United States Patent [19]

Diesch et al.

[11] 4,163,405

[45] Aug. 7, 1979

[54] PAPER FEED CONTROL FOR AUTOMATIC PHOTOGRAPHIC PAPER CUTTER

[75] Inventors: Robert E. Diesch, Rogers; Gerald R. Strunc, Maple Grove, both of Minn.

[73] Assignee: Pako Corporation, Minneapolis, Minn.

[21] Appl. No.: 838,000

[22] Filed: Sep. 29, 1977

[51] Int. Cl.[2] ..... B26D 5/34; B26D 7/06

[52] U.S. Cl. ..... 83/371; 83/211; 83/365; 83/369

[58] Field of Search ..... 83/371, 365, 370, 369, 83/209, 211

[56] References Cited

U.S. PATENT DOCUMENTS

| | | | |
|---|---|---|---|
| 3,143,017 | 8/1964 | Donnell | 83/211 |
| 3,600,997 | 8/1971 | Schmidt | 83/371 |
| 3,811,768 | 5/1974 | Zahn et al. | 83/371 |
| 4,098,158 | 7/1978 | Escales et al. | 83/371 |

*Primary Examiner*—Donald R. Schran

*Attorney, Agent, or Firm*—Kinney, Lange, Westman and Fairbairn

[57] ABSTRACT

An automatic photographic paper cutter cuts photographic prints from a strip of photographic paper which bears cut indicia indicating the locations of desired paper cuts. An indicia sensor is positioned in fixed relationship with respect to the paper cutter knife assembly at a distance less than the shortest length of print to be cut. The paper cutter derives and stores a feed-after-sense signal, which represents the length the paper strip must be fed after a cut indicium is sensed in order for the strip to be cut at the desired cut location represented by that cut indicium. During automatic operation of the paper cutter, the photographic paper strip is advanced until a cut indicium is sensed, is advanced by an additional distance determined by the feed-after-sense signal, is stopped, and is cut at the desired cut location.

9 Claims, 32 Drawing Figures

FIG. 13
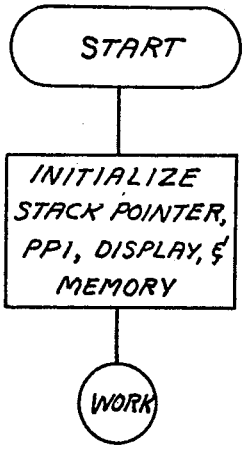
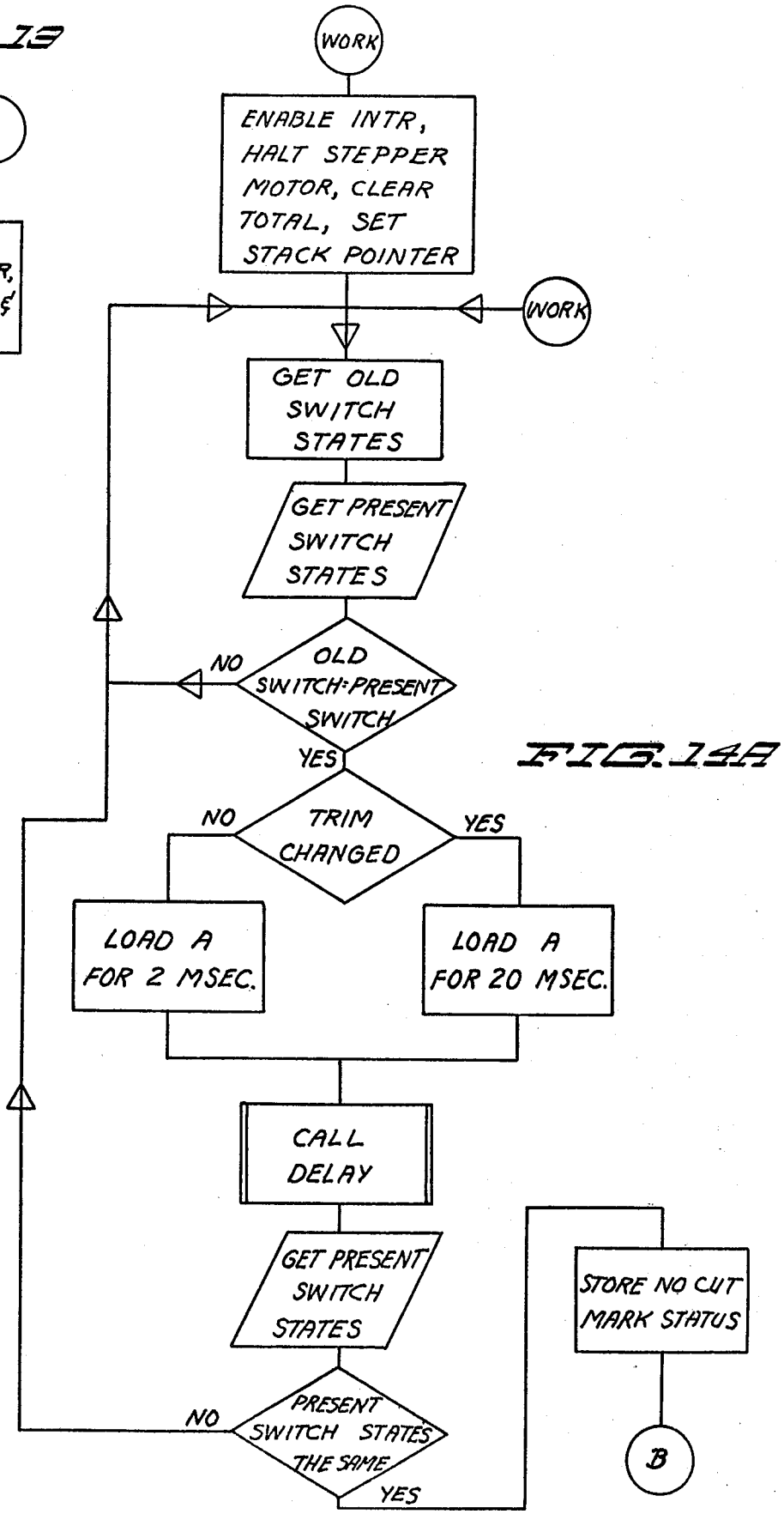
FIG. 14A

TEST 1

NO CUT MARK SELECTED
YES
RAMPD
NO
READY TO RAMP ON
YES
NO
AFTER CUT MARK
YES
END PR
NO
CUT MARK VALID
YES
NOCTM
NO
LOAD CUT WINDOW TO TEST COUNTER & SET CUT MARK VALID
CTCHK
RAMPD
RAMPD
CLEAR READY TO RAMP DOWN
GET NUMBER OF STEPS UNTIL END OF PRINT
NUMBER OF STEPS = Ø
YES
ENDPR
NO
CLEAR MAX SPEED
NO
CUT EARLY
YES
CUT SOLENOID ON
CTCHK

FIG. 20D
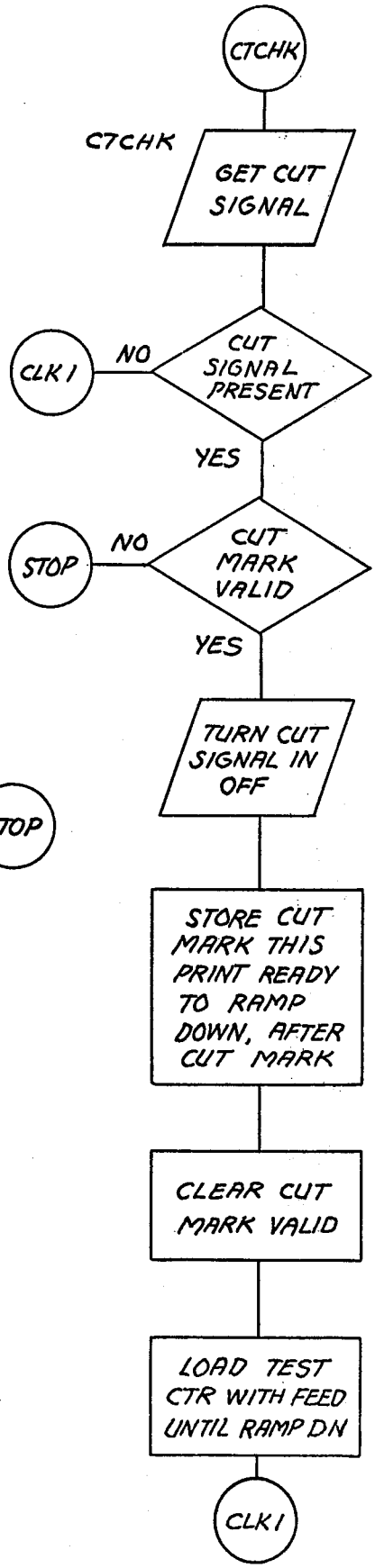
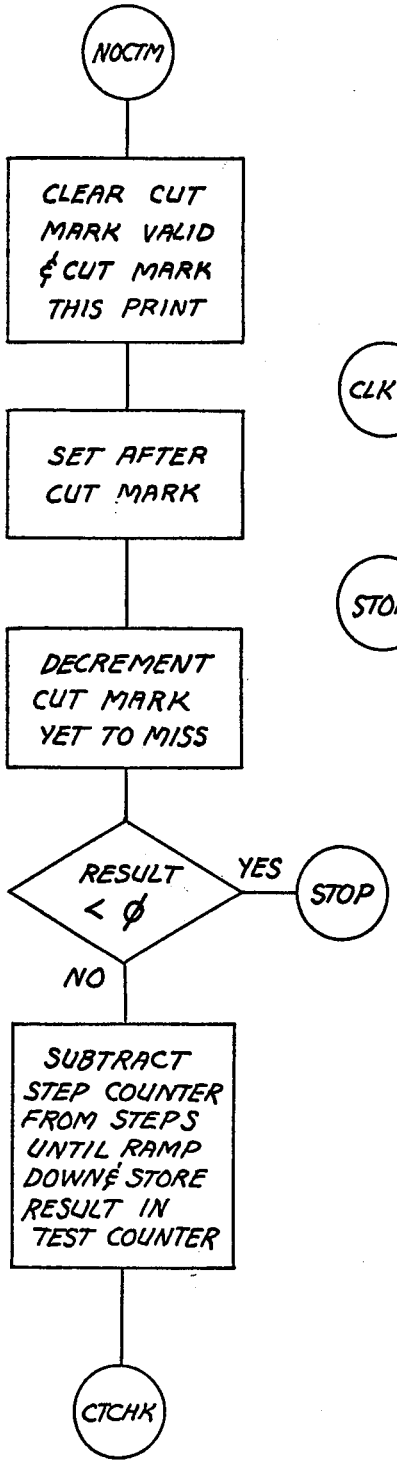
FIG. 20C

PAPER FEED CONTROL FOR AUTOMATIC PHOTOGRAPHIC PAPER CUTTER

REFERENCE TO CO-PENDING APPLICATIONS

Reference is made to the following co-pending patent applications which are filed on even date with this application and are assigned to the same assignee as this application: "Microprocessor Controlled Photographic Paper Cutter" by G. Strunc and F. Laciak; "Paper Drive Mechanism for Automatic Photographic Paper Cutter" by R. Diesch; "Multichannel Indicia Sensor for Automatic Photographic Paper Cutter" by R. Diesch and G. Strunc; "Stepper Motor Control" by G. Strunc; "Print and Order Totalizer for Automatic Photographic Paper Cutter" by G. Strunc; and "Photographic Paper Cutter With Automatic Paper Feed in the Event of Occasional Missing Cut Marks" by G. Strunc. Subject matter disclosed but not claimed in the present application is disclosed and claimed in these co-pending applications.

BACKGROUND OF THE INVENTION

The present invention relates to photographic processing equipment. In particular, the present invention relates to an improved paper feed control system for use in an automatic photographic paper cutter.

In commercial photographic processing operations, very high rates of processing must be achieved and maintained in order to operate profitably. To expedite the photographic processing, orders containing film of similar type and size are spliced together for developing. As many as 500 to 1000 rolls of 12, 20, and 36 exposure film may be spliced together for processing and printing purposes.

After developing, the photographic images contained in the film negatives are printed in an edge-to-edge relationship on a continuous strip of photosensitive paper by a photographic printer. The photographic printer causes high intensity light to be passed through a negative and imaged on the photographic print paper. The photographic emulsion layer on the print paper is exposed and is subsequently processed to produce a print of the image contained in the negative.

After the strip of print paper has been photoprocessed to produce prints, a photographic paper cutter cuts individual prints from the strip. The prints are then sorted by customer order and ultimately packaged and sent to the customer.

Automatic print paper cutters have been developed which automatically cut the print paper into individual prints. These automatic paper cutters are controlled by indicia which are placed along the print paper by the photographic printer. Typically the indicia are of two types: cut marks and end-of-order marks. The cut marks indicate the desired location of a cut between adjacent prints. The end-of-order marks, which typically appear along the opposite edge of the print paper from the cut marks, indicate the end of a customer's order. The automatic paper cutter includes a sensor which senses the cut mark and causes the individual prints to be cut from the strip at the desired locations. The separated prints are passed to an order packaging or grouping device, which groups the prints in response to the end-of-order marks which are sensed by the automatic cutter.

In the prior art automatic paper cutters, the cut mark sensor has been movable along an axis parallel to the paper feed path. The prior art systems have required that the operator position the cut mark sensor at a distance greater than the length of one print from the paper cutter knife. The sensor, therefore, is positioned two cut marks upstream from the knife assembly. When the sensor senses a cut mark, the paper feed is stopped and the paper is cut at a location indicated by the cut mark from the previous paper feed cycle, not the cut location indicated by the cut mark just sensed.

The prior art arrangement has several significant disadvantages. First, it requires the operator to make highly sensitive adjustments to the position of the sensor each time different size prints are to be cut. This is particularly difficult since the knife assembly, for safety reasons, is generally a closed structure. The operator, therefore, must guess on the precise location of the cut mark sensor. The only way that the operator can be certain that the cut mark sensor is in the proper position, is to run repeated tests and readjust the sensor position, if necessary, until the cuts are being made at the correct locations. This operation wastes time and print paper, and is highly operator dependent.

Second, because the cut mark sensor is sensing a cut mark associated with a different cut location from the location then being cut by the knife assembly, inaccurate operation results if the print length varies. The prior art system assumes that all prints on the strip will have equal lengths and that, therefore, it is possible to sense cut marks one or more prints upstream from the knife assembly.

SUMMARY OF THE INVENTION

The paper feed control of the present invention overcomes the shortcomings of the prior art system. In the present invention, the indicia sensing means is positioned in fixed relationship with respect to the paper cutter knife assembly at a distance less than the shortest length of prints to be cut. In fact, in preferred embodiments the indicia sensing means is positioned as close as possible to the knife assembly.

With the system of the present invention, indicia sensing means senses the cut indicium associated with the desired cut location which will be cut at the end of that paper feed and cut cycle, not a cut indicium one or more prints upstream from the desired cut location. Because the distance from the cut indicium to the desired cut location with which it is associated may vary depending upon the manufacturer of the printer which produces the prints and the cut indicia, the present invention includes feed-after-sense signal means which derives and stores a feed-after-sense signal. This feed-after-sense signal indicates the distance which the photographic paper strip must be fed after a cut indicium is sensed so that the desired cut location associated with that cut indicium is properly aligned with the knife assembly.

In operation, the photographic paper is fed until a cut indicium is sensed. The photographic paper continues to be advanced by an additional distance determined by the feed-after-sense signal, is stopped, and cut at the desired cut locations indicated by the cut indicium.

The present invention eliminates the need for time consuming and highly operator sensitive positioning of the indicia sensing means, since the indicia sensing means in the present invention is a fixed distance from the knife assembly. With the present invention, no trial cuts and waste of print paper is required to set up the present invention. Instead, the feed-after-sense signal is derived and stored without any cutting of paper. In addition, print length variation does not affect the accuracy of the system, since the indicia sensing means senses the cut indicium associated with the desired location of the immediately following paper cut, rather than sensing a cut indicium one or more prints upstream.

BRIEF DESCRIPTION OF THE DRAWINGS

FIG. 1 is a perspective view of an automatic paper cutter utilizing the present invention.

FIG. 3 is an electrical block diagram of the automatic paper cutter of FIG. 1.

FIG. 8 is an electrical schematic diagram of the programmable input/output (I/O) device shown in FIG. 4.

FIGS. 13–20D are flow charts illustrating the operation of the present invention.

DETAILED DESCRIPTION OF THE PREFERRED EMBODIMENTS

Introduction

Figure 7:
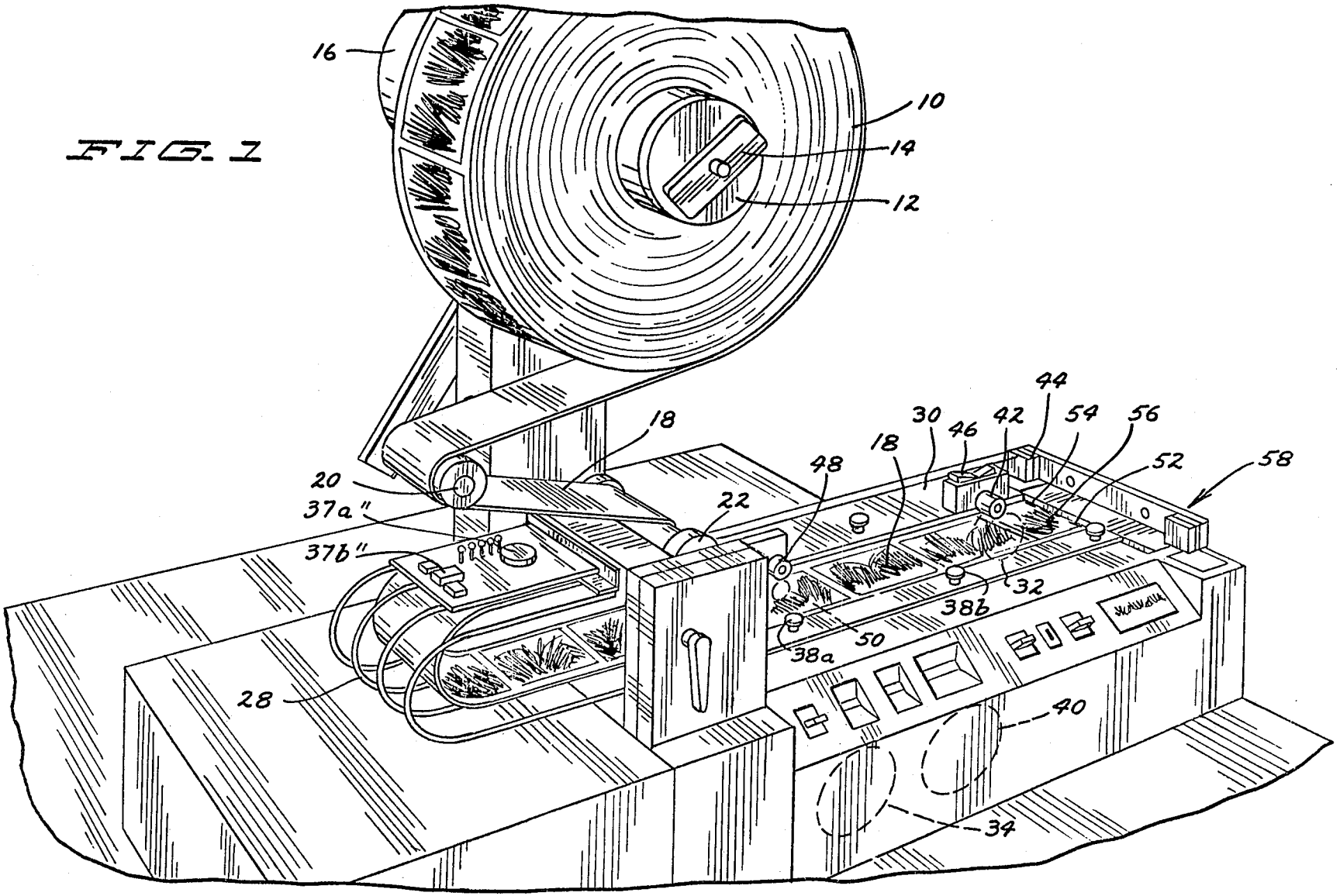
FIG. 7 is an electrical schematic diagram of a portion of the paper cutter control of FIG. 4 including read only memories and associated memory select circuitry.

The paper feed control of the present invention uses a cut indicia sensor which is positioned in a fixed relationship with respect to the paper cutter knife assembly at a distance less than the shortest length of prints to be cut. A feed-after-sense signal is stored which controls the distance that the photographic paper strip is fed after a cut mark is sensed so that the desired cut location is properly aligned with the knife assembly. The system of the present invention is a significant improvement over the prior art systems, which required time consuming and difficult operator adjustments of the cut indicia sensor.

The present invention may use an indicia sensor of the type conventionally used in the prior art, except that the placement of the indicia sensor will differ from the placement used in the prior art, and the electrical circuitry used to control the paper feed mechanism will vary. One particularly advantageous cut indicia sensor is described in the co-pending application entitled: "Multichannel Indicia Sensor for Automatic Photographic Paper Cutter" by R. Diesch and G. Strunc. While this multichannel indicia sensor is particularly advantageous for use in conjunction with the present invention, it also may be used in conjunction with other paper feed systems and, similarly, the paper feed control system of the present invention may utilize other indicia sensors.

The paper feed control of the present invention has been used to considerable advantage in a high-speed, microprocessor controlled, automatic paper cutter. Extremely accurate and high-speed paper feed and cut rates as high as 25,000 3½ inch long prints per hour (i.e. over 7 prints per second) have been achieved with this high-speed, microprocessor controlled, automatic paper cutter. The present invention, therefore, will be described in the context of the high-speed, microprocessor controlled, automatic paper cutter.

The following section, which is entitled, "System Overview," generally describes the operation of the high speed, microprocessor controlled, automatic paper cutter. The following section entitled, "Electrical System," describes those portions of the electrical control system of the automatic paper cutter which pertain to the paper feed control of the present invention. Finally, the section entitled "Paper Feed Control Operation," describes the operation of the paper feed control of the present invention with reference to the various electrical circuits shown in the Figures and to operational flow charts and assembler listings which describe the operations of the microprocessor which pertain to the paper feed control in the present invention.

A complete description of the electrical control system of the automatic paper cutter may be found in the previously mentioned co-pending application entitled: "Microprocessor Controlled Photographic Paper Cutter" and a more detailed description of the paper supply and drive mechanism may be found in the previously mentioned patent application entitled: "Paper Drive Mechanism for Automatic Photographic Paper Cutter." The other co-pending patent application referred to in the "Reference to Co-Pending Applications" also describe various aspects of the automatic photographic paper cutter shown in the Figures. The following description is intended to provide a detailed discussion of the paper feed control of the present invention and, therefore, the other subsystems or components of the automatic photographic paper cutter are described only in that detail required for an understanding of the paper feed control of the present invention.

Paper Cutter System Overview

FIG. 1 is a perspective view of a high speed, microprocessor controlled, automatic paper cutter which includes the paper feed control system of the present invention. The paper cutter includes five major portions: a paper supply, a paper drive mechanism, a knife assembly, main and auxiliary control panels, and control electronics.

The paper supply is an integral part of the paper cutter. A paper roll 10 is loaded from the front on to hub 12, and a lever 14 is tightened to hold paper roll 10 in place. By tightening lever 14, an elastomer material is expanded to give a press fit on the inside diameter of the core of paper roll 10. The rotation of hub 12 is controlled by electro-mechanical brake 16.

Paper strip 18 from roll 10 is trained over bale arm assembly 20 and guide roller 22, between drive and idler pinch rollers (not shown), into wire form retainer 28, and then to paper guides 30 and 32 of the paper drive mechanism. The drive pinch roll is driven by the same AC motor 34 which drives the knife assembly of the paper cutter. The motor 34 drive is transmitted to the drive pinch roller through a belt drive and electromechanical clutch (shown schematically in FIG. 4). When the proper loop is generated, clutch 36 is de-energized and brake 16 is energized to prevent paper from unspooling off roll 10.

The paper drive mechanism includes paper guides 30 and 32, which receive paper strip 18 from the paper supply assembly. Rear guide 30 is fixed and front guide 32 is movable so that various paper widths can be accommodated. Front paper guide 32 is adjusted by loosening thumbscrews 38*a* and 38*b* and moving front guide 32 to the desired position.

Paper strip 18 is driven by stepper motor 40 through idler and drive pinch rollers 42 and 44. Idler roller 42 has a lever 46 to locate idler roller 42 in the engaged position for operation and in the disengaged position for loading paper, shipping, and other non-operating modes. Rollers 42 and 44 are located at the rear edge of strip 18 so the entire print is visible to the operator. Additional guidance of paper strip 18 is provided by another set of idler rollers 48 and 50, which are located near the end of the paper cutter.

Front and rear indicia sensor assemblies 52 and 54 are mounted below top plate 56 and sense all types of marks which appear on the back side of paper strip 18. Cut marks sensed by front or rear sensor assemblies 52 or 54 are used to indicate the location of a desired paper cut.

Knife assembly 58 includes a base, a spring-wrap clutch mechanism 60 (shown schematically in FIG. 4), AC motor 34 (which also drives the drive pinch roller of the paper supply), a main drive shaft, two crank arm assemblies, two vertical drive shafts, and interchangeable blades. One blade is used for cutting straight-bordered and straight-borderless prints, and the other blade is used for cutting round-cornered borderless prints.

Figure 2:
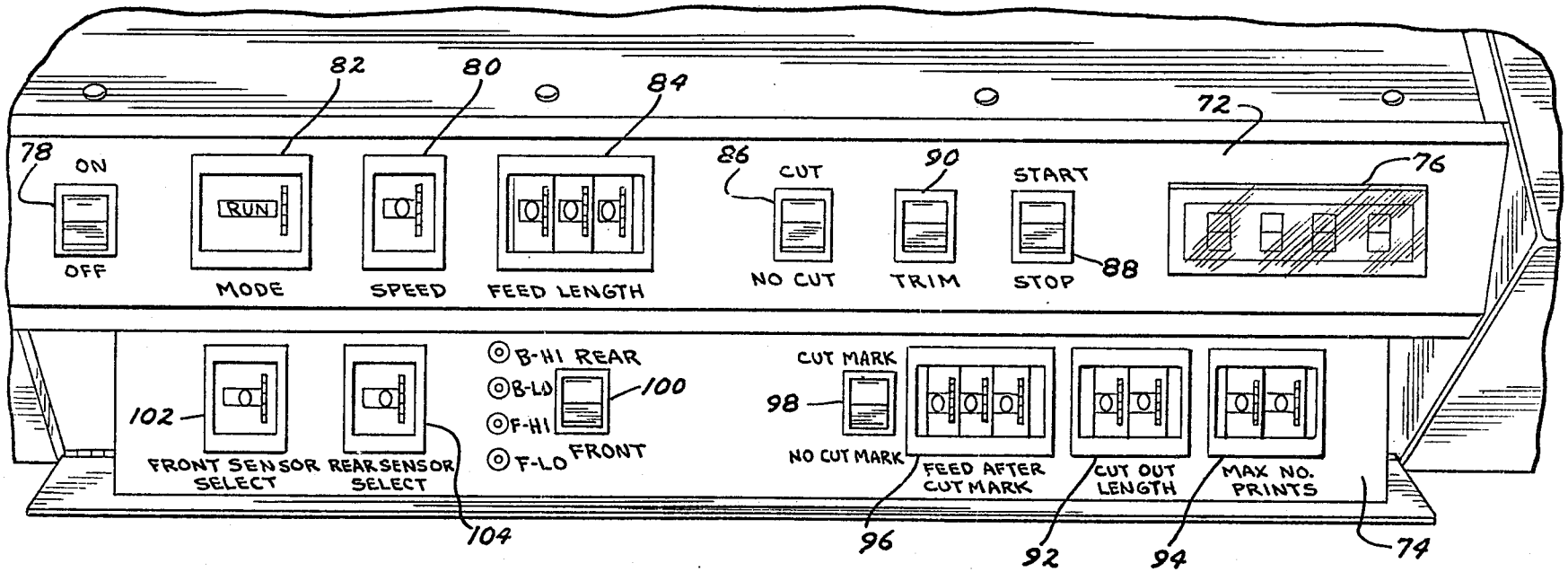
FIG. 2 shows the main and auxiliary control panels of the automatic paper cutter of FIG. 1.

FIG. 2 shows the main and auxiliary control panesl 72 and 74. Main control panel 72, which is located at the front of the paper cutter, has a display 76 and seven switches. These seven switches and Power switch 78, Speed Select switch 80, Mode select switch 82, Feed Length switch 84, Cut/No Cut Switch 86, Start/Stop switch 88, and Trim switch 90.

The remaining seven switches of the automatic paper cutter are located on auxiliary panel 74, which is located below main control panel 72 and is accessible through a hinged cover. The seven switches are Length of Cutout switch 92, Maximum Number of Prints switch 94, Feed-After-Cut Mark switch 96, Cut Mark-/No Cut Mark switch 98, Front/Rear Cut Sensor switch 100, Front Sensor Select switch 102, and Rear Sensor Select switch 104.

The automatic paper cutter operation is commenced by turning on Power switch 78. Front paper guide 32 is then set to the appropriate paper width, paper roll 10 is installed on hub 12, and paper strip 18 is threaded through the paper supply and into the paper cutter.

The operator then selects the proper sensor assembly (either front sensor 52 or rear sensor 54) to sense cut marks by switching Front/Rear Cut Sensor switch 100 to the "Front" or the "Rear" position. The sensor assembly which is not selected is automatically used to sense end-of-order marks, which appear along the opposite edge of paper strip 18 from the cut marks.

The next step involves selecting a proper segment of the sensor assembly so that the largest sensor signal is provided. Mode switch 82 is placed in the SENSOR SELECT mode, and a portion of print paper strip 18 bearing a cut mark or end-of-order mark is oscillated back and forth past the sensor assembly. The operator sets the Front and Rear Sensor Select switches 102 and 104 to the settings which select the proper segments of sensor assemblies 52 and 54 so that the largest sensor signals are provided.

Mode switch 82 is then set to the FEED LENGTH CALIBRATE mode, Start switch 88 is actuated and one print is fed from cut mark to cut mark. The feed length is displayed on display 76, and that value is set into Feed Length switch 84 by the operator.

The operator then sets Mode switch 82 to the FEED AFTER SENSE mode. The edge of a print is aligned with a calibration mark on one of the paper guides 30 and 32. Start switch 88 is actuated and the paper advances to the next cut mark and stops. The feed after sense length is displayed on display 76, and the operator sets that value into Feed-After-Sense switch 96.

The operator then sets Mode switch 82 to the RUN mode and sets Speed switch 80 to the desired cycle rate. If bordered or round-cornered borderless prints are being cut, the paper cutter is then ready to operate. If straight borderless prints are being cut, the length of cutout must be set in Length of Cutout switch 92.

Automatic operation of the paper cutter can then be commenced by actuating Start switch 88. At the end of a shift or the end of a day, summary modes are available in which the total prints cut and total orders cut during that shift or that day are displayed on display 76.

Electrical System Description

FIG. 3 is an electrical block diagram of the automatic photographic paper cutter. As shown in FIG. 3, power supply 150 supplies power to the various circuits and motors contained in the paper cutter. Power supply 150 is controlled by Power switch 78.

Paper cutter control 154 controls the operation of the paper cutter. Paper cutter control 154 receives inputs from the various switches of main control panel 72 and auxiliary panel 74 through control panel logic circuit 156. In addition, signals from reject/remake sensor 158, front indicia sensor 52 and rear indicia sensor 54 are processed by sensor amplifier circuit 160 and supplied through auxiliary panel 74 and control panel logic 156 to paper cutter control 154. Paper cutter control 154 also may receive inputs from optional foot switch 162 and print packer 164. Foot switch 162 is connected in parallel with the start contacts of start/stop switch 88 of main control panel 72 and allows the operator to initiate a feed-and-cut cycle without the use of hands. Packer 164 may be a photographic print sorter and packer such as the PAKOMP II photopacker manufactured by PAKO Corporation. If the paper cutter is to be used in conjunction with packer 164, interconnection is necessary in order to coordinate the operation of the two devices.

The outputs of paper cutter control 154 control the operation of stepper motor 40. Control of AC motor 34 is achieved by means of knife clutch 60, paper clutch/-brake driver assembly 166, paper brake 16, and paper clutch 34. Paper cutter control 154 also supplies signals to control panel logic 156 which control display 76 on the main control panel 72, and supplies output signals to packer 164 if the paper cutter is being used in conjunction with packer 164.

Figure 4:
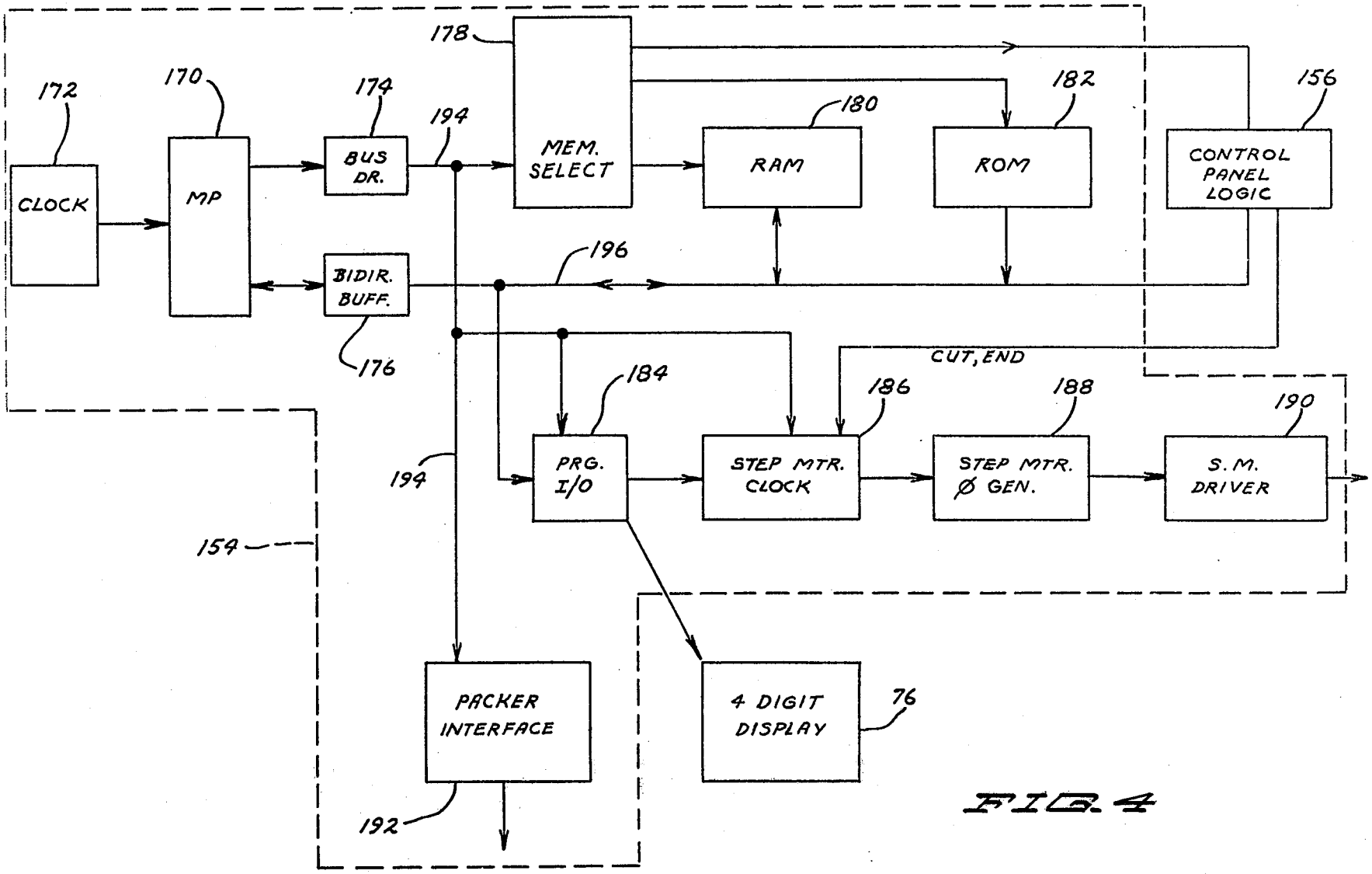
FIG. 4 is an electrical block diagram of the paper cutter control shown in FIG. 3.
Figure 5:
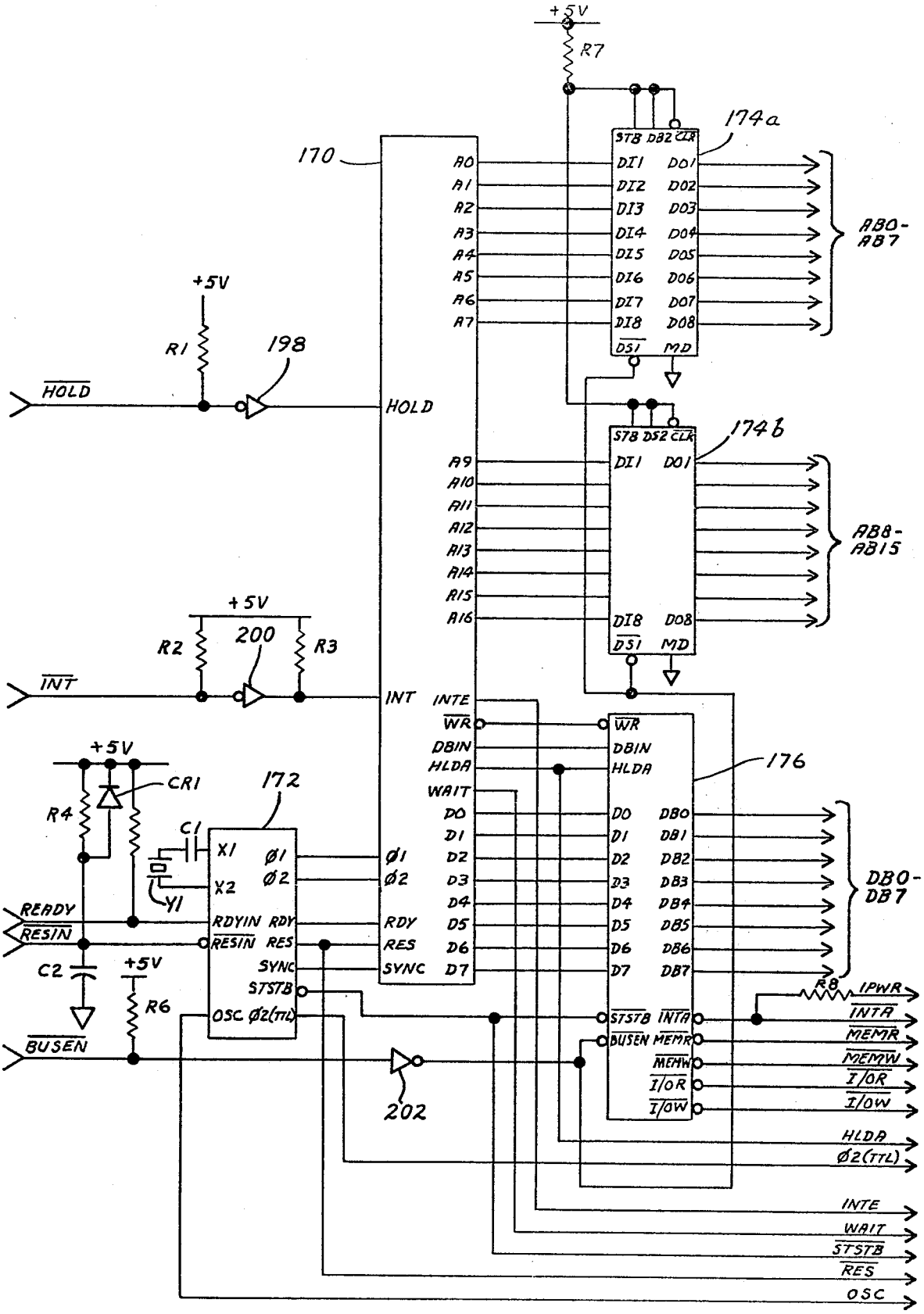

FIG. 4 shows an electrical block diagram of paper cutter control 154. The paper cutter control includes microprocessor 170, clock 172, bus driver 174, bidirectional buffer 176, memory select circuit 178, random access memory (RAM) 180, read only memory (ROM) 182, programmable input/output (I/O) device 184, stepper motor clock 186, stepper motor phase generator 188, stepper motor driver 190, and packer interface circuit 192.

In one preferred embodiment, microprocessor 170 is an 8-bit microprocessor such as the Intel 8080A. Clock circuit 172 supplies clock signals, together with some other related signals, to microprocessor 170. Bus driver 174 receives outputs from microprocessor 170 and drives various lines of address bus 194. Memory select circuit 178 receives the signals from address bus 194 and addresses selected locations of RAM 180 or ROM 182. In addition, memory select circuit 178 may address the control panel logic 156 shown in FIG. 3 to interrogate the various switches of main and auxiliary control panels 72 and 74. In the system shown in FIG. 4, the switches of main and auxiliary panels 72 and 74 are addressed in the same manner as a memory location. Data to and from RAM 180 and data from ROM 182 and control panel logic 156 is supplied over data bus 196. Bidirectional buffer 176 interconnects microprocessor 170 with data bus 196.

Programmable I/O device 184 is also connected to data bus 196 and receives data from microprocessor 170. This data is used to control operation of stepper motor 40 through stepper motor clock 186, stepper motor phase generator 188, and stepper motor driver 190. In addition to the output signals from programmable I/O device 184, stepper motor clock receives the CUT and END signals from control panel logic 156.

Programmable I/O device 184 also controls the operation of display 76. Depending upon the particular mode selected by mode switch 82 on main control panel 72, display 76 may display the feed length, the feed-after-sense length, the number of prints in the previous order, the total number of prints since the cutter was turned on, or the total number of orders since the cutter was turned on.

As shown in FIG. 4, packer interface circuit 192 is also connected to address bus 194. Packer interface circuit 192 supplies the necessary signals to packer 164 of FIG. 3 to coordinate the operation of packer 164 with the operation of the automatic paper cutter.

Figure 5:
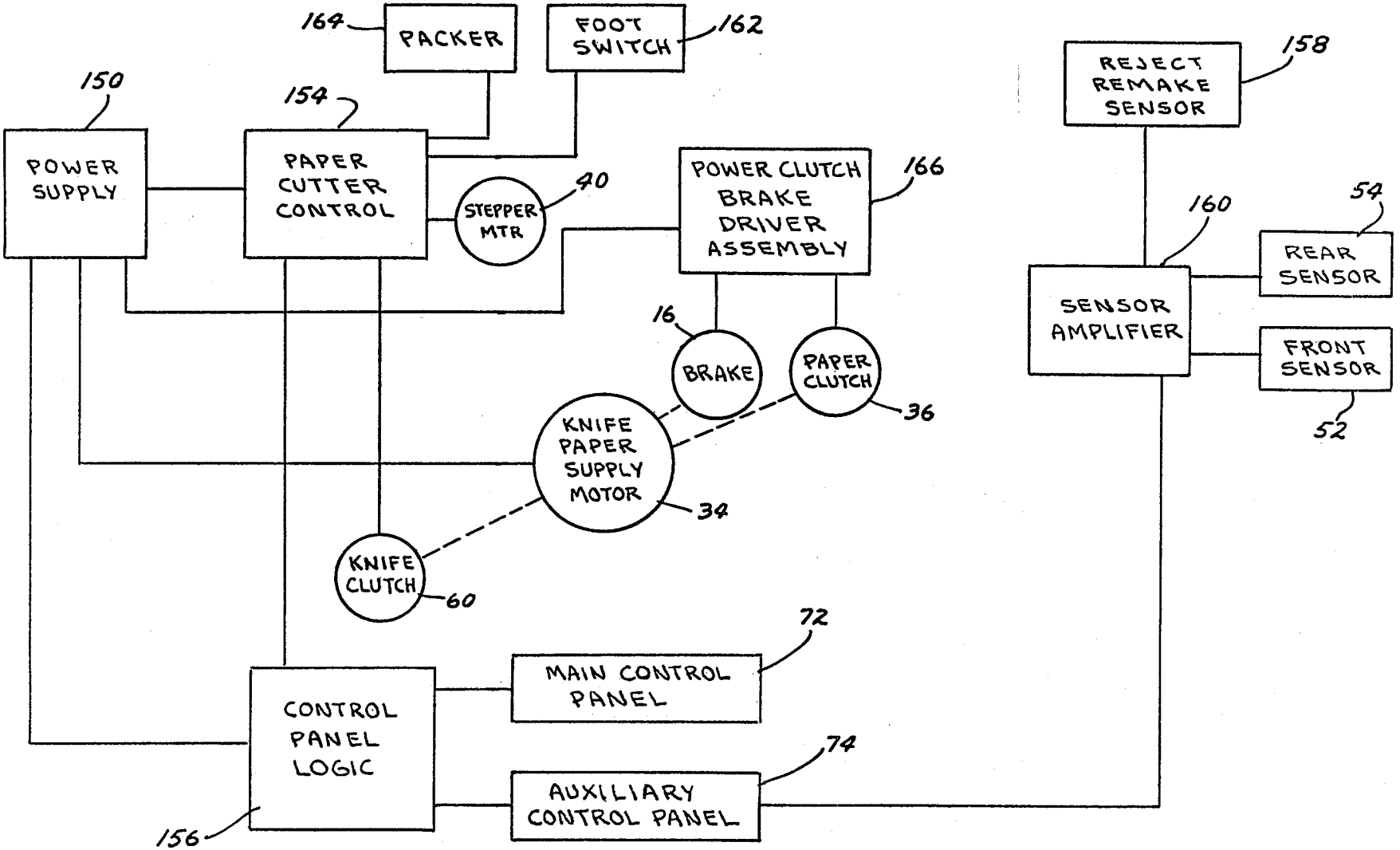
FIG. 5 is an electrical schematic diagram of a portion of the paper cutter control of FIG. 4 including a microprocessor, a clock, bus drivers, and a bidirectional buffer.

FIG. 5 shows a portion of cutter control 154 including microprocessor 170, clock 172, bus drivers **174*a* and 174*b*, and bidirectional buffer 176. Also included in the circuit of FIG. 8 are resistors R1-R8, capacitors C1 and C2, diode CR1, and inverters 198, 200, 202, and 204**.

Clock 172, which in one preferred embodiment is an Intel 8224 integrated circuit, provides the $\phi 1$ and $\phi 2$ clock signals to microprocessor 170. The frequency of the $\phi 1$ and $\phi 2$ clock signals is determined by oscillator crystal Y1 and capacitor C1. In one preferred embodiment, crystal Y1 is selected to provide an 18.432 MHz oscillation.

In addition to the $\phi 1$ and $\phi 2$ clock signals, clock generator 172 also provides the RDY, RES, and SYNC signals to microprocessor 170, the $\overline{\text{STSTB}}$ signal to bidirectional buffer 176, and the $\phi 2$ (TTL) and OSC signals to other circuits within cutter control 154.

In addition to the signals supplied by clock 172, microprocessor 170 receives the HOLD signal from inverter 198 and the interrupt (INT) signal from inverter 200. The outputs of microprocessor 170 include address lines A0–A15, which are supplied to bus drivers **174*a* and 174*b*. The outputs of bus drivers 174*a* and 174*b* are address bus lines AB0–AB15, which form a 16 line address bus 194. Bus drivers 174*a* and 174*b* are enabled by the BUSEN signal from invertor 202**.

Microprocessor 170 includes input/output ports D0–D7 for receiving and supplying data. D0–D7 are connected to bidirectional buffer 176, which also receives the $\overline{\text{WR}}$, DBIN, and HLDA signals from microprocessor 170, the $\overline{\text{STSTB}}$ signal from clock 172, and the BUSEN signal from inverter 202.

Data lines DB0–DB7 of data bus 196 are connected to bidirectional buffer 176, which permits bidirectional flow of data on data bus 196 to and from microprocessor 170. In addition, bidirectional buffer 176 generates the $\overline{\text{INTA}}$, IPWR, $\overline{\text{MEMR}}$, $\overline{\text{MEMW}}$, $\overline{\text{I/OR}}$, and $\overline{\text{I/OW}}$ signals which determine the direction of flow of dataon data bus 196 and control the operation of the various circuits connected to data bus 196.

The remaining signals generated by the circuit shown in FIG. 5 are generated by microprocessor 170. These signals are the HLDA, INTE, and WAIT signals.

Figure 6:
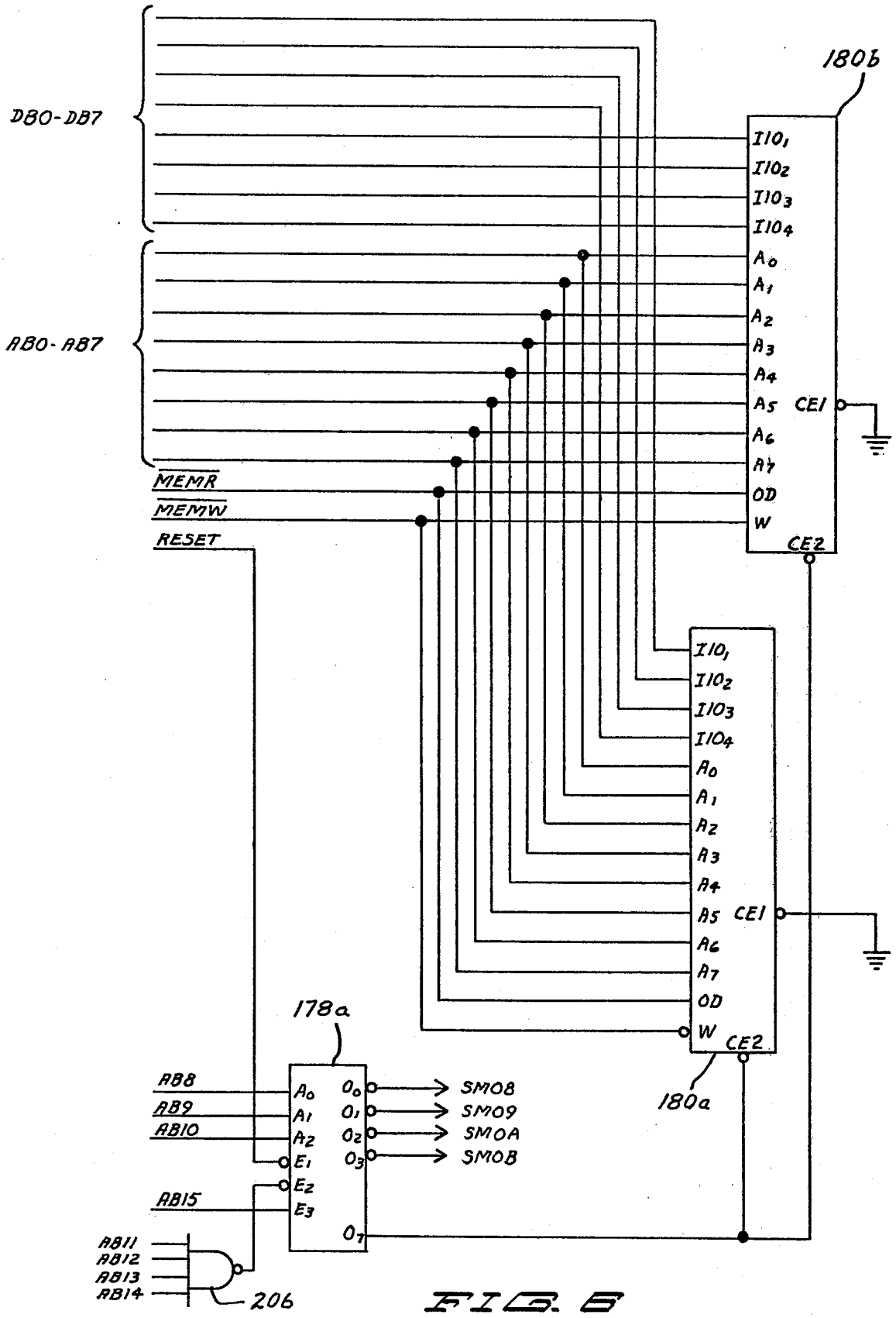
FIG. 6 is an electrical schematic diagram of a portion of the paper cutter control of FIG. 4 including random access memories and associated memory select circuitry.
Figure 7:
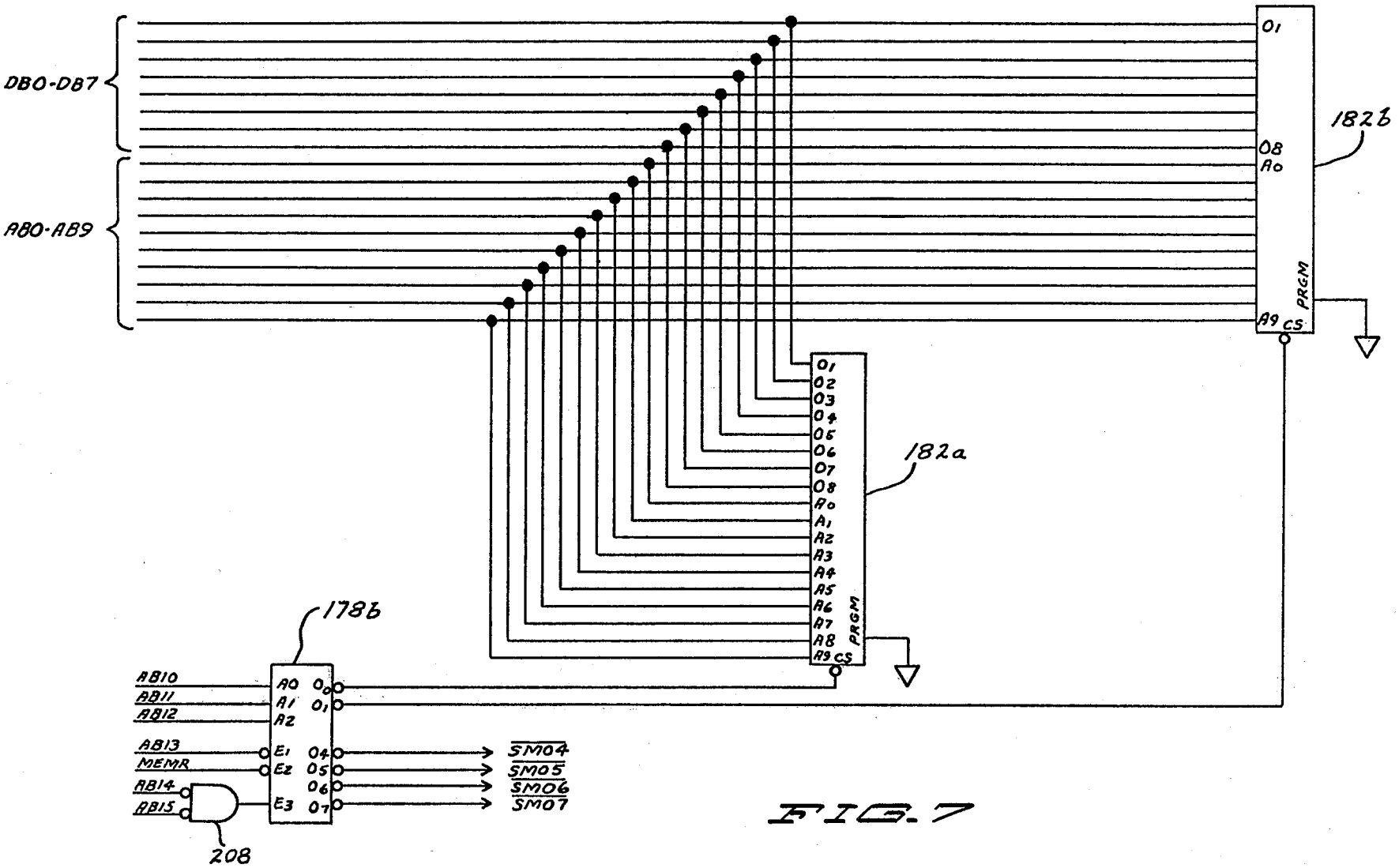

FIG. 6 shows random access memories **180*a* and 180*b*, together with NAND gate 206 and memory select circuit 178*a*. In a preferred embodiment, random access memories 180*a* and 180*b* are Intel 8111-1 integrated circuits and memory select 178*a*** is an Intel 8205 integrated circuit.

Depending upon the states of address bus lines AB-8–AB15, memory select **178*a* provides an enable signal to either RAM 180*a* or 180*b*, or will generate an enable signal on lines SM08, SM09, SM0A, or SM0B**.

If either RAM **180*a* or RAM 180*b* is selected, data will either be written into or read from memory locations of the RAM. The state of the $\overline{\text{MEMW}}$ signal, which is supplied to the W inputs of RAMs 180*a* and 180*b*** determines whether data is written or read.

As shown in FIG. 6, the random access memory includes only two RAM integrated circuits **180*a* and 180*b*. If further storage is required, as many as six additional RAM integrated circuits may be connected and addressed memory select 178*a***. In the embodiment of the automatic paper cutter described in the present application, however, two RAM integrated circuits is sufficient to provide the necessary storage.

FIG. 7 shows ROMs **182*a* and 182*b*, memory select circuit 178*b*, and NAND gate 208. Memory select circuit 178*b* enables either ROM 182*a* or 182*b* depending upon the state of address bus lines AB10–AB15 and the $\overline{\text{MEMR}}$ signal. In addition, memory select circuit 178*b*** produces the $\overline{\text{SM04}}$–$\overline{\text{SM07}}$ signals.

In a preferred embodiment, ROMs **182*a* and 182*b* are erasable programmable read-only memories (EPROM) such as the Intel 8708. When either ROM 182*a* or 182*b* is enabled, address bus lines AB0–AB9 select the particular memory location, and data read from that location is supplied on data bus lines DB0–DB7**.

As in the case of the random access memory shown in FIG. 6, the read-only memory of FIG. 7 may include additional memory circuits if additional storage is required. With the configuration shown in FIG. 7, two additional Intel 8708 EPROMs may be added without requiring additional memory select circuitry.

FIG. 8 shows programmable I/O device 184 together with NAND gates 210 and 212 and inverter 214. In a preferred embodiment, programmable I/O device 184 is an Intel 8255 integrated circuit and NAND gates 210 and 212 and inverter 214 are TTL logic gates. Except where otherwise specifically indicated, all logic gates shown in the figures are CMOS integrated circuit devices.

Programmable I/O device 184 receives data bus lines DB0–DB7, address bus lines AB0 and AB1, and the $\overline{I/OW}$, $\overline{I/OR}$, and RES lines. In addition, address bus lines AB2 and AB3 are NANDed with address bus line AB13 by NAND gate 212. The output of NAND gate 212 is inverted by inverter 214 and supplied to the CS input of programmable I/O device 184.

Programmable I/O device 184 has two 8-line outputs. The first set of 8 outputs, which are designated PA0–PA7, are supplied to the inputs of stepper motor clock generator 186. The 8-bit number supplied on lines PA0–PA7 is used to control the frequency of the output of the stepper motor clock generator 186 and, therefore, the speed of stepper motor 40.

The PBO–PB7 outputs from programmable I/O device 184 are supplied to the main control panel 72. Lines PB0–PB7 are decoded and are used to drive display 76.

Figure 9:
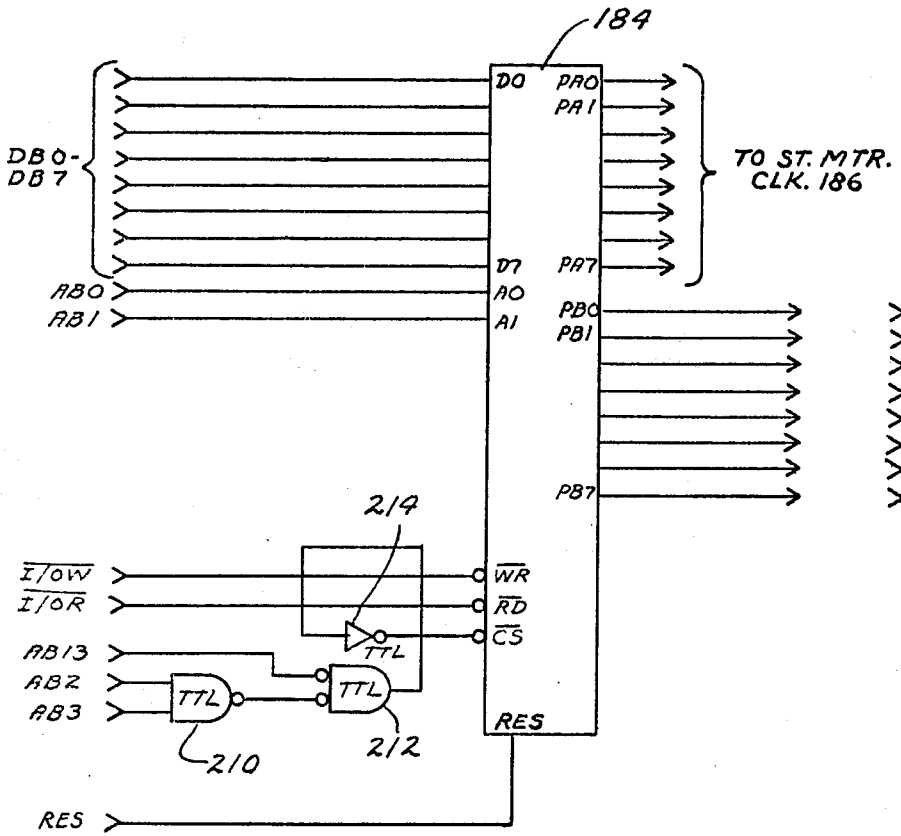
FIG. 9 is an electrical schematic diagram of the packer interface shown in FIG. 4.
Figure 9:
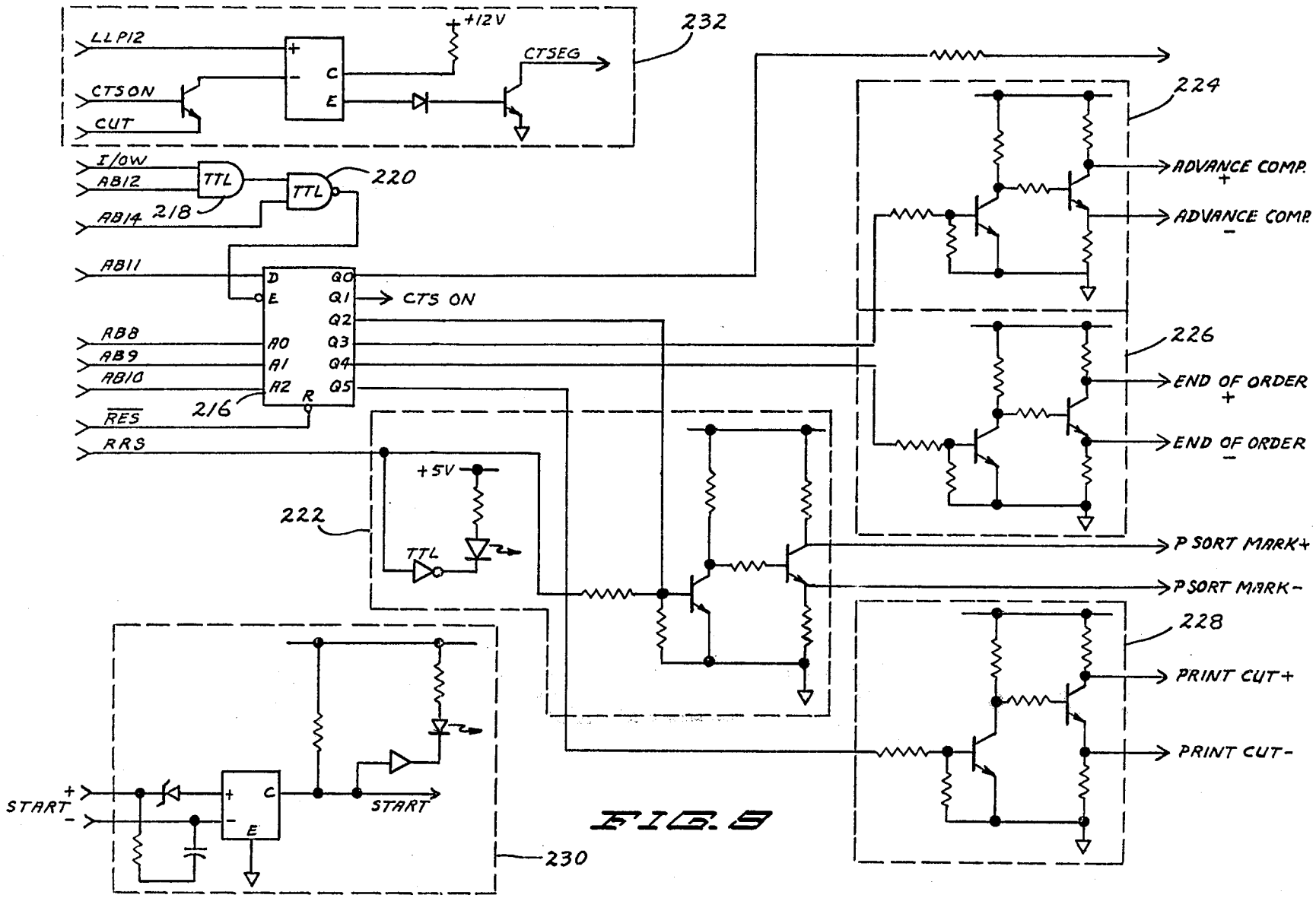

FIG. 9 shows circuitry which is primarily the packer interface 192 as shown in FIG. 4. This circuitry is used to provide the necessary signals to packer 164 shown in FIG. 3 in order to coordinate the operation of the automatic paper cutter with packer 164.

The interface circuitry of FIG. 9 includes an 8-bit adjustable latch 216, TTL NAND gates 218 and 220, and driver circuits 222, 224, 226, and 228 for producing the P SORT MARK + and −, ADVANCE COMPLETE + and −, END OF ORDER + and −, PRINT CUT + and − signals which are supplied to packer 164. In addition, FIG. 9 includes circuit 230 which receives the START + and − signals from packer 164 and supplies the START signal to control panel logic 156. Finally, FIG. 9 includes driver circuit 232 which produces the CTSEG signal which energizes the cutter knife.

The A0, A1, and A2 inputs of latch 216 receive the AB8, AB9, and AB10 address bus lines. The D input of latch 216 is connected to AB11, the R input receives the $\overline{RES}$ signal, and the E input receives an enable signal which results from the NANDing of $\overline{I/OW}$, AB12, and AB14 by NAND gates 218 and 220.

The Q0 output of latch 216 is supplied through resistor R9 to stepper motor driver 190 as the OFF—signal. The Q1 output of latch 216 is the CTSON signal which is supplied to driver circuit 232. When the CTSON and LPP12 signals are high and the CUT signal is low, driver circuitry 232 provides the CTSEG signal which controls the operation of the cutter knife assembly.

Outputs Q2–Q5 of latch 216 are used to generate signals for packer 164. The Q2 output is supplied to driver circuit 222, which generates the P SORT MARK + and P SORT MARK - signals. Driver circuit 222 also receives the RRS signal from sensor amplifier 160. The RRS signal is high if reject/remake sensor 185 senses a mark on a print indicating that the print is a reject or a remake print.

The Q3 output of latch 216 is supplied to driver circuit 224, which provides the ADVANCE COMPLETE + and ADVANCE COMPLETE − signals to packer 164. Similarly, the Q4 output is supplied to driver circuit 226, and a Q5 output is supplied to driver circuit 228. Driver circuit 226 supplies the END OF ORDER + and END OF ORDER − signals to packer 164, while driver circuit 228 supplies the PRINT CUT + and PRINT CUT − signals to packer 164.

Circuit 230 shown in FIG. 9 receives the START + and START − signals from packer 164 and generates a START signal which is supplied to control panel logic 156. The START signal allows packer 164 to initiate a paper feed and cut cycle independent of start switch 88 on main control panel 72.

Figure 10A:
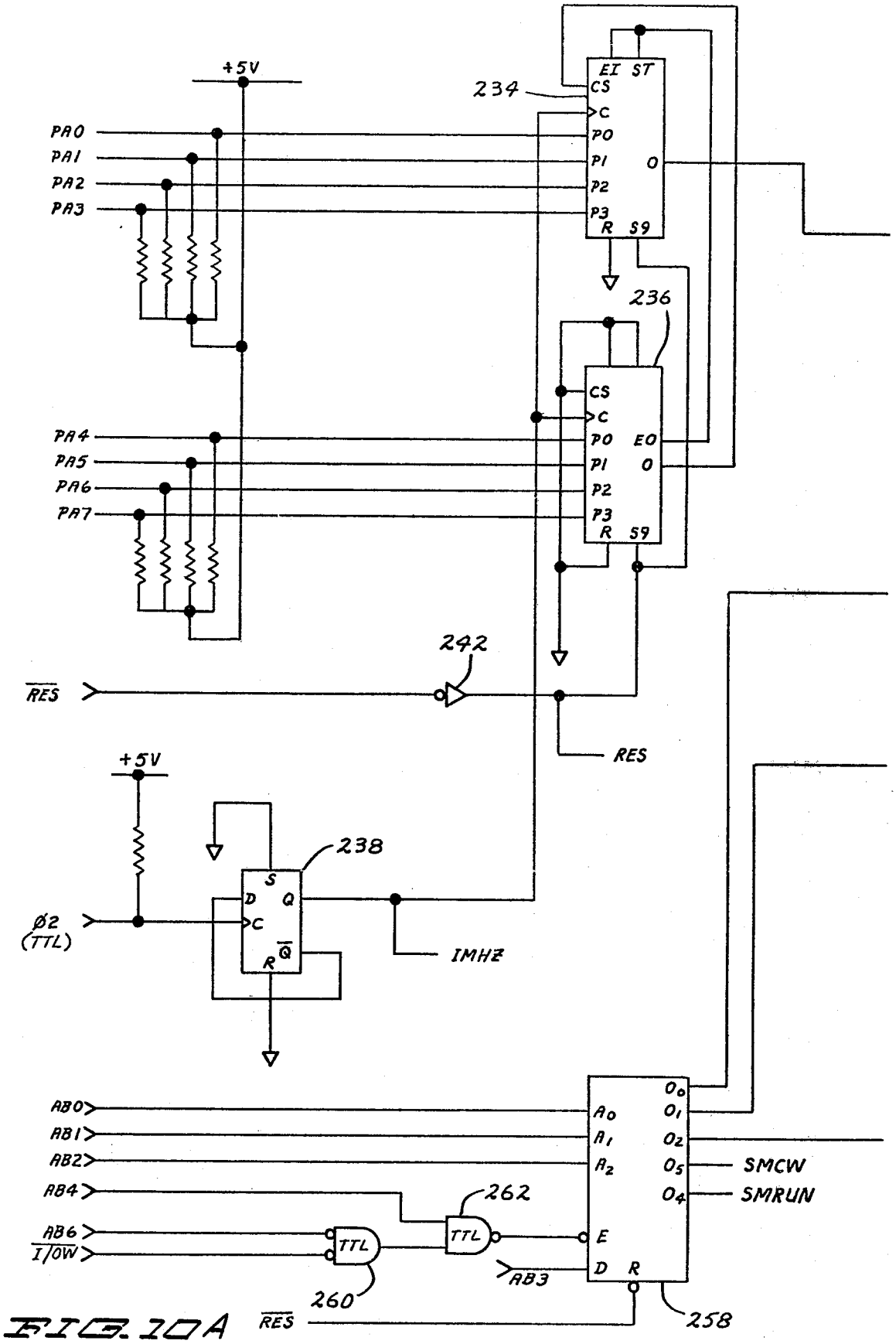
FIGS. 10A and 10B are an electrical schematic diagram of the stepper motor clock shown in FIG. 4.
Figure 10B:
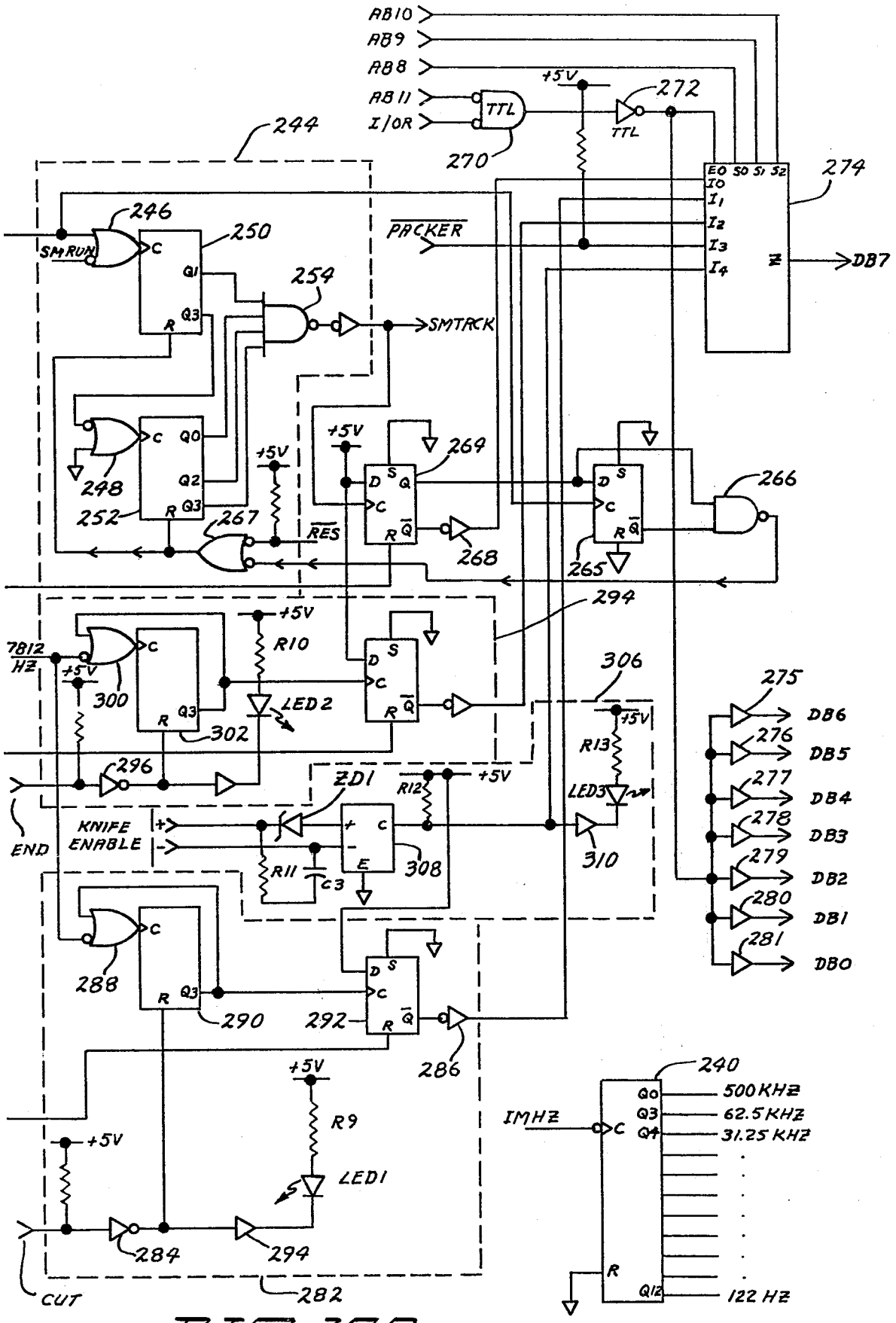

FIGS. 10A and 10B show stepper motor clock 186, which produces the SMTRCK and SMCW signals. The SMTRCK signal is a stepper motor clock signal, and each pulse of the SMTRCK signal corresponds to one step of stepper motor 40. The SMCW signal determines whether stepper motor will be driven clockwise or counterclockwise. Both the SMTRCK and SMCW signals are provided to stepper motor phase generator 188.

The frequency of the SMTRCK signal is determined by inputs PA0–PA7, which are received from programmable I/O device 184. These inputs represent two-digit binary coded decimal (BCD) number. Inputs PA0–PA3 represent the least significant bit, and PA4–PA7 represent the most significant bit. BCD rate multiplier 234 receives inputs PA0–PA3, and BCD rate multiplier 236 receives input PA4–PA7. The two-digit BCD numbers supplied to rate multipliers 234 and 236 represent the number of output pulses produced by the 0 output of rate multiplier 234 per one hundred clock pulses from flipflop 238. In the embodiment shown in FIGS. 10A and 10B, flipflip 238 receives the $\phi 2$ signal which has a frequency of 2 MHz from clock 172 and divides the frequency in half to produce a 1 MHz clock signal. In addtion to supplying the 1 MHz signal to rate multipliers 234 and 236, flipflop 238 also supplies the signal to the clock input of counter 240, which divides the frequency to generate other needed clock frequencies.

The $\overline{RES}$ signal, which is low when power is turned on, is inverted by TTL inverter 242. The RES signal, which is the output of inverter 242, is supplied to the S9 inputs of rate multipliers 234 and 236 to enable them.

The output of rate multiplier 234 is a pulse signal. The number of pulses per one hundred clock pulses is determined by the BCD number supplied on lines PA0–PA7. This number may vary from 0 to 99.

The output of rate multiplier 234 is supplied to a smoothing circuit 244 formed by OR gates 246 and 248, counters 250 and 252, NAND gate 254, and inverter buffer 256. The output of smoothing circuit 244 is the SMTRCK signal. The purpose of smoothing circuit 244 is to smooth variations in spacing between output pulses of rate multiplier 234. The SMTRCK signal is a signal whose spacing between pulses is relatively uniform and whose frequency is determined by the BCD inputs to rate multipliers 234 and 236.

It can be seen that stepper motor clock 186 shown in FIGS. 10A and 10B permits control of the frequency of the SMTRCK signal and, therefore, control of the speed of stepper motor 40 by microprocessor 170. The desired values for the BCD inputs to rate multipliers 234 and 236 are preferably stored in "lookup tables." These lookup tables contain numbers which control the maximum frequency of the SMTRCK signal, as well as a set of frequencies used to generate an up ramp in frequency at the beginning of stepper motor operation or a down ramp in frequency at the end of stepper motor operation.

The remaining circuitry shown in FIGS. 10A and 10B allows microprocessor 170 to monitor status of a number of important signals and to control generation of the SMTRCK as a function of the status of these signals. The first portion of this circuitry includes 8-bit adjustable latch 258, TTL NAND gates 260 and 262, flipflops 264 and 265, NAND gate 266, NOR gate 267 and inverter 268. Latch 258 is enabled when AB4 is high, AB6 and I/OW are low, and power is on so that the the reset signal ($\overline{RES}$) is low. The output states of latch 258 are determined by address bus lines AB-0–AB3.

The $O_0$ and $O_4$ outputs of latch 258 directly control the production of the SMTRCK signal. The $O_4$ output is the SMRUN signal, which is supplied to the inverting input of OR gate 246 and which must be high for the SMTRCK signal pulses to be produced.

When a SMTRCK signal pulse is produced, it clocks flip-flop 264 and causes the $\overline{Q}$ output of flipflop 264 to go low. This causes a high reset signal to be supplied to counters 250 and 252 by NOR gate 266. Further SMTRCK pulses are inhibited, therefore, until the $O_0$ output of latch 258 resets flipflop 264.

The stepper motor clock, therefore, produces only one pulse at a time and microprocessor 170 must cause flipflop 264 to be reset before the next SMTRCK pulse (and therefore the next stepper motor step) is produced.

Microprocessor 170 periodically interrogates the status of flipflop 264, as well as the status of several other signals. This interrogation is achieved by TTL NAND gate 270, TTL inverter 272, 8-bit multiplexer 274, and buffers 275–281.

The state of the $I_0$ input to multiplexer 274 indicates the state of flipflop 264. This input, therefore, indicates whether a SMTRCK pulse has been produced and a step of the stepper motor has been taken.

The $I_1$ input to multiplexer 274 is received from the CUT signal status circuit 282, which includes inverters 284 and 286, OR gate 288, counter 290, flipflop 292, and an indicator circuit formed by buffer 294, resistor R9, and light emitting diode LED1. Prior to receiving the CUT signal, which indicates that a cut mark has been sensed, the $\overline{Q}$ output of flipflop 292 is high and the $I_1$ input to multiplexer 274 is low. When the CUT signal goes high, the output of inverter 284 goes low, thereby removing the reset from counter 290 and causing LED1 to turn on. If the CUT signal remains high for the time required for counter 290 to count until its $Q_3$ output goes high, flipflop 292 will be clocked and the $\overline{Q}$ output will go low. A high input at the $I_1$ input to multiplexer 274, therefore, indicates a cut mark has been sensed. The $I_1$ input remains high until flipflop 292 is reset by the O2 output of latch 258.

$I_2$ input to multiplexer 274 is received from the END signal status circuit 294. END signal status circuit 294 is essentially identical to cut signal status circuit 282 and contains inverters 296 and 298, OR gate 300, counter 302, flipflop 304, and an indicator circuit including buffer 306, resistor R10, and LED2. The $I_2$ input to multiplexer 274 is low until the END signal goes high, at which time input $I_2$ goes high. It remains high until flipflop 304 is reset by the $O_1$ output of latch 258.

The $I_3$ input to multiplexer 274 is $\overline{PACKER}$ signal. This signal indicates whether the automatic paper cutter is being operated in conjunction with a photo packer.

The $I_4$ input to multiplexer 274 is received from KNIFE ENABLE status circuit 306, which includes resistors R11 and R12, capacitor C3, Zener diode ZD1, optoisolator 308, and an indicator circuit formed by buffer 310, LED3, and resistor R13. KNIFE ENABLE status circuit 306 received the KNIFE ENABLE + and – signals from packer 164. The $I_4$ input to multiplexer 274 is high when the KNIFE ENABLE + and – signals from packer 164 call for enabling of the paper cutter knife assembly.

Microprocessor 170 interrogates multiplexer 274 when the AB11 and $\overline{I/OR}$ signals are low. This causes multiplexer 274 to be enabled and also causes the outputs of buffers 275–281, which are connected to data bus lines DB0–DB6, to be low. only DB7, which is the output of the multiplexer 274, supplies data to microprocessor 170. Address lines AB8–AB10 select the particular input of multiplexer 274 which is connected to DB7.

Stepper motor phase generator circuit 188 of FIG. 4 receives the SMTRCK and SMCW signals from stepper motor driver 90 (shown in FIG. 4). Each pulse of the SMTRCK results in one step of stepper motor 40. The SMCW signal determines the direction of the stepper motor steps by controlling the phase relationship of the stepper motor phase signals produced by stepper motor phase generator circuit 188.

A detailed description of one successful embodiment of stepper motor phase generator circuit 188 and stepper motor driver 190 may be found in the previously mentioned co-pending application entitled "Stepper Motor Control." Further detailed discussion of the operation of stepper motor phase generator circuit 188 and stepper motor driver 190 is not necessary for an understanding of the present invention, and will not be undertaken in the present patent application.

Similarly, a detailed description of specific indicia sensor assemblies 52 and 54 and sensor amplifier circuit 160 used in one successful embodiment of the high speed, microprocessor controlled, automatic paper cutter may be found in the previously mentioned co-pending application entitled "Multichannel Indicia Sensor for Automatic Photographic Paper Cutter," and will not be discussed in detail in the present application. For the purposes of this present invention, either the multichannel indicia sensor assembly described in the above-mentioned patent application or other sensor assemblies of the type used in the prior art may be used.

A critical feature of the present invention which differs from prior art systems is that the sensor assembly is mounted a fixed distance from the knife assembly which is less than the length of the shortest print to be cut. The sensor, therefore, senses the cut mark which is associated with the location of the next cut, not a cut mark one or more prints upstream. The particular configuration of indicia sensor assemblies 52 and 54 and sensor amplifier circuit 160 is not critical to the present invention, so long as a CUT signal is generated when a cut mark is sensed and so long as the position of each sensor assembly is fixed with respect to the knife assembly at a distance less than the shortest print to be cut.

Figure 12:
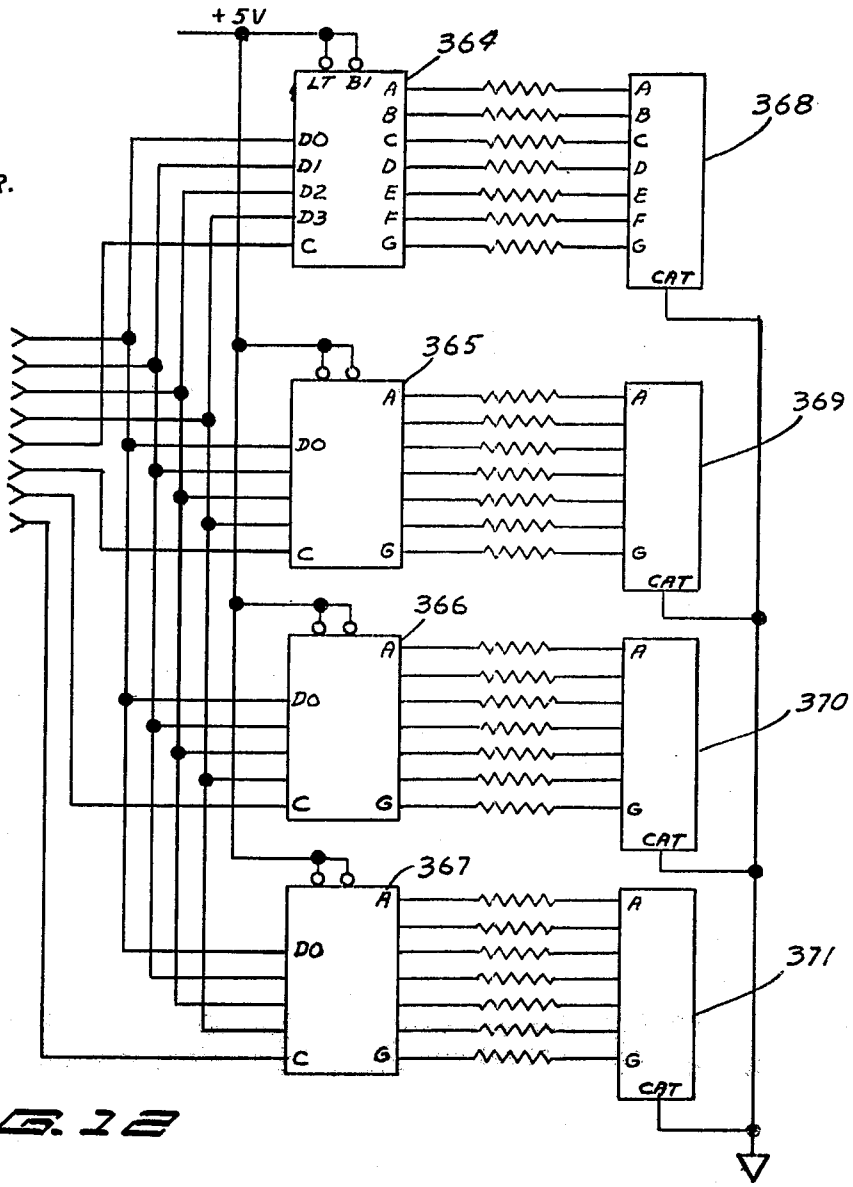
FIG. 12 is an electrical schematic diagram of the display on the main control panel.
Figure 11A:
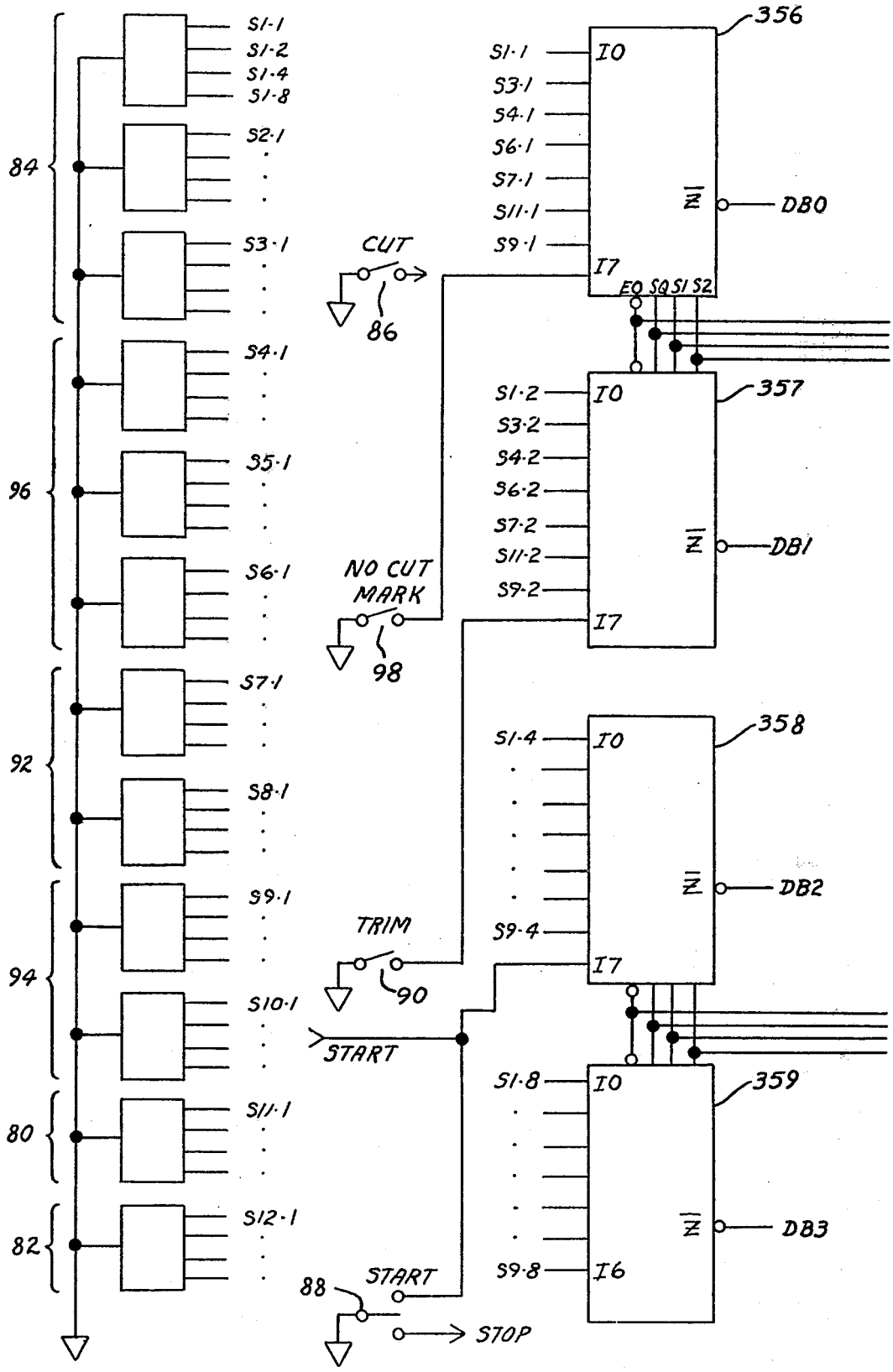
FIGS. 11A and 11B are an electrical schematic diagram of some of the switches of the main and auxiliary control panel, together with associated control panel logic.
Figure 11B:
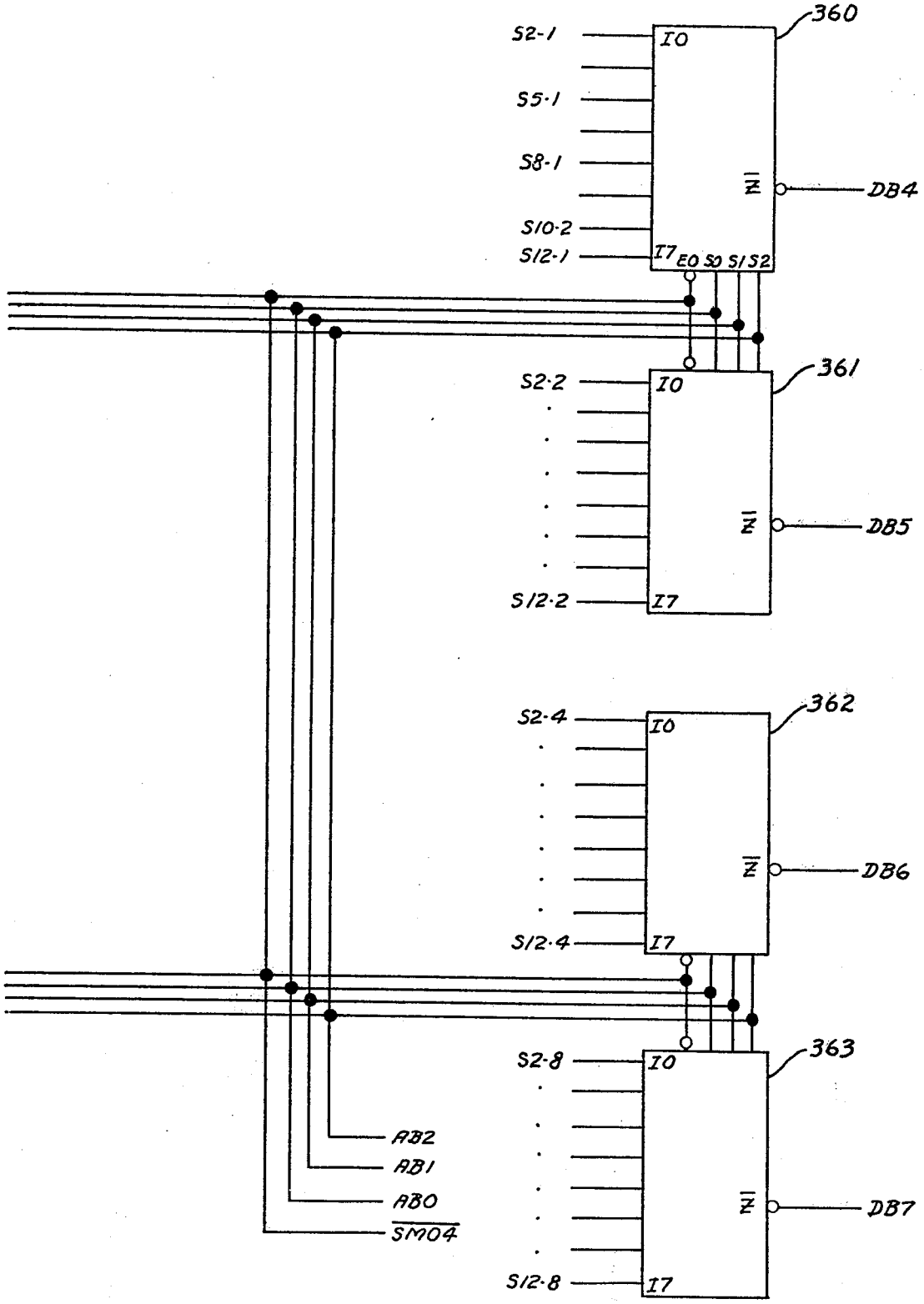

The remaining circuitry of interest is shown in FIGS. 11A, 11B and 12. FIGS. 11A and 11B are a schematic diagram showing switches of main and auxiliary control panels 72 and 74 and control panel logic 156. FIG. 12 is a schematic diagram showing display 76 and its driver circuitry.

As shown in FIGS. 11A and 11B, the control panel logic 156 includes eight multiplexers 356–363, each capable of receiving eight inputs. The outputs of multiplexers 356–363 are connected to data bus lines DB0 through DB7, respectively. The particular signals supplied by the multiplexers to the data bus are selected by the $\overline{SM04}$, AB0, AB1, and AB2 lines.

The inputs to multiplexers 356–363 are derived from the various switches contained on the main and auxiliary panels 72 and 74. The configuration shown in FIGS. 11A and 11B allows microprocessor 170 to address the various switches as memory locations.

Feed Length switch 84 is a three digit, ten position digital thumbwheel switch which allows the feed length to be selected in 0.012 inch nominal increments from 0 to 999 steps. The outputs of switch 84 are in binary coded decimal (BCD) format.

Feed-After-Cut Mark switch 96 is a three digit, ten position digital thumbwheel switch. Because in the present invention the paper cutter has fixed rather than adjustable sensors, the length that the paper advances after a mark is sensed must be varied depending upon the cut mark location on the prints. The length of advance after sensing is selected is 0.012 inch nominal increments from 0 to 99 steps using switch 96.

Length of Cut Out switch 92 is a two digit, ten position digital thumbwheel switch which allows the operator to select the length of cut out in 0.012 inch nominal increments from 0 to 99 steps. This switch is used primarily for straight borderless prints to control the length of slug cut out between prints.

Maximum Number of Prints switch 94 is a two digit, ten position digital thumbwheel switch. The number set into switch 94 (which may varry from 0 to 99) establishes the number of prints that will be cut before the paper cutter stops.

Speed Select switch 80 is a one digit, ten position digital thumbwheel switch. Ten discrete paper cutter cycle speeds can be selected, depending upon the position of switch 80. The speed is varied from 800 to 4200 steps per second in nine increments. Each increment is 20% larger than the previous speed.

When Speed Select switch 80 is at the highest speed position, it also causes paper cutter control 154 to coordinate the operation of the stepper motor 40 and the knife assembly in order to achieve highest possible operating speed. In particular, when the highest speed is selected by Speed Select switch 80, paper cutter control 154 causes the knife assembly to energize slightly before the paper comes to a complete stop. This allows higher speed operation, because there is a slight time delay between the time that the knife assembly receives an energizing signal and the time that the knife actually begins to cut. This coordination of operation allows the highest possible cutter speeds when Speed Select switch 80 has selected the highest speed available.

Mode Select switch 82 is a double width, ten position digital thumbwheel switch that allows the operator to select different operating modes such as RUN, TEST, FEED LENGTH CALIBRATE, and FEED AFTER SENSE. Mode Select switch 82, together with microprocessor 170, allow Start/Stop switch 88 to perform a variety of different functions, depending upon the particular mode selected.

Start/Stop switch 88 is a two position toggle switch which controls the operation of the paper cutter. When Mode Select switch 82 is in the RUN mode, the Start position of Start/Stop switch 88 initiates a paper cutter cycle, and the Stop position stops the paper cutter at the end of the present cycle. When Mode Select switch 82 is in a different mode, Start/Stop switch 88 similarly controls the operation of the cutter in that mode.

As shown in FIGS. 11A and 11B a START signal may also be supplied independent of Start/Stop switch 88. The START signal is received from the packer interface circuitry and allows print packer 164 to initiate a paper cutter cycle if the automatic paper cutter is being used in conjunction with print packer 164.

Trim switch 90 is a pushbutton switch. It actuates the knife assembly for one cycle.

Cut Mark/No Cut Mark switch 98 is a two position toggle switch. The operator selects the proper mode which is dependent upon the print paper having or not having cut marks.

Cut/No Cut switch 86 is a two position toggle which controls the operation of the knife assembly.

FIG. 12 shows the circuitry associated with four digit display 76 on main control panel 72. The circuitry includes four seven-segment decoder driver latches 364–367 and four seven-segment LED displays 368–371. Display 368 represents the most significant digit and display; 371 represents the least significant digit. Decoder driver latches 364–367 receive the PB0-PB7 signals from programmable I/O device 184 and drive displays 368–371 in accordance with those input signals.

Paper Feed Control - Operation

The paper feed control of the present invention includes an indicia sensor assembly 52 or 54 which is positioned in fixed relationship in respect to the paper cutter knife assembly at a distance less than the shortest length of prints to be cut. The cut indicia sensor, therefore, senses the cut indicium associated with the desired cut location which will be cut at the end of the paper feed and cut cycle, rather than a cut indicium one or more prints upstream from the desired cut location. For that reason, the disadvantages of the prior art systems are overcome. No physical adjustment of the position of the sensor assembly is required, and slight variations in the length of prints does not result in inaccurate cutting of prints.

Because the distance from the cut indicium to a desired cut location with which it is associated may vary depending on the manufacturer of the printer which produces the prints and the cut indicia, the present invention derives and stores a feed-after-sense signal which indicates the distance which the photographic paper strip must be fed after a cut indicium is sensed so that the desired cut location associated with that cut indicium is properly aligned with the knife assembly.

The high speed automatic photographic paper cutter described in the preceeding section utilizes the paper feed control of the present invention. Prior to automatic operation of the paper cutter, Mode switch 82 is set to the FEED LENGTH CALIBRATE mode and Start switch 88 is actuated. Paper strip 18 is fed from cut mark to cut mark, and the feed length from cut mark to cut mark is displayed on display 76. The value displayed is set into Feed Length switch 84 by the operator.

It should be noted that in an alternative embodiment the feed length (and also the feed-after-sense length) could be derived and stored directly in RAM 180 rather than displaying the length and requiring the operator to store it in switch 84 (or 96).

The operator then sets Mode switch 82 to the FEED AFTER SENSE mode. The edge of a print is aligned with a calibration mark on one of the paper guides (30 or 32). Start switch 88 is then actuated and the paper advances to the next cut mark and stops. The feed-after-sense length is displayed on display 76, and the operator sets that value into Feed-After-Sense switch 96.

The feed-after-sense length which is displayed on display 76 is derived from the feed length which has been stored in Feed Length switch 84, the distance which paper strip 18 was advanced from the calibration mark until the next cut mark was sensed, and the known distance from the indicia sensor assembly 52 or 54 to the knife assembly. Once the feed-after-sense signal has been derived, displayed, and stored in Feed-After-Sense switch 96, the automatic paper cutter is ready for regular operation. The operator sets Mode switch 82 to the RUN mode and sets Speed switch 80 to the desired cycle rate. Normal operation is then commenced by actuating Start switch 88.

During a normal paper feed and cut cycle, the paper strip 18 is advanced until a cut mark is sensed by sensor assembly 52 or 54, at which time a CUT signal is generated. Once the CUT signal has been produced, paper strip 18 is advanced by an additional distance determined by the feed-after-sense signal stored in feed-after-sense switch 96. In preferred embodiments, paper cutter control 154 causes stepper motor 40 to decelerate as the end of the print is approached. The deceleration (i.e. a down ramp in stepper motor frequency) usually begins some time after the CUT signal has been received, and a predetermined number of steps before stepper motor 40 is stopped. This predetermined number of steps depends upon the stepper motor speed selected by the Speed switch 80.

In the preferred embodiment of the present invention described in previous sections, microprocessor 170 controls the various operations of the automatic photographic paper cutter, including the paper feed control function. The operation of microprocessor 170 relating to the paper feed control of the present invention is illustrated by the flow charts shown in FIGS. 13–20D. In addition, assembler listings for the entire operation of microprocessor 170 are shown in Table 1.

It should be noted that the flow charts shown in FIGS. 13–20D of this patent application represent only those portions of the operation of microprocessor 170 which are directly related to the paper feed control of the present invention. It is clear from the preceeding discussion, and from the assembler listings shown in Table 1, that microprocessor 170 controls other functions of the automatic photographic paper cutter in addition to the paper feed control function. For a more complete description of the operation of microprocessor 170 in the automatic photographic paper cutter, reference should be made to the previously mentioned co-pending application entitled: "Microprocessor Controlled Photographic Paper Cutter."

FIG. 13 illustrates the INIT routine. This routine is for initial startup and for interrupts. The initial conditions of the system are provided by this routine.

Figure 14B:
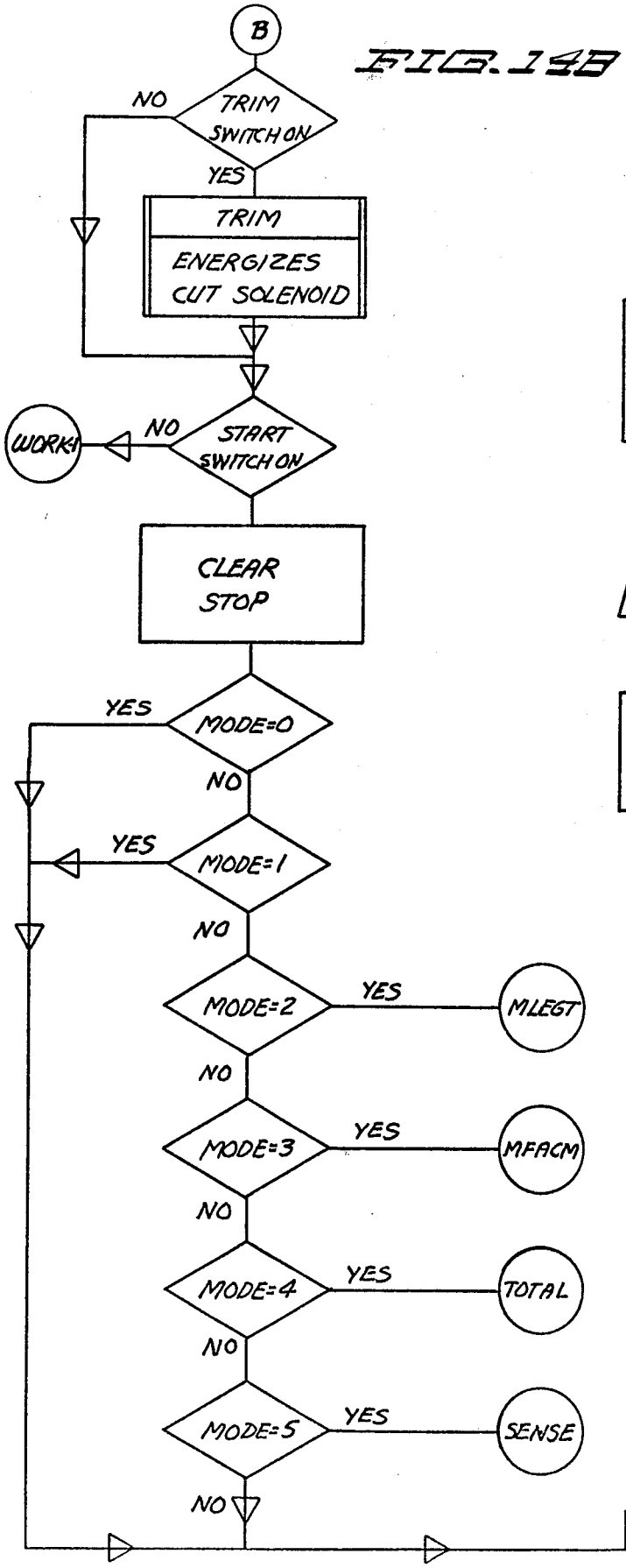

The next routine of microprocessor 170 is WORK. This routine reads the states of the various switches on main and auxiliary panels 72 and 74, and stores this information in appropriate locations of random access memory 180. FIGS. 14A and 14B are flow charts showing the WORK routine.

During the initial set up of the automatic paper cutter, the operator sets Mode switch 82 first to the FEED LENGTH CALIBRATE mode (mode 2) and then to the FEED AFTER SENSE mode (mode 3). As the WORK routine scans the states of the various switches, it checks the modes selected by Mode switch 82. When mode 2 is selected and Start switch 88 is actuated, the SETUP routine shown in FIGS. 15A–15C is commenced.

Figure 15A:
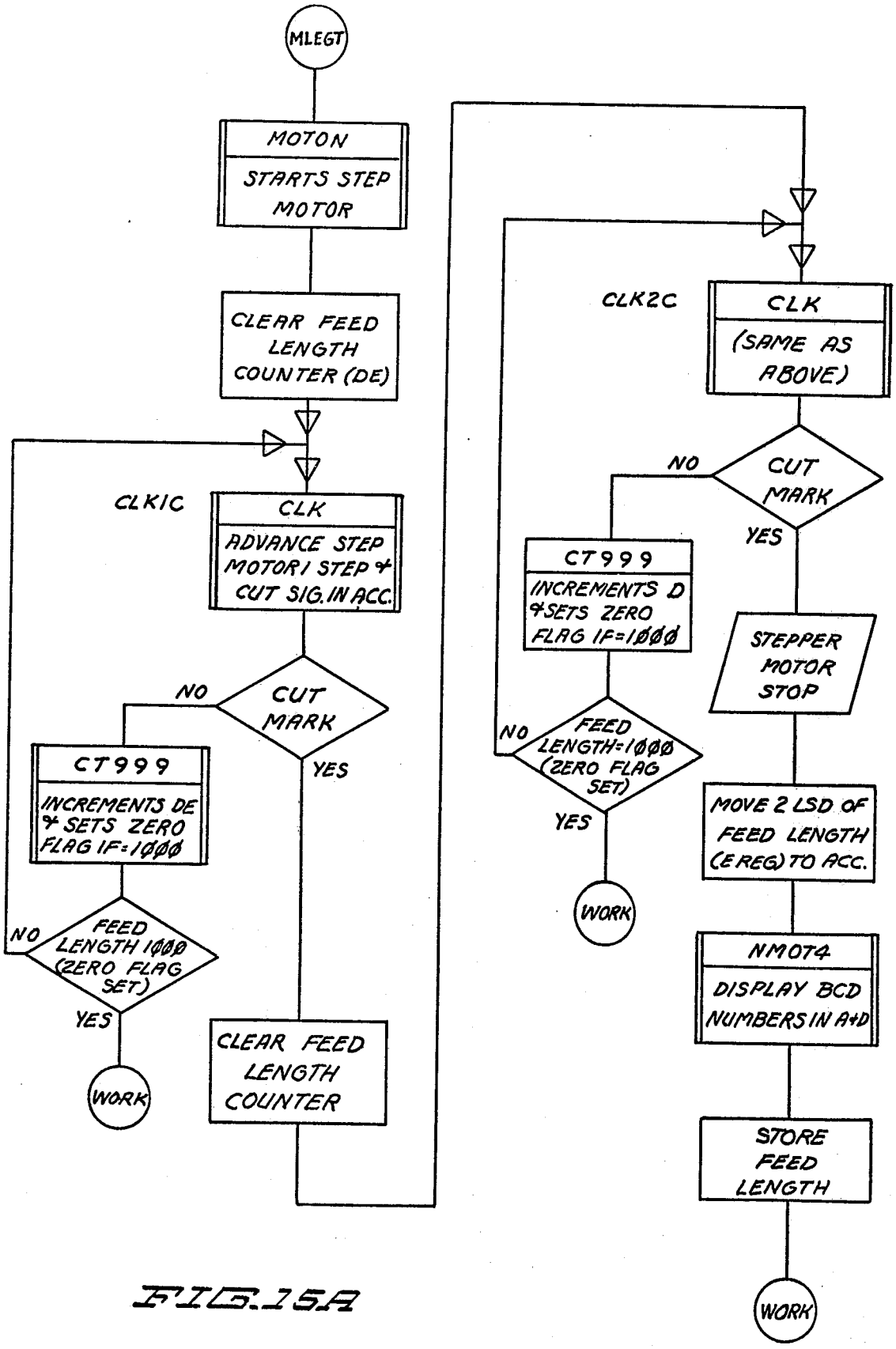
Figure 15B:
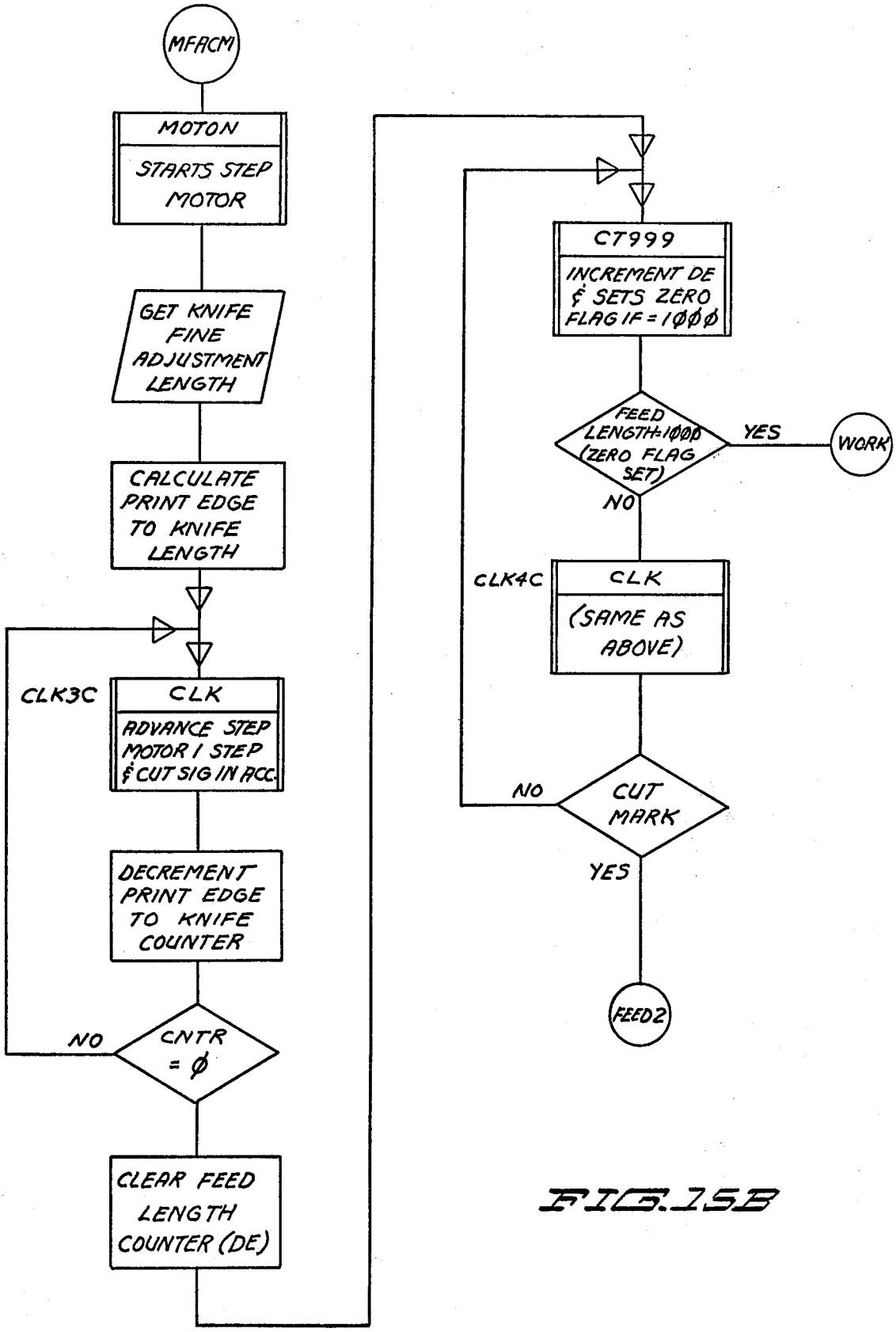
Figure 15C:
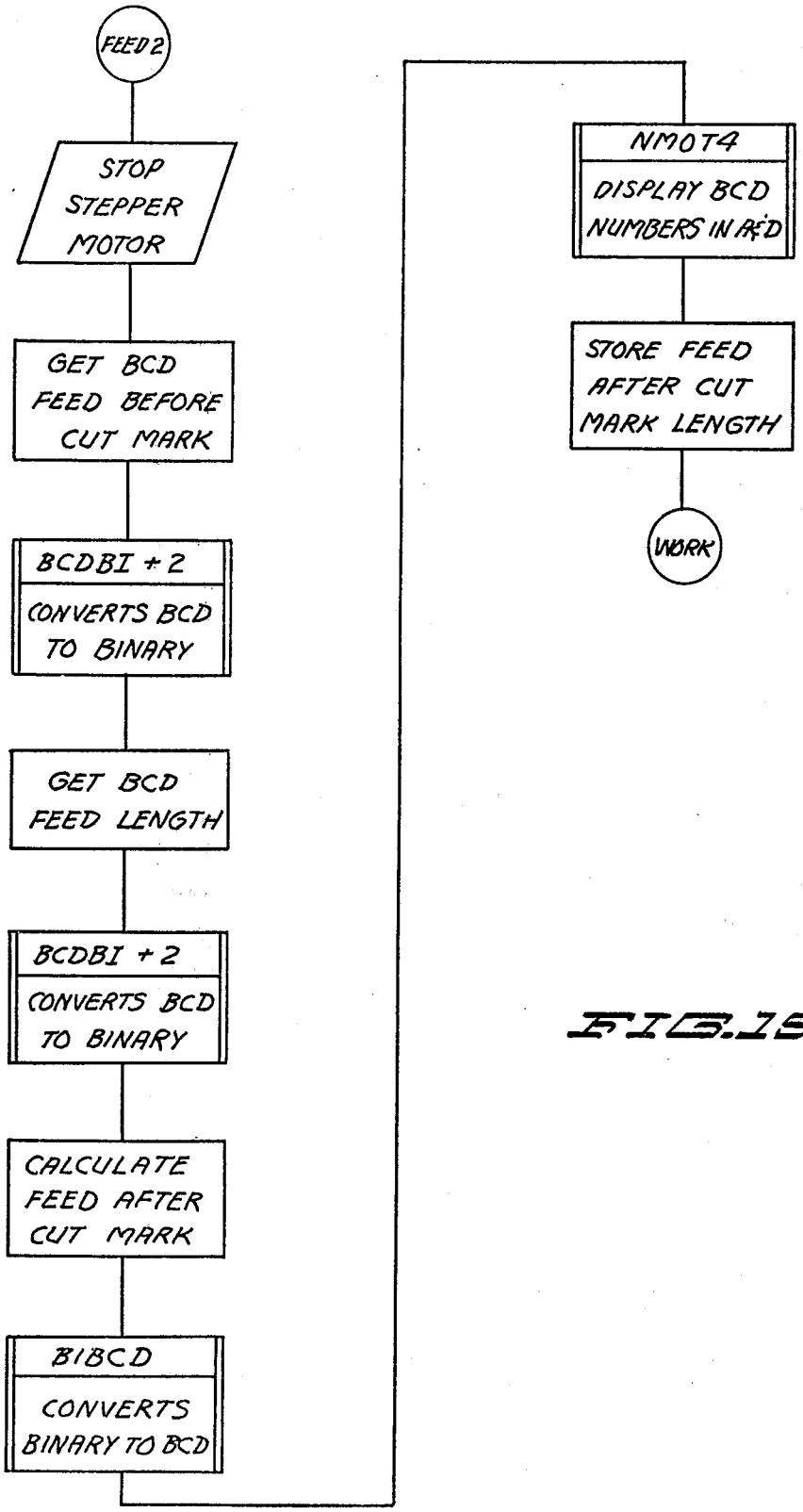

The MLEGT function shown in FIG. 15A measures the length of a print from cut mark to cut mark. The stepper motor 40 is turned on by the MOTON call (FIG. 16A) and the feed length counter is cleared. Paper strip 18 is advanced, a step at a time, until a cut mark is sensed. At that time, the feed length counter is again cleared and the stepper motor is advanced a step at a time until the next cut mark is sensed. As the paper strip 18 is advanced, the count in the feed length counter is incremented until the cut mark is sensed. At that point, the stepper motor is stopped and the feed length from cut mark to cut mark is displayed by display 76. The operator stores the feed length which has been displayed by adjusting Feed Length switch 84 and sets Mode switch 82 to the FEED AFTER SENSE mode (mode 3).

As shown in FIG. 15A, after the feed length has been stored, microprocessor 170 returns to the WORK routine and scans the states of the various switches. Since mode 3 has now been selected, actuation of Start switch 88 will cause the MFACM function of the SETUP routine to be performed. This function is shown in FIGS. 15B and 15C.

When the FEED AFTER SENSE mode (mode 3) has been selected, the operator sets the edge of a print to a calibration mark on one of the paper guides (30 or 32). When Start switch 88 is actuated, the MFACM function causes paper strip 18 to be advanced until a cut mark is sensed.

While the paper strip 18 is being advanced, each step of stepper motor 40 is sensed and counted. This counting is first used to decrement the print edge-to-knife counter until it reaches zero. The number initially in the print edge-to-knife counter represents the number of steps between the indicia sensor and the knife assembly.

Once the print edge-to-knife counter reaches zero, the feed length counter is cleared and the number of steps taken by stepper motor 40 is counted until a cut mark is sensed. When the cut mark is sensed, the stepper motor is stopped and the feed-after-sense or feed-after-cut mark length is calculated and displayed. The feed-after-sense length equals the feed length stored in Feed Length switch 84 minus the length in the feed length counter. The operator then sets the displayed number into Feed-After-Cut Mark switch 96, and the SET-UP routine is completed.

Figure 16A:
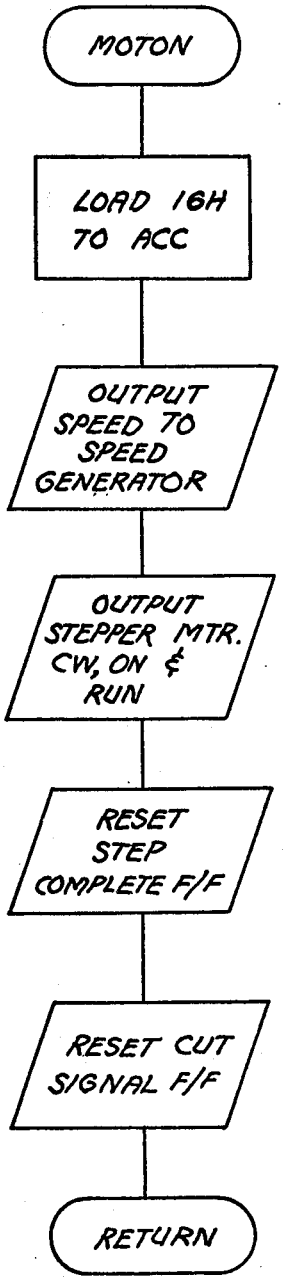
Figure 16B:
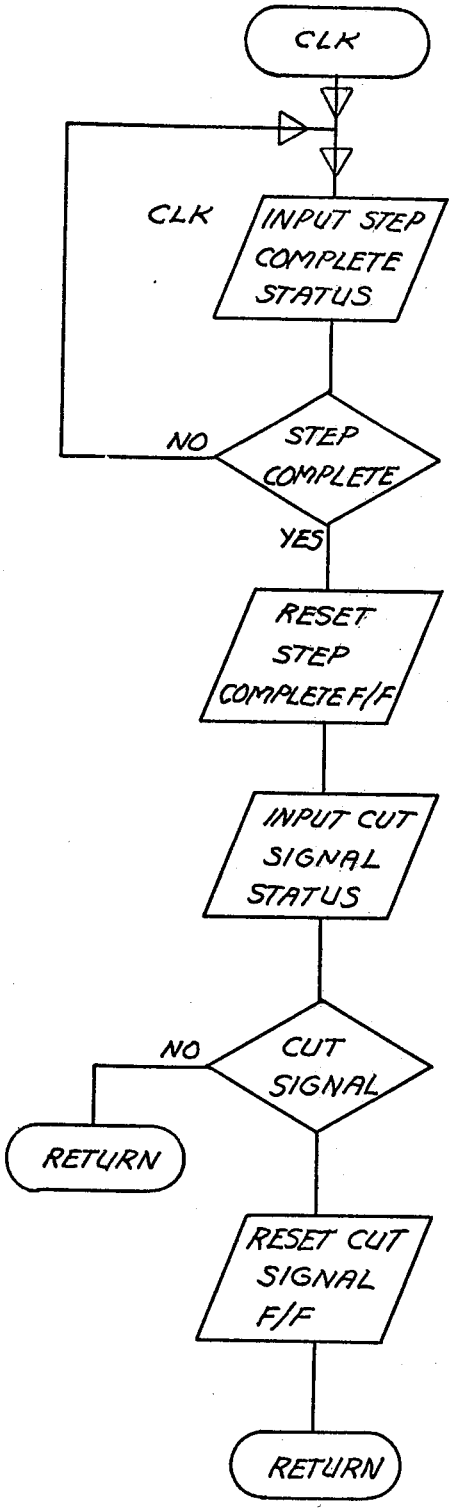
Figure 16C:
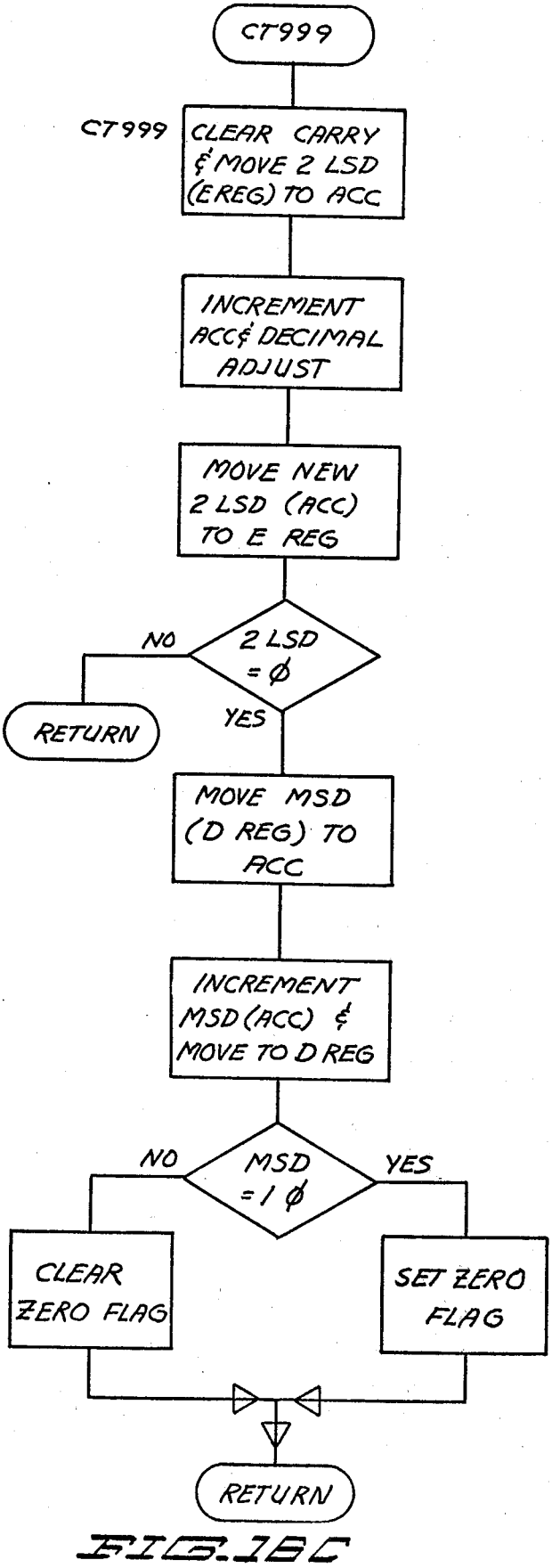

FIGS. 16A–16C show three calls which are used in the SETUP routine. The three calls are MOTON, CLK, and CT999.

Figure 17:
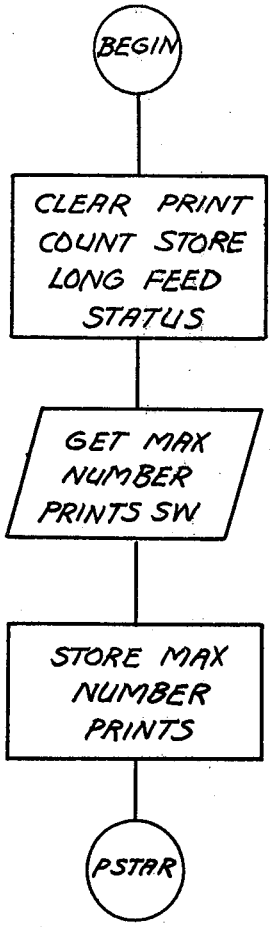

After the SETUP routine has been completed, the operator sets Mode switch 82 to the RUN mode, and the automatic photographic paper cutter is ready for automatic operation. When Start switch 88 is actuated, the BEGIN routine is commenced. This routine is performed when the cutter is beginning an order. FIG. 17 shows the BEGIN routine.

Figure 18A:
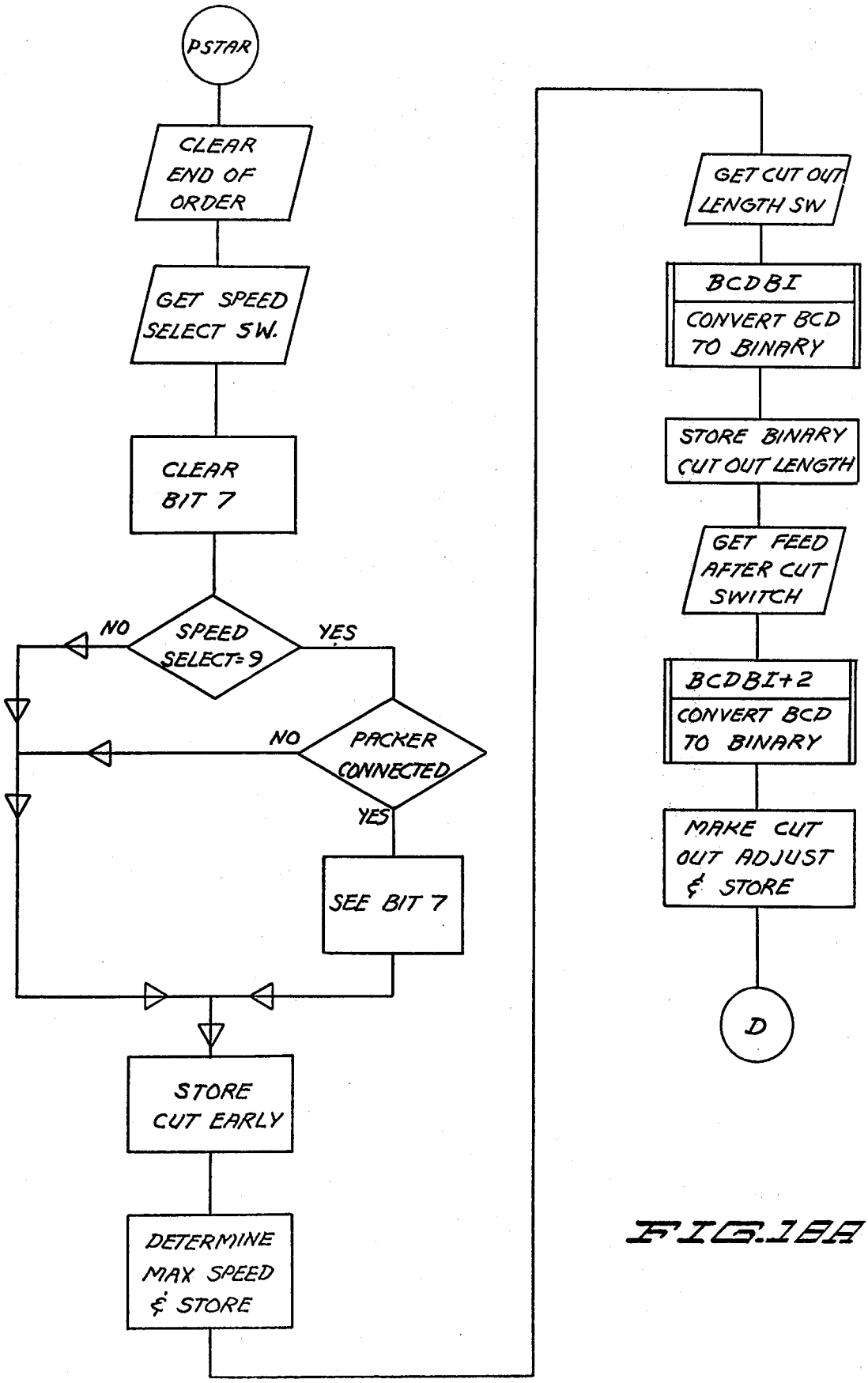
Figure 18B:
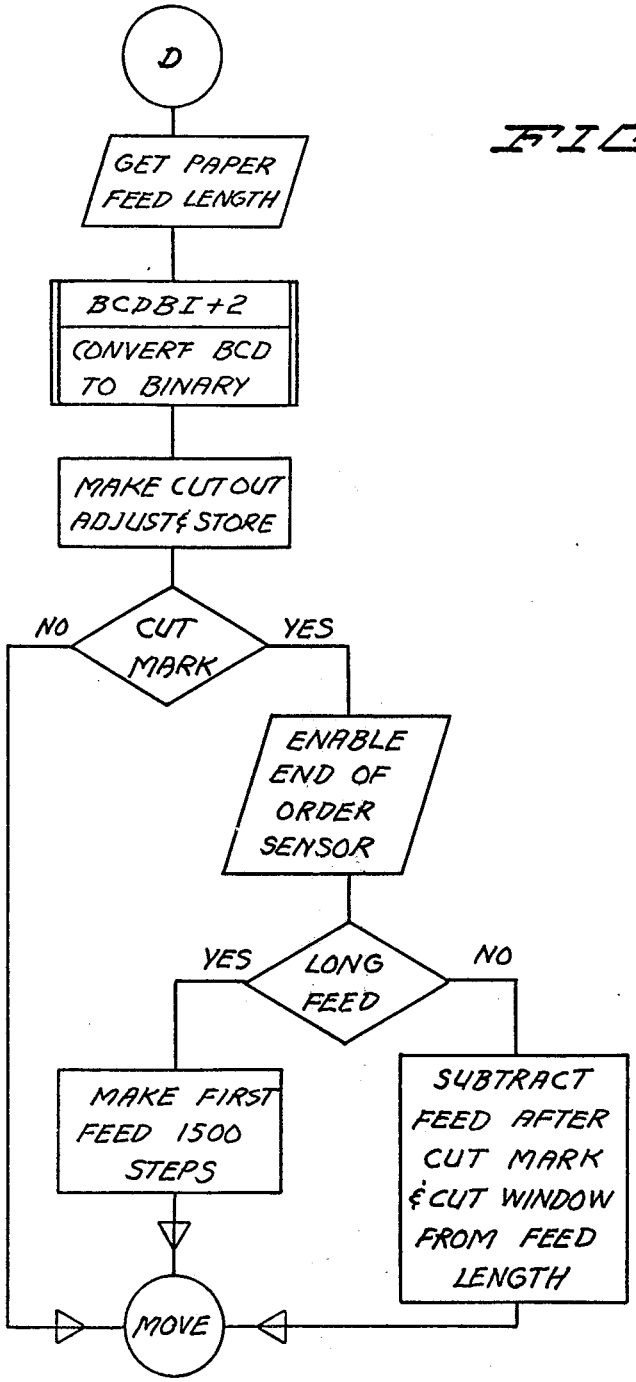
Figure 18A:
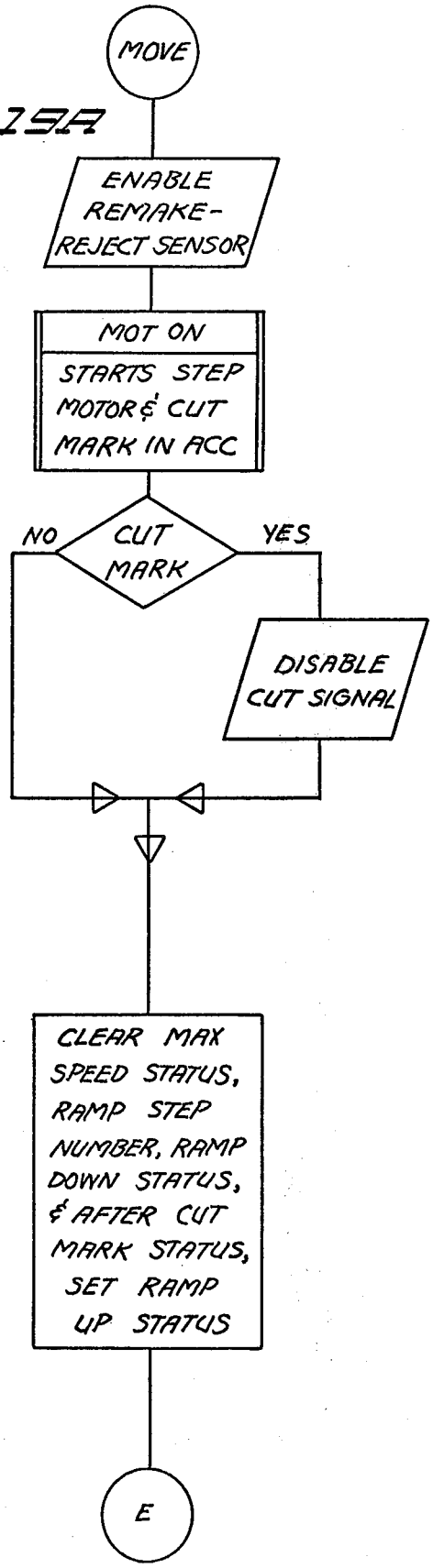

The next routine is the PSTAR routine illustrated in FIGS. 18A and 18B. PSTAR routine is a print/start routine and either follows the BEGIN routine if the cutter is beginning to cut prints from a new customer order, or is commenced at the end of a feed and cut cycle when prints from the same customer order have already been cut.

During the PSTAR routine the state of Speed switch 80 is interrogated and the maximum speed is determined and stored. As shown in FIG. 18A, if the highest speed is selected, the PSTAR routine stores an indication that the knife assembly should be energized early so that there is minimal delay time between the stopping of the print paper and the cutting of the paper by the knife.

The PSTAR routine also includes operations which are necessary to determine the proper feed length depending upon whether the cut marks will or will not be sensed. This involves a conversion of the BCD stored information contained in the feed length switch 84, cut out length switch 92, and feed-after-cut mark switch 96.

Figure 19B:
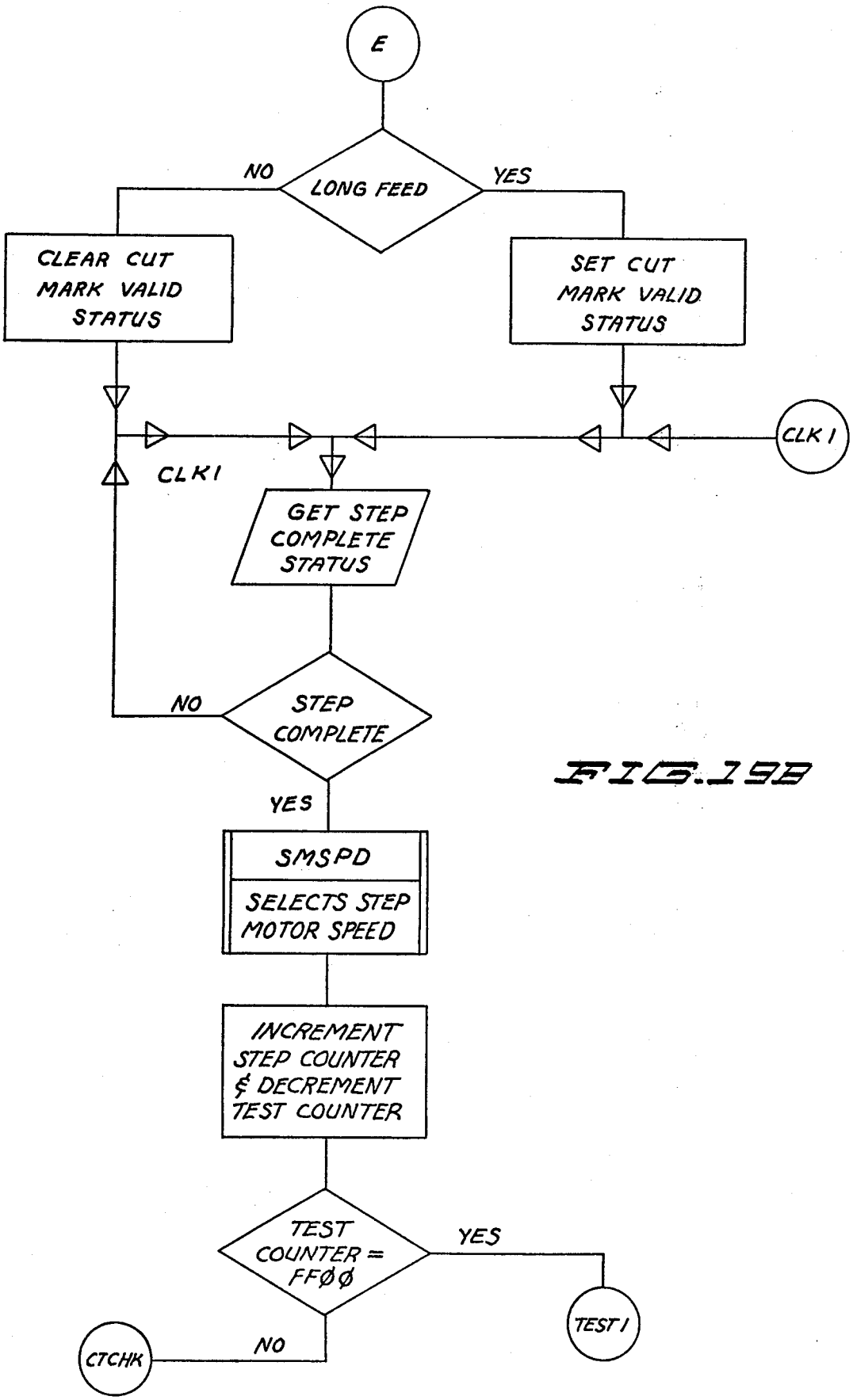

The next routines are the MOVE and the TEST routines, which actually determine the movement of stepper motor 40. FIGS. 19A and 19B illustrate the MOVE routine, and FIGS. 20A–20D illustrate the TEST routine. In the following discussion of the MOVE and TEST routines, only the normal automatic operation of the paper cutter will be discussed. Operation of the paper cutter when cut marks are not used or when an occasional cut mark is missing is the subject of the previously mentioned co-pending application entitled: "Photographic Paper Cutter With Automatic Paper Feed in the Event of Occasional Missing Cut Marks," and will not be discussed in this application.

In normal automatic operation, a test counter is loaded at different times in a paper feed and cut cycle with four different numbers: (1) the number of steps before a CUT signal is valid or acceptable; (2) the number of steps in a "window" during which a CUT signal is valid; (3) the number of steps before beginning the down ramp; and (4) the number of steps in the down ramp until the end of the print. The MOVE routine monitors the number of steps that have been taken by incrementing a step counter and decrementing the test counter as each step is taken. With each step, the Test routine is also performed. When the test counter has a non-zero count, the CTCHK subroutine checks whether a CUT signal has been received and if not the microprocessor returns to the MOVE routine and allows another step to be taken. Each time the test counter reaches zero, the TEST program determines the next number to be loaded into the test counter. If the ramp down is complete, the TEST routine causes the ENDPR routine to be commenced.

When the paper cutter is operating automatically, stepper motor 40 is started by the MOTON call (shown in FIG. 16A), and operates at speeds determined by the SMSPD routine (not shown in the Figures, but shown in Table 1 and described in greater detail in the previously mentioned co-pending application entitled: "Stepper Motor Control"). The test counter first contains the number of steps to be moved before a cut mark is valid. This first number is generated by the MINFD routine, which forms a part of the PSTAR routine shown in FIGS. 18A and 18B. The MINFD routine subtracts the feed-after-sense length and one half of the "window" within which a cut mark should be present from the feed length stored by feed length switch 84.

When the test counter is decremented to zero for the first time, it means that the minimum feed before a cut mark is valid has been completed. Since no cut mark has been sensed up to that point, the test counter is loaded with a second number which represents the "window" during which a cut signal should be received. In addition, the cut mark valid flipflop is set. Microprocessor 170 then proceeds to the CTCHK subroutine, which determines whether a CUT signal is present. If the CUT signal is not present, the CTCHK routine causes microprocessor 170 to return to the MOVE routine and permit stepper motor 40 to take another step.

When a cut signal is sensed within the "window" (i.e. before the test counter is decremented from the second number to zero), the CKCHK subroutine sets flipflops indicating that a cut mark has been sensed this print, that the system is ready to ramp down, and that the cycle is proceeding after a cut mark has been sensed. The CTCHK subroutine then loads the test counter with a third number, which is the number of steps to be taken until the down ramp is commenced. This third number was derived during a SMSPD routine (not shown in the Figures but shown in Table 1) by subtracting the number of steps required for ramp down from the feed-after-sense number. The MOVE routine is repeated, and with each step the test counter is decremented.

Figures 20A, 20B:
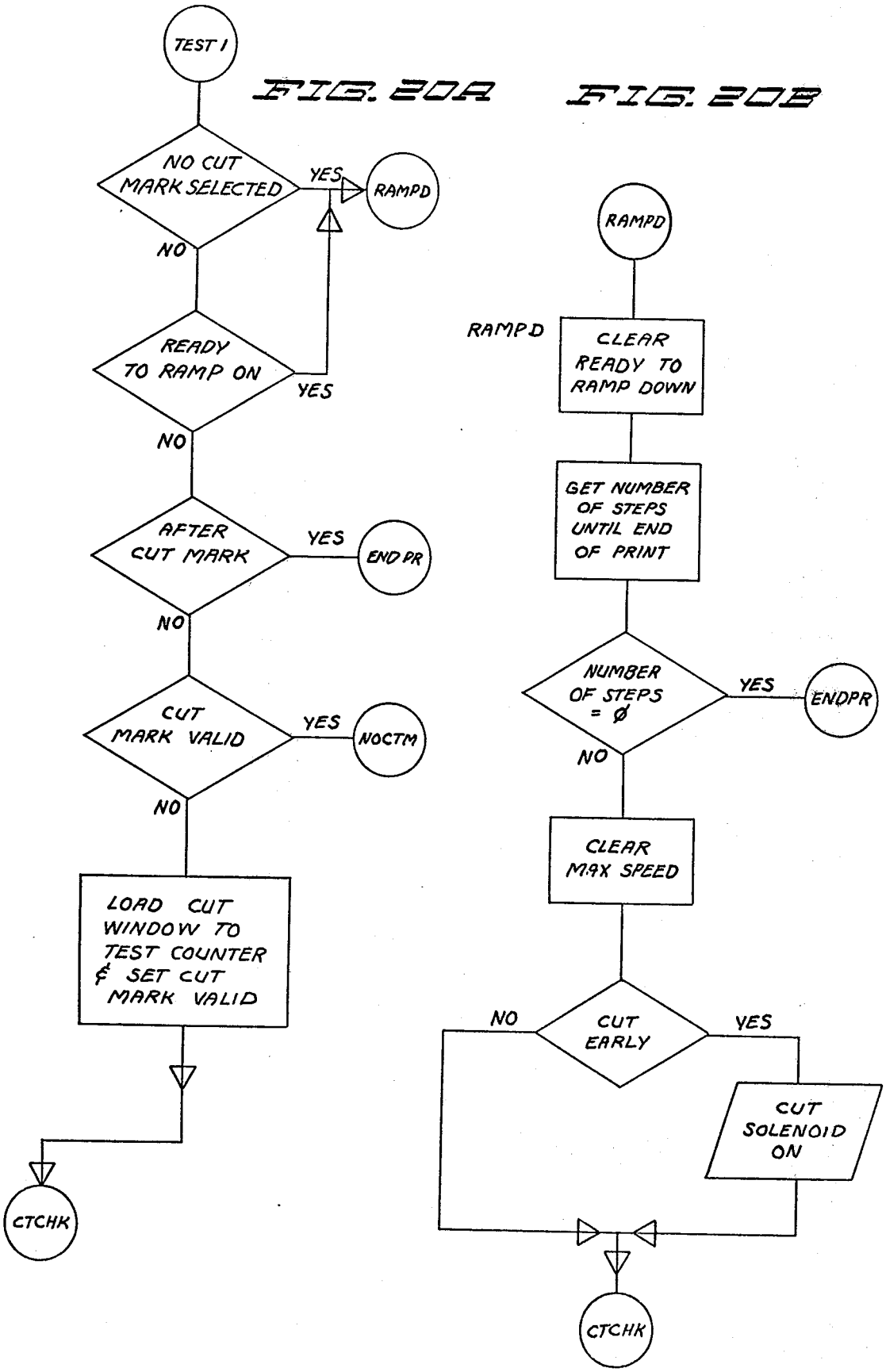

When the test counter again reaches zero, the Test routine is performed and because ready-to-ramp-down-flipflop is set, the RAMPD subroutine shown in FIG. 20B is performed. In the RAMPD subroutine, the ready-to-ramp-down-flipflop is cleared and a fourth number (i.e. the number of steps of the down ramp until the end of the print) is retrieved. If this number is zero, the ENDPR routine is commenced. If, on the other hand, the number of steps is greater than zero so that a down ramp in stepper motor frequency is to occur, the fourth number is loaded into the test counter and the CTCHK subroutine is again performed. Since the cut signal flipflop has been reset by the CTCHK subroutine after it has been received, the MOVE routine is again performed.

When the test counter again reaches zero, the ENDPR routine is performed. This routine (not shown in the Figures but shown in Table 1) performs the necessary functions required to complete a paper feed and cut cycle. These functions include enabling the knife assembly, determining whether the print which has been cut is the end of a customer order, and whether the maximum number of prints have been cut. If the end of an order has not been reached, and the maximum number of prints has not been cut, the ENDPR routine causes another paper feed-and-cut cycle to be commenced with the PSTAR routine shown in FIGS. 18A and 18B.

Conclusion

The paper feed control of the present invention provides highly accurate control of the paper feed in an automatic paper cutter while eliminating the need for time consuming and highly operator sensitive positioning of the indicia sensing means. With the present invention, no trial cuts and waste of print paper is required to set up the paper feed. Instead, a feed-after-sense signal is derived and stored without any cutting of paper. In addition, print length variation does not affect the accuracy of the system, since the indicia sensing means senses the cut indicium associated with the desired location of the immediately following paper cut, rather than sensing a cut indicium one or more prints upstream.

Although the present invention has been described with reference to preferred embodiments, workers skilled in the art will recognize that changes may be made in form and detail without departing from the spirit and scope of the invention. For example, although the present invention has been described in the context of a specific automatic photographic paper cutting having numerous other features, it will be recognized that the paper feed control of the present invention may be applied to other automatic paper cutter systems as well.

TABLE 1

```
;ROUTINE:EQU
;
;EQUATES FOR 451 PAPER CUTTER
;
;MEMORY INPUT PORTS
;
PAFD1   EQU     1000H   ;2 LSD OF PAPER FEED LENGTH
PAFD2   EQU     1001H   ;MSD OF PAPER FEED LENGTH
CTFD1   EQU     1002H   ;2 LSD OF FEED AFTER CUT MARK
CTFD2   EQU     1003H   ;MSD OF FEED AFTER CUT MARK
CTOUT   EQU     1004H   ;2 DIGITS,CUT OUT BETWEEN PRINTS
SPDSL   EQU     1005H   ;LSD-SELECTS MAX SPEED OF MTR
                        ;MSD-4 SWITCHES ON SENSOR AMP
MAPRS   EQU     1006H   ;MAX NUMBER OF PRINTS PER ORDER
IDVSW   EQU     1007H   ;INDIVIDUAL SWITCHES:
                        ;0-NO CUT MARK,1-TRIM,2-START,
                        ;4-7-MODE SELECTION
;
;ISOLATED INPUT PORTS
;
COREC   EQU     0DFH    ;MACHINE KNIFE TO PRINT
                        ;EDGE CORRECTION SWITCH
;
;BITS 0-6 OF THE FOLLOWING INPUT PORTS ARE LOW AND
; CONTAIN NO DATA.
;
STEPC   EQU     0F0H    ;BIT 7 HI FOR STEP COMPETE
CTSIG   EQU     0F1H    ;BIT 7 HI FOR CUT MARK
PREOO   EQU     0F2H    ;BIT 7 HI FOR PRINT END OF ORDER
PACK    EQU     0F3H    ;BIT 7 LO FOR PACKER CONNECTED
KNIFE   EQU     0F4H    ;BIT 7 LO FOR PACKER KNIFE ENABLE
CTCP    EQU     0F5H    ;BIT 7 LO FOR CUT COMPLETE
RJECT   EQU     0F6H    ;BIT 7 HI FOR REJECT THIS PRINT
RMAKE   EQU     0F7H    ;BIT 7 HI FOR REMAKE THIS PRINT
;
;ISOLATED OUTPUT PORTS
;
;PORT ADDRESSES BEGINNING WITH B AND E DO NOT USE
;INFORMATION ON THE DATA BUS.
;THE MOST SIGNIFICANT HEXADECIMAL DIGIT OF THE PORT
;ADDRESS SELECTS AN ADDRESSABLE LATCH AND BITS 0-2 SELECTS
;A SINGLE BIT IN THE LATCH. THE STATE OF THE SELECTED BIT
;IS DETERMINED BY BIT 3 OF THE PORT ADDRESS.
;
RCKOF   EQU     0B0H    ;RESET STEP COMPLETE F/F OFF
REOOF   EQU     0B1H    ;RESET END OF ORDER F/F OFF
RCSOF   EQU     0B2H    ;RESET CUT SIGNAL F/F OFF
SMCCW   EQU     0B3H    ;STEP MTR CCW(REVERSE)
SMSTP   EQU     0B4H    ;STEPPER MOTOR STOP
RRCOF   EQU     0B5H    ;RESET REMAKE/REJECT COUNTER OFF
RCKON   EQU     0B8H    ;RESET STEP COMPLETE F/F ON
REOON   EQU     0B9H    ;RESET END OF ORDER F/F ON
RCSON   EQU     0BAH    ;RESET CUT SIGNAL F/F ON
SMCW    EQU     0BBH    ;STEP MTR CW(FORWARD)
SMRUN   EQU     0BCH    ;STEPPER MOTOR RUN
RRCON   EQU     0BDH    ;RESET REMAKE/REJECT COUNTER ON
;
SPDGN   EQU     0DCH    ;SET FREQ OF STEPPER CLK SPD GEN
DISPY   EQU     0DDH    ;BCD TO 2 DIGIT DISPLAY
;
SMOFF   EQU     0E0H    ;STEPPER MOTOR OFF
CTOFF   EQU     0E1H    ;CUT SOLENOID OFF
RRSOF   EQU     0E2H    ;REMAKE-REJECT SENSOR NOT ENABLED
AVCOF   EQU     0E3H    ;ADVANCE COMPLETE OFF
EOOOF   EQU     0E4H    ;END OF ORDER OFF
PCTOF   EQU     0E5H    ;PRINT CUT OFF
SMON    EQU     0E8H    ;STEPPER MTR ON
CTON    EQU     0E9H    ;CUT SOLENOID ON
RRSON   EQU     0EAH    ;REMAKE-REJECT SENSOR ENABLED
```

```
AVCON   EQU     0EBH    ;ADVANCE COMPLETE ON
EOOON   EQU     0ECH    ;END OF ORDER ON
PCTON   EQU     0EDH    ;PRINT CUT ON
;
;ROUTINE EQUATES
;
ADVSW   EQU     04      ;DIAGNOSTIC ADVANCE SWITCH
CUTL    EQU     15      ;CUTL*1.0 MSEC=CUT SOL ON TIME
CUTTM   EQU     52      ;CUTTM*1.0MSEC=KNIFE RET TIME
CWIND   EQU     10      ;+ OR - VARIATION OF CUT MARK
                        ;LOCATION(# OF STEPS)
DSTOR   EQU     0FF80H  ;START OF DATA STORAGE
INITC   EQU     40H     ;INITIATE CONTINUE
MXMCM   EQU     2       ;MAX NUMBER OF MISSING CUT MARKS
PEDGE   EQU     110     ;PRINT EDGE TO KNIFE FEED LENGTH
SPDTB   EQU     700H    ;START OF LOOK UP TABLES
STOPS   EQU     700     ;STOP SWITCH INTERRUPT
WHY0    EQU     0       ;TEST FOR NORMAL OPERATION
WHY4    EQU     STOPS   ;STOP SWITCH SELECTED
;
;ROUTINE:INIT
;
;THIS ROUTINE IS FOR INITIAL START UP AND THE
;INTERRUPTS.
;
INIT:
        LXI     H,DSTOR
        SPHL            ;INITIALIZE STACK POINTER
        JMP     INITC   ;ALLOW SPACE FOR FUTURE INTERRUPTS
        ORG     STOPS
STOPS:                  ;STOP SWITCH
        CALL    STOP    ;SAVE REASON FOR STOP & DISPLAY
                        ;PRINT COUNT
        POP     H       ;DUMP RETURN ADDRESS
        JMP     WORK
        ORG     INITC
INITC:                  ;INITIATE CONTINUED
        MVI     A,89H   ;A,B-OUTPUT C-INPUT
        OUT     DISPY+2 ;CONTROL TO PPI
        XRA     A       ;SET A =0
        CALL    NMOT2   ;SHOW DISPLAY=0
INITM:                  ;INITIALIZE MEMORY
        MOV     M,A     ;ALL DSTORE=0
        INR     L
        JNZ     INITM   ;IF HL=/0,JUMP
;
;ROUTINE:WORK
;
;THIS ROUTINE READS THE CONTROL SWITCHES AND STORES
;THE INFORMATION IN THE APPROPIATE LOCATION IN RINARY.
;
WORK:
        OUT     SMSTP   ;STOP STEPPER MOTOR
        OUT     SMOFF   ;TURN OFF STEPPER MOTOR
        OUT     REOON   ;RESET END OF ORDER F/F
        OUT     REOOF
        OUT     AVCOF   ;TURN OFF ADVANCE COMPLETE
        OUT     EOOOF   ;TURN OFF END OF ORDER
        XRA     A       ;A=0
        STA     TOT1?   ;CLEAR FIRST TOTAL DISPLAYED
        STA     STOPM   ;RESET STOP IF SET
        STA     REOCM   ;CLEAR CUT MARK REQUIRED
        LXI     H,DSTOR ;RE-INITIALIZE STACK POINTER
        SPHL
        EI              ;ALLOW STOP SWITCH TO INTERRUPT
WORK1:
        LXI     D,SWSTM ;SWITCH STORAGE MEMORY
        LXI     H,IDVSW ;LOCATION OF INDIVIDUAL SWITCHES
        LDAX    D       ;OLD SWITCH STATE TO A
        MOV     C,A     ;SAVE OLD SWITCH STATES
CHECK:
        MOV     A,M     ;GET PRESENT SWITCH STATES
```

```
        MOV     B,A     ;SAVE SWITCH STATES
        XRA     C       ;STATES CHANGED?
        JZ      CHECK   ;NO, TRY AGAIN
        RRC
        RRC             ;TRIM CHANGE SETS CARRY
        JNC     PAKIN
        MVI     A,20    ;LOAD A FOR 20 MILLISECONDS
                        ;IF TRIM CHANGED
        JMP     DEBON
PAKIN:                  ;PACKER INPUT
        RRC             ;START ON SETS CARRY
        JNC     DEBON-2
        IN      PACK    ;PACKER CONNECTED
        ANA     A       ;SET FLAGS
        JM      DEBON-2
        CALL    DMS2    ;DEBOUNCE PACKER START INPUT 0.5 MS
        JMP     DEBON+3
        MVI     A,2     ;LOAD A FOR 2 MILLISECONDS
DEBON:                  ;DEBOUNCE
        CALL    DELAY   ;YES,DEBOUNCE SWITCH
        MOV     A,M     ;GET PRESENT SWITCH STATES
        XRA     B       ;HAVE ANY SWITCHES CHANGED?
        JNZ     CHECK   ;YES,TRY AGAIN
        MOV     A,B     ;NO, SWITCH STATES TO ACCUM
        STAX    D       ;SAVE SWITCH POSITION
        RRC             ;NO CUT MARK TO CARRY & A7
        INX     D       ;DE=NCTMS(NO CUT MARK STATUS)
        STAX    D       ;STORE NO CUT MARK STATUS
        RRC             ;TRIM TO CARRY
        CC      TRIM
        RRC             ;START TO CARRY
        JNC     WORK1
        RRC             ;MODE TO A0-A3
        ANI     0FH     ;SAVE MODE # & SET FLAGS
        EI
PROT1:  IF      PROT
        JZ      BEGIN   ;MODE 0?(     )
        DCR     A
        JZ      BEG1    ;MODE 1?(RUN)
        DCR     A
        JZ      MLEGT   ;MODE 2?(FEEDL)
        DCR     A
        JZ      MFACM   ;MODE 3?(FEEDA)
        DCR     A
        JZ      TOTAL   ;MODE 4?(TOTAL)
        DCR     A
        JZ      SENSE   ;MODE 5?(SENSE)
        DCR     A
        JZ      DIAG    ;MODE 6?(     )
        DCR     A
        JZ      WORK    ;MODE 7?(     )
        DCR     A
        JZ      WORK    ;MODE 8?(     )
        DCR     A
        JZ      TEST    ;MODE 9?(TEST)
        ENDIF
BEGIN:                  ;BEGINNING OF ORDER (CUT MARKS REQUIRED)
        MVI     A,80H
        STA     REQCM   ;SET CUT MARK REQUIRED
BEG1:                   ;BEGINNING OF ORDER (MISSING CUT MARKS ACCEPTABLE)
        PUSH    H
        LXI     H,WHY   ;LOWER BYTE ADDRESS OF LAST STOP
        MVI     A,WHY2+3 AND 0FFH       ;LOWER BYTE OF CUT MARK
                                        ;WRONG LOCATION ADDRESS
        CMP     M       ;LOWER ADDRESS BYTES EQUAL?
        MVI     M,0     ;CLEAR LOWER ADDRESS BYTE
        INX     H       ;HIGH BYTE ADDRESS OF LAST STOP
        JNZ     TEST4   ;JUMP IF LOWER ADDRESS BYTES NOT EQUAL
        MVI     A,(WHY2+3) SHR 8        ;HIGH BYTE OF CUT MARK
                                ;WRONG LOCATION ADDRESS
        CMP     M       ;HIGH ADDRESS BYTES EQUAL?
```

```
TEST4:
        MVI     A,0
        MOV     M,A     ;CLEAR HIGH ADDRESS BYTE
        POP     H       ;RESTORE H
        JZ      TEST5   ;SAVE PREVIOUS PRINT COUNT
        STA     PRCT    ;SET PRINT COUNT TO ZERO
TEST5:
        STA     STOPM   ;RESET STOP IF SET
        OUT     SMON    ;TURN MOTOR ON
        MVI     A,18
        CALL    DELAY   ;KEEP MOTOR ON 18 MSEC
        IN      PREOO   ;NEW ROLL OF PAPER IF SET
        MOV     B,A     ;SAVE STATUS
        LDA     PWRON   ;ZERO IF JUST TURNED ON
        XRI     80H     ;COMPLEMENT MSB
        ORA     B       ;BIT 7 HI IF LONG FEED REQUIRED
        INX     D       ;D=LONFD(LONG FEED)
        STAX    D
        DCX     H       ;M=MXPRS(MAX PRINTS SW)
        INX     D       ;D=MXPRM(MAX PRINTS MEM)
        MOV     A,M     ;MAX NUMBER PRINTS TO A
        STAX    D       ;STORE MAX PRINTS
        DCX     H       ;M=SPDSL(SPEED SELECT SW)
;
PSTAR:                  ;PRINT START
;
;INPUTS:DE=MXPRM(MAX PRINTS MEMORY ADDRESS)
;       HL=SPDSL(SPEED SELECT SWITCH ADDRESS)
;
        OUT     REOON   ;CLEAR END OF ORDER F/F
        MOV     A,M     ;SPEED SELECT IN
        ANI     0FH     ;MASK OFF UPPER 4 BITS
        MOV     B,A     ;SAVE SPEED SELECT
        CPI     9       ;TOP SPEED SELECTED?
        MVI     A,0     ;A7=0
        JNZ     CONT1   ;NO, THAN JUMP
        IN      PACK    ;BIT 7 LO IF PACKER USED
        ANI     80H     ;SET BIT 7 HI IF PACKER
                        ;NOT USED
CONT1:                  ;CONTINUE 1
        STA     CTELY   ;STORE CUT EARLY
        MOV     A,B     ;RESTORE SPEED SELECTED
        PUSH    H
        LXI     H,SPDTB ;SPEED TABLE
        ADD     L
        MOV     L,A     ;SPDTB+A TO L
        MOV     A,M     ;LOOK UP MAX SPEED
        STA     MXSPD   ;STORE MAX SPEED
        POP     H
        DCX     H       ;M=CTOUT(CUT OUT LENGTH SW)
        MOV     B,M     ;GET CUT OUT LENGTH
        CALL    BCDBI   ;CHANGE TO BINARY
        INX     D       ;D=CTOTM(CUT OUT LENGTH MEM)
        STAX    D       ;STORE BINARY CUT OUT LENGTH
        DCX     H       ;M=CTFD2(FEED AFTER CUT 2)
        MOV     A,M     ;MSD OF SWITCH
        ANI     0FH     ;MASK OFF UPPER 4 BITS
        DCX     H       ;M=CTFD1(FEED AFTER CUT 1)
        MOV     B,M     ;2 LSD OF SWITCH
        CALL    BCDBI+2 ;CHANGE TO BINARY
        MOV     C,A     ;SAVE 2 LSD
        LDAX    D       ;GET CUT OUT LENGTH
        ANA     A       ;SET FLAGS
        CNZ     COADJ   ;MAKE ADJUSTMENT FOR CUT OUT
        MOV     A,C     ;GET ADJUSTED 2 LSD
        INX     D       ;D=ACTF1(AFTER CUT MARK FEED 1)
        STAX    D       ;2 LSD BINARY STORED
        INX     D       ;D=ACTF2(AFTER MARK FEED 2)
        MOV     A,B     ;MSD TO A
        STAX    D       ;MSD BINARY STORED
        DCX     H       ;M=PAFD2(PAPER FEED LENGTH 2)
        MOV     A,M     ;MSD OF SWITCH
```

```
        DCX     H           ;M=PAFD1(PAPER FEED LENGTH 1)
        MOV     B,M         ;2 LSD OF SWITCH
        CALL    BCDBI+2     ;CHANGE TO BINARY
        MOV     C,A         ;SAVE 2 LSD OF BINARY PAPER FEED REQUIRED
        LDA     CTOTM       ;CUT OUT LENGTH
        ANA     A           ;SET FLAGS
        CNZ     COADJ+1     ;MAKE ADJUSTMENT FOR CUT OUT
        LDA     NCTMS       ;NO CUT MARK STATUS
        RLC                 ;STATUS TO CARRY
        XCHG                ;M=ACTF2(AFTER CUT MARK FEED 2)
        CALL    MOTON       ;TURN MOTOR ON AND SET
                            ;MOTOR DIRECTION TO FORWARD
        JC      MOV1        ;JUMP IF NO CUT MARK
        OUT     REOOF       ;ENABLE END OF ORDER MARK
        LDA     LONFD       ;LONG FEED
        ANA     A           ;SET FLAGS
        JP      MINFD       ;IF NOT LONG FEED, JUMP
        LXI     B,1500
        JMP     MOV1+2
;
;THIS ROUTINE DETERMINES THE  MINIMUM FEED
;ALLOWED FOR A CUT MARK TO BE ACCEPTED.  IT SUBTRACTS THE
;FEED AFTER CUT MARK AND HALF THE "WINDOW" THE CUT MARK
;SHOULD BE PRESENT IN FROM THE TOTAL PRINT FEED LENGTH.

;
MINFD:                      ;MINIMUM FEED
        MOV     A,C         ;GET 2 LSD OF FEED LENGTH
        DCX     H           ;M=ACTF1(AFTER CUT MARK FEED LENGTH 1)
        SUB     M           ;2 LSD OF FEED BEFORE CUT MARK
        JNC     CONT2       ;IF NO CARRY SKIP NEXT 2
        DCR     B           ;SUBTRACT BORROW
CONT2:                      ;CONTINUE 2
        SUI     CWIND       ;2 LSD OF FEED BEFORE CUT
                            ;MARK WINDOW
        MOV     C,A         ;C=2 LSD OF FEED BEFORE CUT MARK WINDOW
        INX     H           ;M=ACTF2(AFTER CUT MARK FEED 2)
        MOV     A,B         ;MSD OF FEED LENGTH
        SBB     M           ;MSD OF FEED BEFORE CUT MARK WINDOW
        MOV     B,A         ;B=MSD OF FEED BEFORE CUT MARK WINDOW
;
;ROUTINE:MOVE
;
;THIS ROUTINE DETERMINES THE MOVEMENT OF THE STEPPER
;MOTOR.  IF CUT MARK IS USED, BC CONTAINS THE NUMBER OF STEPS
;TO BE MOVED(1)BEFORE A CUT MARK IS VALID (OMITTED ON FIRST
;PRINT IN A ROLL OF PAPER OR AFTER POWER IS TURNED ON),
;(2)WHILE A CUT MARK IS VALID,(3)BEFORE RAMP DOWN,
;(4)UNTIL THE END OF PRINT.  IF NO CUT MARK IS
;USED, BC CONTAINS THE NUMBER OF STEPS TO BE
;MOVED(1)UNTIL THE END OF PRINT,(2) BEFORE RAMP
;DOWN(CORRECTED AFTER RAMP UP IS COMPLETE),(3) UNTIL
;THE END OF PRINT.
;
;INPUTS:BC-SEE ABOVE
;
;OUTPUTS:DE-TOTAL STEPS MOVED
;
MOV1:
        OUT     RCSON       ;DISABLE CUT SIGNAL IN
        OUT     RRSON       ;ENABLE REMAKE-REJECT SENSOR
        XRA     A           ;A=0
        MOV     D,A         ;D=0
        MOV     E,A         ;E=0
        INX     H           ;M=MSPDS(MAX SPEED STATUS)
        MOV     M,A         ;CLEAR MAX SPEED STATUS
        INX     H
        INX     H           ;M=RSTPN(RAMP STEP NUMBER)
        MOV     M,A         ;RAMP STEP #=0
        INX     H           ;M=URAPS(UP RAMP STATUS)
        MVI     M,80H       ;UP RAMP STATUS SET
        INX     H           ;M=RRPDN(READY RAMP DOWN)
        MOV     M,D         ;CLEAR READY TO RAMP DN
```

```
        INX     H       ;M=ACTM(AFTER CUT MARK)
        MOV     M,0     ;CLEAR AFTER CUT MARK
        INX     H       ;M=CTVAL(CUT MARK VALID)
        LDA     LONFD   ;BIT 7 HI IF LONG FEED
        MOV     M,A     ;CUT MARK VALID IF LONG
                        ;FEED, OTHERWISE NOT VALID
CLK1:
        CALL    CLK     ;CHECK STEP & CUT SIGNAL
        JP      STEP    ;IF NO CUT SIGNAL JUMP
        OUT     RCSON   ;RESET CUT SIGNAL F/F ON
        STA     CTMNW   ;STORE CUT MARK THIS PRINT
        CALL    CMARK   ;CHANGE APPROPIATE FLAGS
        LHLD    ACTF1   ;FEED AFTER CUT MARK
        MOV     B,H     ;MOVE TO BC
        MOV     C,L
STEP:
        CALL    SMSPD   ;YES,CHECK SPEED
        INX     D       ;MOTOR STEP TOTAL
        DCR     C       ;DECREMENT BC
        JZ      BC0?
        MVI     A,0FFH
        CMP     C       ;C=FF?
        JNZ     CLK1
        DCR     B
        JMP     CLK1
BC0?:                   ;BC=0?
        XRA     A       ;A=0
        CMP     B
        JNZ     CLK1    ;JUMP IF BC=/0
;
;ROUTINE:TST
;
;THIS ROUTINE DETERMINES IF A CUT MARK IS ACCEPTABLE
;AND ALSO DETERMINES THE FEED LENGTH IF THERE IS NO
;CUT MARK.  IF THE CUT MARK OR ITS SUBSTITION HAS BEEN
;SENSED, AN INDICATION IS PROVIDED.
;
TEST1:
        LDA     NCTMS   ;NO CUT MARK STATUS
        ANA     A       ;SET FLAGS
        MVI     A,0     ;ZERO A REG, NO FLAG CHANGE
        LXI     H,RRPDN ;READY TO RAMP DOWN
        JM      RAMPD   ;JUMP IF NO CUT MARK STATUS
        CMP     M       ;READY TO RAMP DOWN
        JZ      ENDP?   ;NO, THEN CHECK END OF PRINT
RAMPD:                  ;RAMP DOWN
        MOV     M,A     ;CLEAR READY TO RAMP DOWN
        DCX     H
        DCX     H       ;M=RSTPN(RAMP STEP NUMBER)
        MOV     B,A     ;B=0
        MOV     C,M     ;C=NUMBER STEPS TIL END OF PRINT
        CMP     C       ;C=0
        JZ      ENDPR   ;YES,END  OF PRINT
        DCX     H
        DCX     H       ;M=MSPDS(MAX SPEED STATUS)
        MOV     M,A     ;CLEAR MAX SPEED
        LDA     CTELY   ;CUT EARLY
        ANA     A       ;SET FLAGS
        JP      CLK1    ;JUMP IF NOT EARLY CUT
        OUT     CTON    ;TURN ON CUT SOLENOID
        JMP     CLK1
ENDP?:                  ;CHECK FOR END OF PRINT
        INX     H       ;M=ACTM(AFTER CUT MARK)
        CMP     M
        JNZ     ENDPR   ;JUMP IF AFTER CUT MARK
        INX     H       ;M=CTVAL(CUT MARK VALID)
        CMP     M       ;LOOKING FOR CUT MARK?
        JNZ     NOCTM   ;YES, GO TO NO CUT MARK SENSED
        OUT     RCSOF   ;ENABLE CUT SIGNAL
        LXI     B,2*CWIND       ;BC=CUT MARK WINDOW
        MVI     A,80H
        MOV     M,A     ;SET CUT VALID
```

```
        JMP     CLK1
NOCTM:                          ;NO CUT MARK SENSED
        MOV     M,A             ;CLEAR CUT MARK VALID
        OUT     RCSON           ;DISABLE CUT SIGNAL
        STA     CTMNW           ;CLEAR CUT MARK THIS PRINT
        DCX     H               ;M=ACTM(AFTER CUT MARK)
        LDA     LONFD           ;LONG FEED STATUS
        ANA     A               ;SET FLAGS
        JP      WHY1+6
WHY1:
        CALL    STOP            ;NO CUT MARK YET SO STOP
        JMP     WORK
        INX     H
        INX     H               ;M=MISCM(CUT MARK YET TO MISS)
        DCR     M
        LDA     REQCM           ;BIT 7 HI IF CUT MARK REQUIRED
        ORA     M
        JP      WHY2+6
WHY2:
        CALL    STOP            ;STOP IF TOO MANY MISSING MARKS
        JMP     WORK
        INX     H               ;M=PFD1(PAPER FEED 1)
        MOV     A,M
        SUB     E
        MOV     C,A
        INX     H               ;M=PFD2(PAPER FEED 2)
        MOV     A,M
        SBB     D
        MOV     B,A             ;BC=STEPS TO END OF PRINT
        LDA     RSTPN           ;GET NUMBER OF RAMP DOWN STEPS
        CMA
        MOV     L,A
        CALL    RPDNA           ;CORRECT FOR RAMP DOWN STEPS
        MVI     A,80H           ;SET BIT 7
        CALL    CMARK           ;CHANGE APPROPIATE FLAGS
        JMP     CLK1
;
;THIS ROUTINE SETS APPROPIATE FLAGS AFTER A CUT
;MARK HAS BEEN SENSED OR AFTER A MISSING CUT MARK
;HAS BEEN ACCEPTED.
;
;INPUTS:BIT 7 OF A REG IS SET HI
;
CMARK:                          ;CUT MARK
;
        LXI     H,RRPDN         ;READY TO RAMP DOWN
        MOV     M,A             ;STORE READY TO RAMP DN
        INX     H               ;M=ACTM(AFTER CUT MARK)
        MOV     M,A             ;STORE AFTER CUT MARK
        INX     H               ;M=CTVAL(CUT MARK VALID)
        XRA     A               ;A=0
        MOV     M,A             ;CLEAR CUT MARK  VALID
        RET
;
;ROUTINE:SETUP
;
;THIS ROUTINE CONTAINS THE NECESSARY FUNCTIONS FOR
;INITIAL SET UP CALIBRATION OF THE PAPER CUTTER.THESE
;FUNCTIONS ARE:
;       MLEGT-MEASURES THE LENGTH OF THE PRINT FROM CUT
;MARK TO CUT MARK.
;       MFACM-MEASURES THE DISTANCE THE PAPER MOVES AFTER
;THE CUTMARK IS SENSED UNTIL IT IS CUT.  IT REQUIRES THE
;OPERATOR TO POSITION THE LEADING EDGE OF THE PRINT TO A
;PREDETERMINED POINT.
;
MLEGT:                          ;MEASURE LENGTH
        CALL    MOTON
        LXI     D,0             ;RESET FEED LENGTH
CLK1C:                          ;CLOCK CALL 1
        CALL    CLK             ;TAKE STEP
        JM      CLK2C-3         ;IF CUT MARK,JUMP
        CALL    CT999           ;INCREMENT FEED LENGTH DE
```

```
        JZ      FEEDL   ;FEED TOO LONG
        JMP     CLK1C
        LXI     D,0     ;RESET FEED LENGTH
CLK2C:                  ;CLOCK CALL 2
        CALL    CLK     ;TAKE STEP
        JM      FEED1   ;IF CUT MARK SENSED,JUMP
        CALL    CT999   ;INCREMENT FEED LENGTH DE
        JZ      FEEDL   ;FEED TOO LONG
        JMP     CLK2C   ;TAKE A STEP
FEED1:                  ;MEASURED FEED LENGTH
        OUT     SMSTP   ;STOP STEPPER MOTOR
        MOV     A,E     ;SET UP FOR DISPLAY
        CALL    NMOT4
        XCHG            ;MOVE MEASURED FEED LENGTH TO HL
        SHLD    MFDL    ;SAVE MEASURED FEED LENGTH
        JMP     FEEDL
MFACM:                  ;MEASURE FEED AFTER CUT MARK
        CALL    MOTON
        IN      CORRC   ;GET KNIFE TO PRINT EDGE CORRECTION
        ANI     01FH    ;MASK OUT UPPER 3 BITS
        MVI     B,PEDGE ;GET PRINT EDGE TO KNIEF LENGTH
        ADD     B       ;ADD CORRECTION
        MOV     B,A     ;SAVE LENGTH
CLK3C:                  ;CLOCK CALL 3
        CALL    CLK     ;TAKE STEP
        DCR     B       ;B=DISTANCE TO KNIFE
        JM      CLK4C-6 ;IF EDGE AT KNIFE JUMP
        JMP     CLK3C   ;IF NOT, TAKE A STEP
        LXI     D,0
        CALL    CT999   ;INCREMENT DE
        JZ      FEEDL   ;FEED TOO LONG
CLK4C:                  ;CLOCK CALL 4
        CALL    CLK     ;TAKE STEP
        JM      FEED2   ;IF CUT MARK JUMP
        JMP     CLK4C-6
FEED2:
        OUT     SMSTP   ;STOP STEPPER MOTOR
        LHLD    MFDL    ;MEASURED FEED LENGTH
        MOV     A,D     ;BCD FEED BEFORE CUT MARK
        MOV     B,E
        CALL    BCDBI+2 ;CONVERT TO BINARY
        MOV     D,B     ;BINARY FEED BEFORE CUT
        MOV     E,A
        MOV     A,H     ;BCD FEED LENGTH
        MOV     B,L
        CALL    BCDBI+2 ;CONVERT TO BINARY
        SUB     E       ;DETERMINE 2 LSD
        MOV     E,A     ;SAVE 2 LSD
        MOV     A,B     ;MSD OF BINARY FEED LENGTH
        SBB     D       ;DETERMINE MSD
        MOV     D,A
        CALL    BIBCD   ;CONVER TO BCD
        MOV     E,A     ;SAVE 2 LSD
        CALL    NMOT4   ;DISPLAY MEASURED FEED AFTER CUT
                        ;MARK LENGTH
        XCHG
        SHLD    MFDAC   ;SAVE MEASURED FEED AFTER
                        ;CUT MARK LENGTH

FEEDL:                  ;FEED LONG
        XRA     A       ;A=0
        STA     PWRON   ;CLEAR  PWRON
        JMP     WORK
MOTON:                  ;MOTOR ON
        MVI     A,16H   ;SLOW SPEED SELECT
        OUT     SPDGN   ;SLOW SPEED OUT
        OUT     SMCW    ;STEPPER MTR CW(FORWARD)
        OUT     SMON    ;TURN ON STEPPER MTR
        OUT     SMRUN   ;RUN STEPPER MOTOR
        OUT     RCKON   ;RESET STEP COMP F/F
        OUT     RCKOF
        OUT     RCSON   ;CLEAR CUT SIGNAL F/F
        OUT     RCSOF
```

```
        RET
;
;THIS CALL LOOKS FOR THE STEPPER MOTOR TO COMPLETE
;ONE STEP.  IF THE STEP HAS NOT BEEN COMPLETED WITHIN
;APPROXIMATELY 5 MILLISECONDS, CONTROL WILL BE
;RETURNED TO "WORK" WHERE THE STACK WILL BE INITILIZED
;TO REMOVE THE RETURN ADDRESS & DATA SAVED ON THE
;STACK.  UPON STEP COMPLETION, THE MINUS FLAG IS SET
;IF A CUT MARK HAS BEEN SENSED.
;
CLK:                            ;STEPPER MOTOR CLOCK
        PUSH    B
        MVI     B,0             ;TIME OUT COUNTER
        INR     B               ;INCREMENT TIMER
        JNZ     WHY3+6
WHY3:
        CALL    STOP
        JMP     WORK
        IN      STEPC           ;STEP COMPLETE
        ANA     A               ;SET FLAGS
        JP      CLK+3           ;NO, TRY AGAIN
        POP     B
        OUT     RCKON           ;RESET STEP COMP F/F
        OUT     RCKOF
        IN      CTSIG           ;GET CUT SIGNAL
        ANA     A               ;SET FLAGS
        RP                      ;IF NO SIGNAL, RETURN
        OUT     RCSON           ;CLEAR CUT SIGNAL F/F
        OUT     RCSOF
        RET
;
;THIS CALL INCREMENTS THE BCD CONTENTS OF REGISTER
;PAIR DE BY ONE COUNT.  IF THE COUNT IS LESS THAN
;1000, ZERO IS NOT SET ON RETURN.
;
CT999:                          ;COUNT DE TO 999
        ANA     A               ;CLEAR CARRY
        MOV     A,E             ;GET 2 LSD
        INR     A               ;INCREMENT 2 LSD
        DAA                     ;MAKE SURE THEY ARE BCD
        MOV     E,A             ;SAVE 2 LSD
        RNC                     ;IF NO CARRY RETURN
        MOV     A,D             ;GET MSD
        INR     A               ;INCREMENT MSD
        MOV     D,A             ;SAVE MSD
        CPI     0AH             ;ZERO FLAG SET IF DE=1000
        RET
;
;ROUTINE:TOTA
;
;THIS ROUTINE DISPLAYS THE TOTALS OF PRINTS CUT
;& ORDERS COMPLETED SINCE POWER ON. THE FOLLOWING
;SEQUENCE IS USED TO DISPLAY THE DATA:(1) 2 MSD OF
;PRINTS CUT,(2) 4 LSD OF PRINTS CUT,(3) 2 MSD OF
;ORDERS CUT,(4) 4 LSD OF ORDERS CUT.  AFTER (4) HAS
;BEEN DISPLAYED, THE SEQUENCE STARTS OVER AT (1).
;
;DESTROYS:A,B
;
TOTAL:
        LDA     TOT1?           ;BIT 7 HI IF THIS IS
                                ;FIRST TOTAL DISPLAYED
        ANA     A               ;SET FLAGS
        JM      TOT2            ;JUMP IF NOT FIRST DISP
        MVI     B,4             ;SET NUMBER OF PASSES
        LXI     H,PRCT1+2               ;2 MSD OF PRINTS CUT
DIG2:                           ;DISPLAY 2 DIGITS
        MOV     A,M             ;GET 2 DIGITS
        CALL    NMOT2           ;DISPLAY 2 DIGITS
        MVI     A,80H
        STA     TOT1?           ;SET FIRST TOTAL DISPLAYED
TOT3:
        STA     DIG4S           ;STORE DISPLAY 4 DIGITS STATUS
```

```
        PUSH    H           ;SAVE LOCATION OF LAST
                            ;DIGITS DISPLAYED
        DCR     B           ;DECREMENT PASS COUNTER
        LXI     D,SWSTM     ;SWITCH STATUS MEMORY
        PUSH    B           ;SAVE PASS COUNTER
        JNZ     WORK1       ;JUMP IF NOT LAST PASS
        JMP     WORK        ;CLEAR TOTIZ THIS TIME
TOT2:
        POP     B           ;GET PASS COUNTER
        POP     H           ;GET LOCATION OF LAST DIGITS DISPLAYED
        DCX     H           ;LOCATION OF NEXT 2 DIGITS
                            ;TO BE DISPLAYED
        LDA     DIGAS       ;BIT 7 HI IF 4 DIGITS
        ANA     A           ;SET FLAGS
        JP      DIG2        ;JUMP IF 2 DIGITS TO BE DISPLAYED
        MOV     D,M         ;2 MSD TO BE DISPLAYED TO D
        DCX     H
        MOV     A,M         ;2 LSD TO A
        STC                 ;SHOWING LEADING ZEROS
        CALL    NMOT4       ;DISPLAY 4 DIGITS
        XRA     A           ;A=0
        JMP     TOT3
;
;ROUTINE:SENS
;
;THIS ROUTINE ALLOWS THE CUT MARK TO BE
;MOVED BACK AND FORTH IN FRONT OF THE SENSOR
;SO THAT IT MAY BE PROPERLY ADJUSTED.
;
SENSE:
        CALL    MOTON       ;TURN MOTOR ON
        LXI     D,400       ;START COUNT AT 400
NMARK:                      ;CHECK FOR MARK
        CALL    CT999
        JZ      FEEDL       ;FEED TOO LONG
        CALL    CLK
        JP      NMARK       ;IF NO CUT MARK JUMP
        MVI     B,50        ;PRELOAD STEP COUNT
FWD:                        ;FORWARD DIRECTION
        CALL    CLKS
        JM      FEEDL       ;GO BACK IF STOP SW SELECTED
        OUT     SMCCW       ;GO BACKWARDS
REV:                        ;REVERSE DIRECTION
        CALL    CLKS
        JM      FEEDL       ;GO BACK IF STOP SW SELECTED
        OUT     SMCW        ;GO TOWARDS KNIFE
        JMP     FWD
CLKS:                       ;SENSOR CLOCK
        CALL    CLK
        DCR     B           ;DECREMENT STEP COUNT
        JNZ     CLKS        ;IF STEP COUNT =/ 0 TAKE
                            ;ANOTHER STEP
        MVI     B,100       ;PRELOAD STEP COUNT
        LDA     STOPM       ;BIT 7 HI IF STOP SWITCH
                            ;ENERGIZED
        ANA     A           ;SET FLAGS
        RP                  ;GO BACK IF NOT READY TO STOP
        MVI     A,0         ;A=0 & FLAGS NOT CHANGED
        STA     STOPM       ;CLEAR STOP
        RET
;
;ROUTINE:STOP
;
;THIS ROUTINE WILL DISPLAY THE NUMBER OF PRINTS
;CUT IN THE PRESENT ORDER IF THE CUTTER HAS
;STOPPED.  IT WILL STORE THE ADDRESS THAT CAUSED
;IT TO STOP.
;
STOP:
        XRA     A           ;A=0
        STA     PWRON       ;ALLOW LONG FEED NEXT TIME
        STA     CTMNW       ;NO CUT MARK ON LAST PRINT
```

```
STOP1:
        LDA     PRCT    ;NUMBER OF PRINTS CUT
                        ;THIS ORDER
        ANA     A       ;CLEAR CARRY FOR LEADING
                        ;ZERO SUPPRESSION
        CALL    NMOT2   ;DISPLAY PRINTS CUT
        POP     H       ;WHAT ADDRESS CAUSED STOP
        SHLD    WHY     ;SAVE FOR FUTURE CHECK
        PUSH    H       ;PUT BACK FOR RETURN
        RET
;
;ROUTINE:ENDP
;
;THIS ROUTINE PERFORMS THE NECESSARY FUNCTIONS THAT TAKE
;PLACE AT THE END OF A PRINT.
;
ENDPR:                  ;END OF PRINT
        OUT     RRSOF   ;DISABLE REMAKE-REJECT SENSOR
        OUT     AVCON   ;TELL PACKER READY TO CUT
        OUT     SMSTP   ;STEPPER MOTOR STOP
        IN      PREOO   ;PRINT END OF ORDER
        ANA     A
        MOV     B,A     ;SAVE END OF ORDER STATUS
        JP      NEOO
        OUT     EOOON   ;END OF ORDER TO PACKER
NEOO:                   ;NO END OF ORDER
        IN      PACK    ;PACKER STATUS
        ANA     A       ;SET FLAGS
        JM      NPAC1
        LXI     H,0
NIFEN:                  ;KNIFE ENABLE
        LDA     STOPM   ;OPERATOR TIRED OF WAITING?
        CPI     80H
        JNZ     WHY6+6
WHY6:   CALL    STOP1
        JMP     WORK
        INR     L       ;DELAYS UNTIL HL OVERFLOWS
        JNZ     NIFIN
        INR     H
        JNZ     NIFIN
        OUT     SMOFF   ;TURN OFF STEPPER MTR IF
                        ;TOO LONG A WAIT
NIFIN:                  ;INPUT KNIFE ENABLE
        IN      KNIFE   ;PACKER KNIFE ENABLE
        ANA     A       ;SET FLAGS
        JM      NIFEN   ;SIGNAL HERE?
        CALL    DMS2    ;YES, DEBOUNCE 0.5 MSEC.
        IN      KNIFE
        ANA     A
        JM      NIFEN
        OUT     SMON    ;TURN MOTOR ON FOR CUT
NPAC1:                  ;NO PACKER
        OUT     AVCOF   ;TURN OFF ADVANCE COMPLETE
        PUSH    PSW
        LDA     CTFLY   ;CUT EARLY
        ANA     A       ;SET FLAGS
        OUT     PCTON   ;PRINT CUT (ON) TO PACKER
        CP      TRIM    ;IF NOT EARLY CUT
        CM      TRIM1   ;IF EARLY CUT, TAKE LESS TIME
        POP     PSW
        LXI     H,PRCT  ;PRINTS CUT THIS ORDER
        MOV     A,M     ;GET PRINTS CUT THIS ORDER
        INR     A       ;NEW PRINT COUNT
        DAA
        MOV     M,A     ;SAVE NEW COUNT
        MOV     C,A     ;PRINTS THIS ORDER
        IN      PACK    ;PACKER CONNECTED?
        CMA
        ORA     B       ;COMBINE STATUS CONDITIONS
        JP      DSPRT+3 ;JUMP IF NEITHER
        MOV     A,C     ;GET COUNT BACK FOR OUTPUT
```

```
DSPRT:                      ;DISPLAY PRINT COUNT
        CALL    NMOT2       ;SHOW NEW COUNT
        LXI     H,MXPRM     ;M=MX NUMBER OF PRINTS THIS ORDER
        MOV     A,M
        CPI     0           ;CONTINOUS CUT IF 0
        JNZ     MXPR?
        MOV     C,A
        INR     A           ;MAKE A>C
MXPR?:                      ;MAXIMUM NUMBER OF PRINTS
        SUB     C           ;A=0 IF MAX COUNT
        MOV     C,A         ;SAVE MAX COUNT STATUS
        LXI     H,ORDCT-1
        MOV     A,B         ;END OF ORDER STATUS
        XRI     80H         ;COMPLEMENT MSB
        PUSH    D           ;SAVE FEED LENGTH
        CALL    BCDIN+1     ;INCREMENT END OF ORDER
                            ;TOTAL IF APPROPIATE
        CALL    BCDIN       ;INCREMENT TOTAL PRINT COUNT
        POP     D           ;GET FEED LENGTH
        INX     H           ;M=CTMNW(CUT MARK NEW)
        MOV     A,M         ;CUT MARK THIS CUT
        ANA     A           ;SET FLAGS
        INX     H           ;M=CTMOD(CUT MARK OLD)
        JP      CTDLY       ;IF NO CUT MARK JUMP
        CMP     M
        JNZ     CTDLY       ;JUMP IF LAST PRINT NO CUT MARK
        MVI     A,MXMCM     ;MAX MISSING CUT MARKS
        STA     MISCM       ;STORE ABOVE
        XCHG
        SHLD    PFD1        ;STORE FEED LENGTH OF LAST PRINT
        JMP     CTDLY+1
CTDLY:                      ;CUT DELAY FOR KNIFE RETURN
        MOV     M,A         ;CUT MARK STATUS FOR NEXT PRINT
        MVI     A,CUTTM     ;CUT TIME AFTER SOLENOID IS
                            ;ENERGIZED
        CALL    DELAY       ;WAIT FOR KNIFE TO COMPLETE CYCLE
        OUT     PCTOF       ;PRINT CUT(OFF) TO PACKER
        LDA     CTOTM       ;CUT OUT LENGTH
        ANA     A           ;SET FLAGS
        JZ      TEST2       ;IF NO CUT OUT, JUMP
        OUT     SMRUN
        MOV     D,A         ;SAVE CUT OUT LENGTH
CLK2:
        CALL    CLK         ;CHECK STEP COMPLETE
        DCR     D           ;DECREASE CUT OUT LENGTH
        JNZ     CLK2        ;TO MOVE & IF NOT ZERO JUMP
        OUT     SMSTP
        CALL    TRIM
        MVI     A,CUTTM
        CALL    DELAY       ;WAIT FOR KNIFE TO COMPLETE CYCLE
TEST2:
        STA     LONFD       ;RESET LONG FEED
EOO?:                       ;END OF ORDER?
        MVI     A,80H
        STA     PWRON       ;SET FIRST PRINT CUT STATUS
        CMP     B           ;END OF ORDER?
        JZ      HOLD        ;YES, GO WAIT FOR NEXT ORDER
        MOV     A,C         ;MAX COUNT STATUS
        ANA     A           ;SET FLAGS
        JNZ     WHY5+6
WHY5:
        CALL    STOP1
        JMP     HOLD
        LXI     H,SPDSL     ;SPEED SELECT
        LXI     D,MXPRM     ;MAX PRINTS MEMORY
        JMP     PSTAR       ;START NEXT PRINT
HOLD:
        MVI     A,20
        CALL    DELAY
        JMP     WORK
;
;ROUTINE:BCDB
;
```

```
;THIS PROGRAM WILL TAKE 0-999 COMPLEMENTED DECIMAL AND
;CONVERT IT TO BINARY(0-3E7H). REGISTER A CONTAINS MSD
;AND REGISTER B CONTAINS THE TWO LSD.
;
;D1=MSD        D2=2MSD        D3=LSD
;
;FUNCTION:BCDBI
;
;INPUTS:A,B CONTAIN BCD DATA
;
;OUTPUTS:A=2LSD AND B=MSD IN BINARY
;
;DESTROYS:A,B,C,FLAGS
;
BCDBI:
        MVI     A,0H        ;START FOR TWO DIGITS
        ANI     0FH         ;START FOR THREE DIGITS
                            ;MASK OFF UPPER 4 BITS
        PUSH    D
        PUSH    H
        MOV     C,A         ;SAVE D1
        RLC                 ;A=2 D1
        RLC                 ;A=4 D1
        ADD     C           ;A=5 D1
        RLC                 ;A=10 D1
        MOV     L,A         ;STORE 10 D1
        MVI     H,0         ;H=0
        MOV     A,B         ;GET D2 AND D3
        ANI     0F0H        ;SAVE D2
        RRC
        RRC
        RRC
        RRC
        ADD     L           ;A=10 D1 + D2
        MOV     L,A         ;L=10 D1 + D2
        MOV     E,L         ;E=10 D1 + D2
        MOV     D,H         ;D=0
        DAD     H           ;HL=2(10 D1 + D2)
        DAD     H           ;HL=4(10 D1 + D2)
        DAD     D           ;HL=5(10 D1 + D2)
        DAD     H           ;HL=10(10 D1 + D2)
        MOV     A,B         ;GET D2 AND D3
        ANI     0FH         ;SAVE D3
        MOV     E,A         ;DE=D3
        DAD     D           ;HL=100 D1 + 10 D2 + D3
        MOV     B,H
        MOV     A,L
        POP     H
        POP     D
        RET
;
;ROUTINE:BCDI
;
;THIS ROUTINE INCREMENTS A SIX PLACE DECIMAL
;NUMBER IN MEMORY. INCREMENTS OCCUR AT CONDITIONAL ENTRY
;POINT ONLY IF A=0.
;
;INPUTS:HL-POINTS TO TWO LSD LESS 1 LOCATION
;
;DESTROYS:A,D,H,L
;
BCDIN:                      ;BCD  INCREMENT
        XRA     A           ;A=0
        MVI     D,4         ;CONDITIONAL ENTRY POINT
        DCR     D
        RZ                  ;RETURN IF 4TH PASS
        INX     H           ;LOCATION OF NUMBER TO BE
                            ;INCREMENTED
        ANA     A           ;SET FLAGS
        JNZ     BCDIN+3     ;DON'T INCREMENT IF A =/ 0
        MOV     A,M         ;GET 2 DIGITS
        INR     A
```

```
        DAA
        MOV     M,A     ;RETURN 2 DIGITS
        JMP     BCDIN+3 ;CONTINUE
;
;ROUTINE:BIBC
;
;THIS ROUTINE CONVERTS A BINARY NUMBER NOT
;GREATER THAN 3CEH TO BCD FORM.
;
;INPUTS:DE-CONTAINS BINARY VALUE(0-3CEH) TO BE
;CONVERTED
;
;OUTPUTS:D-CONTAINS MSD BCD IN 4 LOWER BITS
;       A-CONTAINS 2 LSD BCD
;
;DESTROYS:B,C,D,E,H,L
;
;FUNCTION:BIBCD
;
BIBCD:
        LXI     B,100
        CALL    DIGIT
        PUSH    H       ;SAVE MSD BCD
        LXI     B,10
        CALL    DIGIT
        MOV     A,H
        RRC
        RRC
        RRC
        RRC
        MOV     L,A     ;SAVE DIGIT
        LXI     B,1
        CALL    DIGIT
        MOV     A,H     ;GET LSD BCD
        ADD     L       ;MERGE 2 LSD BCD
        POP     D       ;RETURN MSD BCD
        RET
;
;THIS ROUTINE SUBTRACTS THE CONTENTS OF REGISTER
;PAIR BC FROM THE CONTENTS OF REGISTER PAIR
;DE.  EACH TIME THE REMAINDER IS GREATER THAN OR EQUAL
;TO ZERO, THE H REGISTER(BCD DIGIT) IS INCREMENTED.
;WHEN THE REMAINDER IS LESS THAN ZERO, AN ADJUSTMENT
;IS MADE SO THAT A POSITIVE NUMBER REMAINS.
;
DIGIT:
        MVI     H,0     ;INITIALIZE DIGIT
DI0:
        MOV     A,E     ;SUBTRACT LOOP
        SUB     C
        MOV     E,A
        MOV     A,D
        SBB     B
        MOV     D,A
        JM      DI1
        INR     H       ;INCREMENT BCD DIGIT
        JMP     DI0
DI1:                    ;ADJUST FOR NEXT SEQUENCE
        MOV     A,E
        ADD     C
        MOV     E,A
        MOV     A,D
        ADC     B
        MOV     D,A
        RET
;
;ROUTINE:COAD
;
;THIS ROUTINE SUBTRACTS EITHER THE FULL VALUE OR HALF
;VALUE IN REG A FROM THE VALUE IN REG BC.  IT IS
;USED TO ADJUST THE TOTAL FEED LENGTH AND THE
```

```
;FEED AFTER CUT MARK LENGTH WHEN THERE IS A CUT OUT.
;
;INPUTS:A,B,C
;
;OUTPUTS:B,C
;
CCADJ:                          ;CUT OUT ADJUSTMENT
        RAR                     ;ENTRY POINT FOR HALF VALUE
        PUSH    D               ;ENTRY POINT FOR FULL VALUE
        MOV     D,A             ;SAVE VALUE
        MOV     A,C             ;GET 2 LSD
        SUB     D               ;SUBTRACT VALUE
        MOV     C,A             ;SAVE 2 LSD
        MOV     A,B             ;GET MSD
        SBI     0               ;SUBTRACT BORROW IF ANY
        MOV     B,A             ;SAVE MSD
        POP     D
        RET
;
;ROUTINE:DELAY
;
;THIS ROUTINE GENERATES DELAYS IN 1 MILLISECOND
;INCREMENTS.  ACCUMULATOR CONTAINS THE (HEXADECIMAL)
;LENGTH OF THE DELAY IN MILLISECONDS.
;
;INPUTS:A
;
DELAY:
        CALL    DMSEC
        DCR     A
        JNZ     DELAY           ;TRY TIL TIME IS UP
        RET
;
;ROUTINE:DMSEC
;
;THIS ROUTINE GENERATES A 1.0 OR 0.5 MILLISECOND
;DELAY AND RETURNS AFTER THE DELAY IS COMPLETE
;
DMSEC:                          ;DELAY 1 MILLISECOND
        PUSH    PSW
        MVI     A,124           ;A=124
        INR     A
        JNZ     DMSEC+3
        POP     PSW
        RET
DMS2:                           ;DELAY 0.5 MSEC.
        MVI     A,190
        INR     A
        JNZ     DMS2+2
        RET
;
;ROUTINE:DISP
;
;THIS ROUTINE ALLOWS EITHER 2 OR 4 DIGITS TO BE
;DISPLAYED ON THE DIGITAL READOUT.  IF CARRY IS
;SET ON ENTRY,LEADING ZEROS WILL NOT BE SUPPRESSED.
;IF CARRY IS NOT SET ON ENTRY, LEADING ZEROS WILL BE
;SUPPRESSED.  REGISTER E IS NON ZERO IF ZEROS ARE NOT
;SUPPRESSED.  REGISTER H CONTAINS A LOW BIT WHICH
;DETERMINES WHICH DIGIT IS OUTPUTTED TO(BIT 4
;SELECTS MSD AND BIT 7 SELECTS THE LSD).
;
;INPUTS: A - 2 LSD
;        D - 2 MSD
;        CARRY - HI IF NO ZERO SUPPRESSION
;
;DESTOYS: CARRY
;
NMOT2:                          ;ENTRY POINT FOR 2 DIGIT DISPLAY
                                ;A HAS THE 2 DIGITS
        PUSH    D
        MVI     D,0             ;2 MOST SIGNIFICANT DIGITS = 0
        JMP     NMOT4+1
```

```
NMOT4:                          ;ENTRY POINT FOR 4 DIGIT DISPLAY
                                ;D HAS UPPER 2,A HAS LOWER 2
        PUSH    D
        PUSH    H
        PUSH    B
        LXI     H,0FFFFH        ;SELECT FOR MSD
        MVI     E,0
        MOV     B,A             ;SAVE 2 LSD
        JNC     DIS2D           ;JUMP IF LEADING ZEROS SUPPRESSED
        MOV     E,H             ;SHOW LEADING ZEROS
DIS2D:                          ;DISPLAY 2 DIGITS
        MOV     A,D
        RRC
        RRC
        RRC
        RRC
        RRC                     ;GET UPPER 4 BITS TO LOWER 4 BITS
        ANI     0FH             ;MASK OUT UPPER 4 BITS
        JNZ     ZERO2           ;IF DIGIT (LOWER 4 BITS) IS
                                ;NOT EQUAL TO ZERO, JUMP
        CMP     E
        JNZ     ZERO2+1         ;IF ALL PREVIOUS 0, BLANK
        MVI     A,0FH           ;BLANK DIGIT
        JMP     ZERO2+1         ;SKIP NEXT INSTRUCTION
ZERO2:
        MOV     E,A             ;NON ZERO DIGIT
        CALL    DISOT           ;DISPLAY OUTPUT
        MOV     A,D
        ANI     0FH             ;GET DIGIT 2
        JNZ     ZERO3           ;IF DIGIT(LOWER 4 BITS) IS
                                ;NOT EQUAL TO ZERO, JUMP
        CMP     E
        JNZ     ZERO3+1         ;IF ALL PREVIOUS 0,BLANK
        ADD     H               ;ZERO UPPER 4 BITS IF DIGIT
                                ;SELECT IS FOR LSD
        MOV     A,D             ;SET A=XOH
        JP      ZERO3+1         ;IF LSD, DISPLAY 0
        MVI     A,0FH           ;BLANK DIGIT
        JMP     ZERO3+1
ZERO3:
        MOV     E,A             ;NON ZERO DIGIT TO E
        CALL    DISOT           ;DISPLAY OUTPUT
        MOV     A,H             ;GET DIGIT SELECT
        ANA     A               ;SET FLAGS
        MOV     D,B             ;2 LSD TO D
        JPO     DIS2D           ;JUMP IF H HAS A LOW BIT
                                ;TO SELECT DIGIT
        MOV     A,B             ;RESTORE A FROM BEGINNING
                                ;VALUE
        POP     B
        POP     H
        POP     D
        RET
DISOT:                          ;DISPLAY OUTPUT
        ORI     0F0H            ;SET UPPER 4 BITS HI
        MOV     C,A
        ANA     H               ;MOVE DIGIT SELECT TO A UPPER 4 BITS
        OUT     DISPY           ;OUTPUT DIGIT
        MOV     A,C             ;RETURN DIGIT VALUE TO A
        OUT     DISPY           ;STORE DIGIT
        DAD     H               ;SHIFT DIGIT SELECT TO NEXT DIGIT
        RET
;
;ROUTINE:SMS
;
;STEPPER MOTOR SPEED
;
;THIS ROUTINE DETERMINES WHETHER THE STEPPER MOTOR IS TO
;BE RAMPING UP OR DOWN OR AT A MAXIMUM OR FIXED SPEED.
;
;DESTROYS:A,H,L,FLAGS
;
```

```
SMSPD:
        PUSH    B
        PUSH    D
        LXI     D,STPTB-1       ;STEP TABLE ADDR-1
        LXI     H,MSPDS         ;MAX SPEED STATUS
        MVI     A,80H           ;A=80H
        CMP     M               ;CHECK STATUS
        INX     H               ;M=MAXIMUM SPEED
        MOV     B,M             ;B=MAXIMUM SPEED
        STC                     ;SET CARRY SO THAT CONDITIONAL
                                ;RETURN WILL OCCUR IF AT MAX SPD
        JZ      SPD01           ;IF MAX SPEED, OUTPUT
        INX     H               ;M=RSTPN(RAMP STEP #)
        MOV     C,M             ;C=RSTPN
        INX     H               ;M=RAMP UP STATUS
        CMP     M               ;M=80?
        DCX     H               ;M=RAMP STEP #
        JZ      URAMP           ;JUMP IF RAMP UP STATUS=80H
DRAMP:                          ;DOWN RAMP
        MOV     A,C             ;RAMP STEP # TO A
        ADD     E               ;ADD RAMP STEP # TO BASE
                                ;ADDRESS LOCATION
        MOV     E,A             ;BASE + RSTPN RETURNED
        LDAX    D               ;NEW SPEED TO A
        DCR     C               ;DECREASE RSTPN(RAMP STEP #)
        MOV     M,C             ;SAVE RSTPN
        CMP     B               ;CHECK MAX & NEW SPEED
        JC      SPD02           ;NWSPD<MXSPD THEN JUMP
        STC                     ;CARRY CAUSES CONDITIONAL RET
        JMP     SPD01
URAMP:                          ;UP RAMP
        INR     C               ;INCREASE RSTPN(RAMP STEP #)
        MOV     M,C             ;SAVE RSTPN
        MOV     A,C             ;A=RSTPN
        CMA
        MOV     C,A             ;SAVE COMPLEMENTED STEP NUMBER
        CMA
        ADD     E               ;ADD RAMP STEP # TO BASE LOCATION
        MOV     E,A             ;BASE +RSTPN RETURNED
        LDAX    D               ;NEW SPEED TO A
        CMP     B               ;CHECK MAX & NEW SPEED
        JC      SPD02           ;NWSPD<MXSPD?
MX:                             ;MAXIMUM SPEED REACHED THIS
                                ;TIME
        INX     H               ;M=URAPS(UP RAMP STATUS)
        MVI     M,0             ;CLEAR RAMP UP STATUS
        LXI     H,MSPDS         ;M=MSPDS(MAX SPEED STATUS)
        MVI     M,80H           ;SET MAX SPEED STATUS
        MOV     L,C             ;SAVE RSTPN(RAMP STEP #)
SPD01:
        MOV     A,B             ;A=MXSPD(MAX SPEED)
SPD02:
        OUT     SPDGN           ;TO SPEED GENERATOR
        POP     D
        POP     B
        RC                      ;RETURN IF MAX SPEED WAS NOT
                                ;REACHED THIS TIME
        LDA     NCTMS           ;NO CUT MARK STATUS
        ANA     A               ;SET FLAGS
        JM      RPDNA           ;JUMP IF NO CUT MARK STATUS
        MOV     A,L             ;COMPLEMENTED RAMP DOWN STEPS
        INR     A               ;MAKE TWO'S COMPLEMENT
        LXI     H,ACTF1         ;LOCATION OF TWO LSD OF AFTER
                                ;CUT MARK FEED
        ADD     M               ;SUBTRACT RAMP DOWN STEPS
        MOV     M,A             ;SAVE NEW FEED LENGTH
        RC                      ;RETURN IF CARRY
        INX     H               ;LOCATION OF MSD OF AFTER
                                ;CUT MARK FEED
        DCR     M               ;REDUCE MSD BY ONE
        RET
RPDNA:                          ;RAMP DOWN ADJUSTMENT
        MVI     H,0FFH
```

```
        DAD     B           ;REDUCE TOTAL FEED BY RAMP
                            ;DOWN STEPS.
        INX     H           ;ADJUST FOR CARRY
        MOV     B,H         ;FEED BEFORE RAMP DOWN
        MOV     C,L         ; TO BC
        RET
;
;ROUTINE:TRTM
;
;THIS ROUTINE ENERGIZES THE CUT SOLENOID FOR THE
;LENGTH OF TIME DETERMINED BY CUTL.  IF ENTRY IS
;MADE AT TRIM1 THE SOLENOID WILL BE TURNED OFF
;AFTER THE PROPER ENERGIZATION TIME.
;
TRIM:
        OUT     CTON        ;TURN CUT SOLENOID ON
        MVI     A,CUTL-3            ;CUT SOLENOID ON TIME
        CALL    DELAY
TRIM1:
        MVI     A,3         ;ENTRY POINT WHEN EARLY CUT
        CALL    DELAY
        OUT     CTOFF       ;TURN CUT SOLENOID OFF
        RET
;
;ROUTINE:DB
;
;THIS IS THE LOOK UP TABLE FOR THE SELECTED SPEED.
;THE STEP RATE IS (41.66 STEPS/SEC)(LOOK UP)
;
        ORG     SPDTB
SPDTB:  DB      16H,20H,24H,29H,36H         ;SELECT 0-4
        DB      44H,54H,66H,81H,99H         ;SELECT 5-9
;
;THIS IS THE LOOK UP TABLE FOR THE STEPPER MOTOR RAMP.
;
;               SPEED(41.66 STEP/SEC)(LOOKUP)    STEP#
;
STPTB:  DB      16H,29H,49H,37H,44H,50H,58H      ;1-7
        DB      61H,63H,65H,68H,70H,72H,74H      ;8-14
        DB      76H,78H,79H,82H,83H,83H,84H      ;15-21
        DB      87H,87H,87H,90H,90H,91H,92H      ;22-28
        DB      92H,92H,93H,94H,94H,94H,96H      ;29-35
        DB      96H,97H,98H,98H,99H              ;36-40
;
;ROUTINE:DS
;
        ORG     DSTOR
SWSTM:  DS      1           ;STATUS OF PB & TOGGLE SWITCHES
NCTMS:  DS      1           ;BIT 7 HI,NO CUT MARK STATUS
LONFD:  DS      1           ;BIT 7 HI IF NEW PAPER ROLL
MXPRM:  DS      1           ;MAX NUMBER PRINTS THIS ORDER(BCD)
CTOTM:  DS      1           ;CUT OUT LENGTH-MEMORY(BINARY)
ACTF1:  DS      1           ;2 LSD,FEED AFTER CT MARK(BINARY)
ACTF2:  DS      1           ;MSD,FEED AFTER CUT MARK(BINARY)
MSPDS:  DS      1           ;BIT 7 HI,AT MAX SPEED
MXSPD:  DS      1           ;MAX SPEED
RSTPN:  DS      1           ;RAMP STEP #
URAPS:  DS      1           ;BIT 7 HI,RAMP UP STATUS
RRPDN:  DS      1           ;BIT 7 HI,READY TO RAMP DOWN
ACTM:   DS      1           ;BIT 7 HI,LOOKING FOR END OF PRT
CTVAL:  DS      1           ;BIT 7 HI,CUT MARK IS ACCEPTABLE
MISCM:  DS      1           ;CUT MARK YET TO MISS
PFD1:   DS      1           ;2 LSD OF FEED LAST CUT(BINARY)
PFD2:   DS      1           ;MSD OF FEED LAST CUT(BINARY)
PRCT:   DS      1           ;# OF PRINTS CUT THIS ORDER(BCD)
ORDCT:  DS      3           ;# ORDERS TOTAL(BCD)
PRCT1:  DS      3           ;# PRINTS CUT TOTAL(BCD)
CTMNW:  DS      1           ;BIT 7 HI,CUT MARK ON PRESENT
                            ;(NEW) CUT
CTMOD:  DS      1           ;BIT 7 HI,CUT MARK ON PREVIOUS
                            ;(OLD) CUT
```

```
STOPM:   DS    1     ;BIT 7 HI,STOP SELECTED SINCE
                     ;LAST CUT
MFDL:    DS    2     ;MEASURED FEED LENGTH(BCD)
MFDAC:   DS    2     ;MEASURED FEED LENGTH AFTER
                     ;CUT MARK(BCD)
PWRON:   DS    1     ;BIT 7 HI IF PRINTS HAVE BEEN CUT
                     ;SINCE POWER ON & NO ERROR IN LAST ADVANCE
TOT1?:   DS    1     ;BIT 7 HI IF FIRST TOTAL HAS
                     ;BEEN DISPLAYED
DIG4S:   DS    1     ;BIT 7 HI IF UPPER FOUR DIGITS ARE
                     ;TO BE DISPLAYED NEXT
CTELY:   DS    1     ;BIT 7 HI IF CUT SOLENOID IS TO BE
                     ;ENERGIZED EARLY WHEN RAMP DOWN BEGINS
REQCM:   DS    1     ;BIT 7 HI IF CUT MARKS REQUIRED ON ALL PRINTS
WHY:     DS    2     ;CONTAINS ADDRESS OF REASON FOR PAPER CUTTER STOP
         END
```

What is claimed is:

1. A photographic paper cutter comprising:

stepper motor means for advancing the photographic paper in steps;

knife means for cutting the photographic paper;

indicia sensing means for sensing indicia on the photographic paper indicative of desired locations of paper cuts and producing a cut signal when an indicium is sensed, the indicia sensing means being positioned in fixed relationship with respect to the knife means at a distance less than the shortest length of photographic paper to be cut;

means for producing a feed length signal indicative of the number of steps the photographic paper is advanced from one indicium to another indicium;

means for producing a signal indicative of the number of steps the paper is advanced between a desired location of a paper cut and an indicium;

feed-after-sense signal means for deriving a feed-after-sense signal from the feed length signal and the signal indicative of the number of steps the paper is advanced between a desired location of a paper cut and an indicium, wherein the feed-after-sense signal is a digital signal indicative of the number of steps the photographic paper must be advanced after a cut signal is received in order to align the desired location of paper cut associated with the sensed indicium with the knife means; and means for controlling operation of the stepper motor means as a function of the feed-after-sense signal and the cut signal to cause the stepper motor means to advance the photographic paper until an indicium is sensed and then advance the paper an additional distance determined by the feed-after-sense signal.

2. The photographic paper cutter of claim 1 wherein the means for producing a feed length signal comprises:

means for causing the drive means to advance the photographic paper from one indicium to another indicium;

means for counting the number of steps the paper was advanced; and means for storing a feed length signal indicative of the number of steps the paper was advanced.

3. The photographic paper cutter of claim 2 and further comprising:

means for storing the feed-after-sense signal.

4. The photographic paper cutter of claim 3 wherein the means for storing the feed-after-sense signal comprises:

the means for displaying the number indicative of the feed-after-sense signal; and operator controlled feed-after-sense switch means for storing the number displayed.

5. The photographic paper cutter of claim 4 wherein the means for storing a feed length signal comprises:

means for displaying a number indicative of the number of steps the paper was advanced; and operator controlled feed length switch means for storing the number displayed.

6. The photographic paper cutter of claim 5 and further comprising:

mode switch means for causing the photographic paper cutter to generate the feed length signal when in a feed length calibrate mode and causing the photographic paper cutter to generate the feed-after-sense signal when in a feed-after-sense mode.

7. The photographic paper cutter of claim 1 and further comprising:

means for storing the number of steps required to advance the photographic paper from the indicia sensing means to the knife means.

8. The photographic paper cutter of claim 7 wherein the means for deriving the feed-after-sense signal derives the feed-after-sense signal from a feed length signal, the signal indicative of the number of steps the paper is advanced between a location of a paper cut and indicium, and the number of steps required to advance the photographic paper from the indicia sensing means to the knife means.

9. In a photographic paper cutter for cutting photographic prints from a strip of photographic paper bearing indicia indicative of desired cut locations, the photographic paper cutter including paper drive means for driving the strip along a path and knife means for cutting the strip, the improvement comprising:

indicia sensing means for sensing the indicia, the indicia sensing means being positioned along the path a fixed distance from the knife means, the fixed distance being less than the shortest length of print to be cut from the strip;

means for producing a feed length signal indicative of a distance between one indicium and another indicium;

means for producing a signal indicative of a distance between a desired cut location and an indicium;

feed-after-sense signal means for deriving, from the feed length signal and the signal indicative of the distance between the desired cut location and an indicium, a feed-after-sense signal indicative of a feed length that the strip is to be fed after an indicia is sensed in order for the strip to be cut at a desired cut location; and paper cutter control means for controlling operation of the paper drive means and paper cutter means to cause the strip to be fed until an indicium is sensed and then fed an additional distance determined by the feed-after-sense signal and cut.

* * * * *